US005583619A

United States Patent [19]

Tanaka et al.

[11] Patent Number: 5,583,619

[45] Date of Patent: Dec. 10, 1996

[54] IMAGE FORMING APPARATUS CAPABLE OF FORMING INVERTED AND NON-INVERTED IMAGE

[75] Inventors: Masayuki Tanaka; Masato Sone; Motoaki Mushika; Yasuhiro Kishimoto, all of Gifu, Japan

[73] Assignee: Sanyo Electric Co., Ltd., Moriguchi, Japan

[21] Appl. No.: 277,889

[22] Filed: Jul. 20, 1994

[30] Foreign Application Priority Data

| | | | |
|---|---|---|---|
| Jul. 22, 1993 | [JP] | Japan | 5-181083 |
| Jul. 22, 1993 | [JP] | Japan | 5-181084 |
| Jul. 22, 1993 | [JP] | Japan | 5-181085 |
| Aug. 20, 1993 | [JP] | Japan | 5-206383 |

[51] Int. Cl.[6] ..... G03G 15/02

[52] U.S. Cl. ..... 355/219; 355/225

[58] Field of Search ..... 355/219, 221, 355/225

[56] References Cited

U.S. PATENT DOCUMENTS

| | | | |
|---|---|---|---|
| 4,141,648 | 2/1979 | Gaitten et al. | 355/225 |
| 4,591,262 | 5/1986 | Oseto et al. | 355/221 |
| 4,920,380 | 4/1990 | Ueda et al. | 355/219 |
| 5,049,935 | 9/1991 | Saito et al. | 355/219 |
| 5,394,221 | 2/1995 | Kishimoto et al. | 355/219 X |

*Primary Examiner*—Fred L. Braun

*Attorney, Agent, or Firm*—Darby & Darby, P.C.

[57] ABSTRACT

An image forming apparatus includes a microcomputer which increments a mode counter each time a copying operation is completed in a selected one of a non-inverted or inverted image forming mode. After the completion of the copying operation in the selected mode, when the image forming mode is changed to the other image forming mode, a time is set in a timer according to the count value of the previously used selected image forming mode counter and a photosensitive drum is pre-charged to a predetermined voltage corresponding to the image forming mode to be utilized next. Therefore, a pre-charge time can be set for one of the inverted and non-inverted image forming modes in accordance with the number of image forming operations carried out in the preceding selected image forming mode. The transfer corona producing source of the apparatus can be used as the pre-charging voltage source when the inverted image forming mode is selected and the main corona producing source can be used when the non-inverted image mode is selected.

12 Claims, 52 Drawing Sheets

IMAGE FORMING APPARATUS CAPABLE OF FORMING INVERTED AND NON-INVERTED IMAGE

BACKGROUND OF THE INVENTION

1. Field of the Invention

The present invention relates to an image forming apparatus. More specifically, the present invention relates to an image forming apparatus in which one of a non-inverted image and an inverted image is formed by developing an electrostatic latent image formed on a surface of a photosensitive member being charged in one of a positive polarity and a negative polarity.

2. Description of the Prior Art

In such a kind of image forming apparatus, at a time just after an image forming mode is changed between a non-inverted image forming mode and an inverted image forming mode by changing a charging polarity of the photosensitive member, a charged voltage of the photosensitive member at the start of a succeeding image forming mode is small due to an influence of a preceding image forming mode.

Therefore, in Japanese Patent Application Laying-open No. 1-294057 laid open on Nov. 28, 1989, it is proposed that an image forming process is started after the photosensitive member is charged in advance (pre-charged) for a predetermined time with a charging polarity adapted to the succeeding image forming mode. However, an image forming apparatus disclosed in the above described prior art, a pre-charge time is required, and therefore, there was a problem that it takes a long time until the image forming process is started.

SUMMARY OF THE INVENTION

Therefore, a principal object of the present invention is to provide a novel image forming apparatus.

Another object of the present invention is to provide an image forming apparatus in which a pre-charge time can be shortened.

Another object of the present invention is to provide an image forming apparatus in which a pre-charge time in a succeeding image forming mode is controlled by taking a status in a preceding image forming mode into consideration.

Another object of the present invention is to provide an image forming apparatus in which it is possible to largely shorten a pre-charge time at a time that an image forming mode is changed from an inverted image forming mode to a non-inverted image forming mode.

An image forming apparatus according to the present invention is an image forming apparatus in which a photosensitive member is pre-charged prior to starting an image forming process, and comprises: charging means for charging the photosensitive member with a predetermined polarity; forming means for forming an electrostatic latent image on the photosensitive member being charged by the charging means; developing means for developing the electrostatic latent image to obtain a toner image; transfer means for applying a transferring electric field to transfer the toner image onto a paper; selecting means for selecting one of a non-inverted image forming mode and an inverted image forming mode; parameter means for evaluating a time related parameter in an image forming mode prior to a different image forming mode as selected by the selecting means; timer means in which a pre-charge time is set on the basis of the time related parameter; and turning-on means for turning-on one the charging means and the transfer means during the pre-charge time prior to starting an image forming process of one of the non-inverted image forming mode and the inverted image forming mode.

When the image forming process is performed in the inverted image forming mode, for example, the number of image forming operations in the inverted image forming mode is counted by a mode counter, and a count value of the mode counter becomes a time related parameter. After completion of the image forming process, when the image forming mode is changed into the non-inverted image forming mode by operating a mode changing switch, for example, prior to starting the image forming process in the non-inverted image forming mode, the transfer means is turned-on by the turning-on means for the time according to the count value, i.e., the time related parameter, and therefore, the photosensitive member is pre-charged by the transfer means with a negative polarity, for example. Thus, it is possible to control the pre-charge time in accordance with a degree of a recovery of fatigue of the photosensitive member, and therefore, the pre-charge time can be shortened.

In another aspect of the present invention, an image forming apparatus is an image forming apparatus in which a photosensitive member is pre-charged prior to starting an image forming process, and comprises: charging means for charging the photosensitive member with a predetermined polarity; forming means for forming an electrostatic latent image on the photosensitive member being charged by the charging means; developing means for developing the electrostatic latent image to obtain a toner image; transfer means for applying a transferring electric field to transfer the toner image onto a paper; selecting means for selecting one of an inverted image forming mode and a non-inverted image forming mode; and turning-on means for continuously turning-on the transfer means for a predetermined time after completion of the image forming process in the inverted image forming mode. In this aspect, for the predetermined time after the completion of a last transferring process in the inverted image forming mode, the transferring electric field is continuously applied to the photosensitive member. Therefore, if the non-inverted image forming mode is then selected by the selecting means, the pre-charge time can be shortened because the influence of the positive polarity charge of the photosensitive member in the inverted image forming mode has been made small.

In another aspect of the present invention, an image forming apparatus comprises: a photosensitive member; charging means for charging the photosensitive member with a predetermined polarity; forming means for forming an electrostatic latent image on the photosensitive member being charged by the charging means; developing means for developing the electrostatic latent image to obtain a toner image; transfer means for applying a transferring electric field to transfer the toner image onto a paper; selecting means for selecting one of an inverted image forming mode and a non-inverted image forming mode; start key means for starting an image forming process; and turning-on means for turning-on the transfer means for a predetermined time in response to an operation of the start key means. In this aspect, at a time that the image forming process in the non-inverted image forming mode is started in response to the operation of the start key means, the transfer means is turned-on for the predetermined time, and therefore, the photosensitive member is pre-charged by the transfer means with a negative polarity, for example. On the other hand, if the non-inverted image forming mode is selected, the transfer means is turned-on with a reversed polarity for the predetermined time in starting the image forming process, and therefore, the photosensitive member is pre-charged by the transfer means with a positive polarity, for example. Thus, since the photosensitive member is pre-charged by the transfer means after the start key means is operated, it is possible to shorten the pre-charge time.

One of the features of the present invention is that the photosensitive member is pre-charged by the transfer means. The transfer means is arranged at a downstream side of the charging means, and therefore, if the photosensitive member is pre-charged by the transfer means the pre-charge time can be shortened in comparison with a case where the photosensitive member is pre-charged by the charging means. In a case where the photosensitive member is a photosensitive drum, for example, since the image forming process is started at a time that the surface of the photosensitive drum being pre-charged by the transfer means becomes to face the charging means, the pre-charge time is defined by a time that the surface of the photosensitive drum is rotated from a position of the transfer means to a position of the charging means. In contrast, in a case where the pre-charged is performed by the charging means, it takes a long time until the surface of the photosensitive drum is rotated so as to be moved to the position of the charging member again, and therefore, the pre-charge time becomes long. Furthermore, in a case where a charger which is utilized for the pre-charge only is provided separately from the charging means, the pre-charge time becomes short; however, the number of components is increased, and therefore, a cost becomes high, and the image forming apparatus can not be miniaturized. In contrast, in accordance with the present invention in which the photosensitive member is pre-charged by the transfer means, no additional component is required, and therefore, a cost becomes low and the image forming apparatus can be made compact.

The above described objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
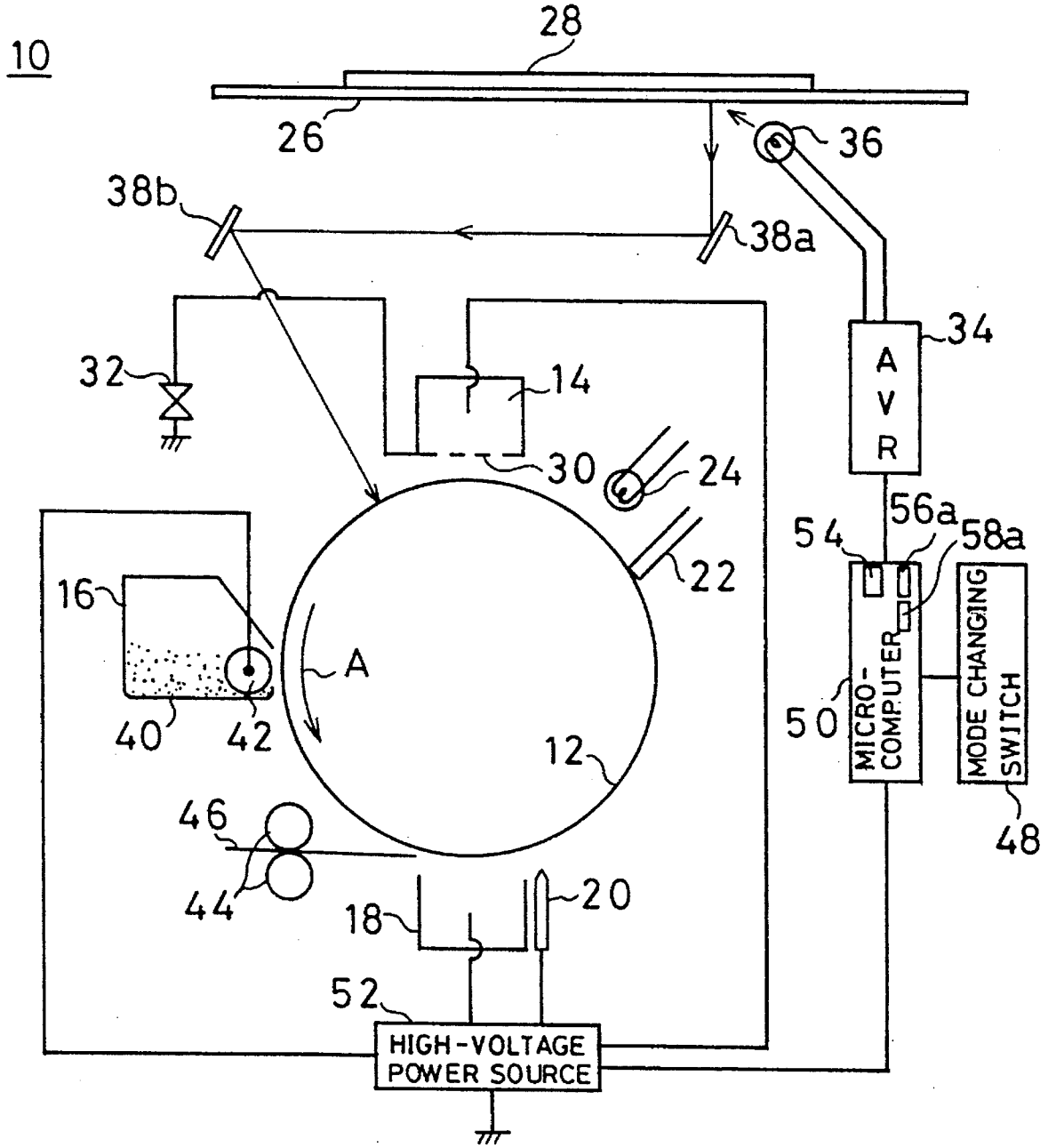
FIG. 1 is an illustrative view showing one embodiment according to the present invention.
Figure 2:
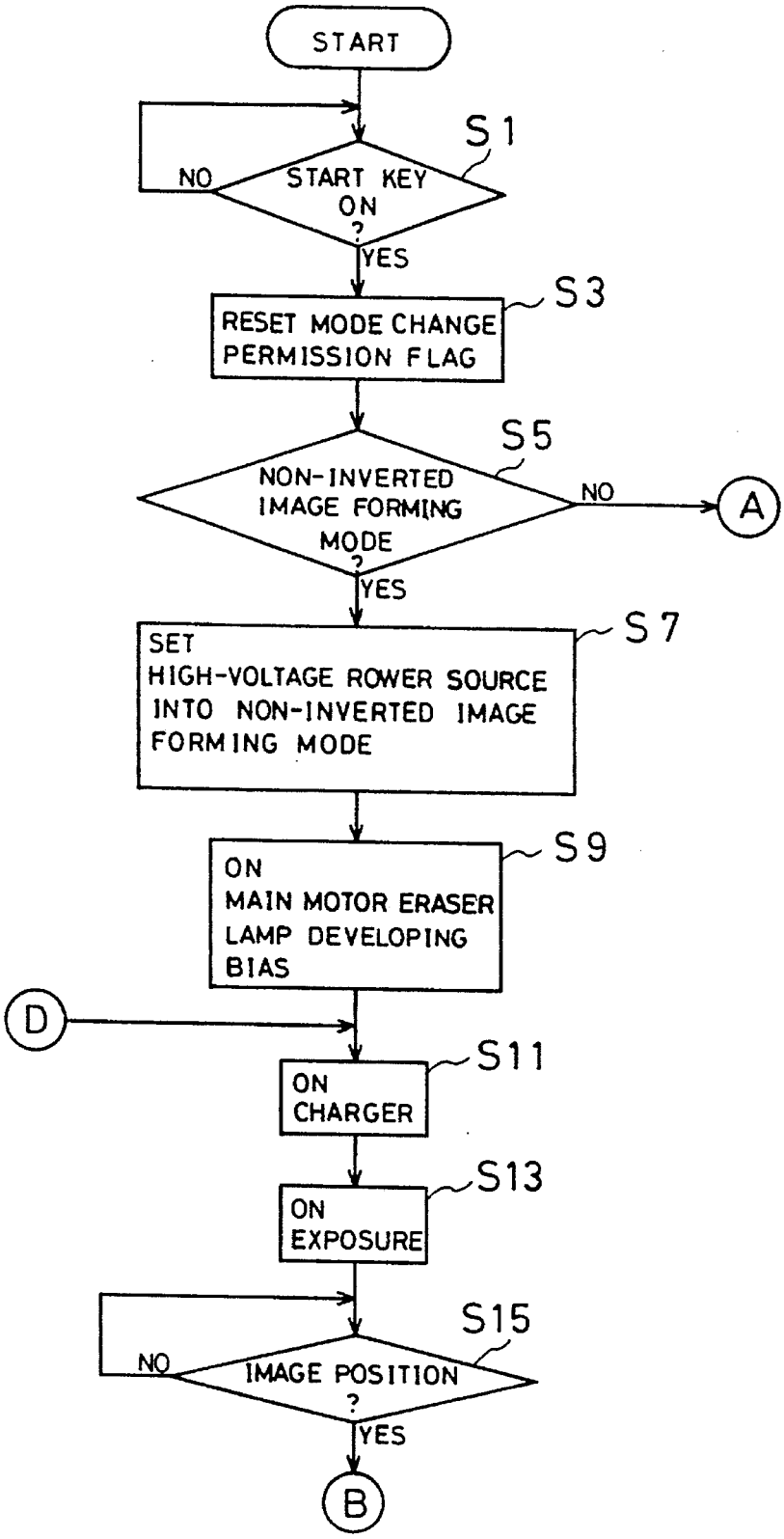
FIG. 2 is a flowchart showing a portion of an operation of the FIG. 1 embodiment.
Figure 3:
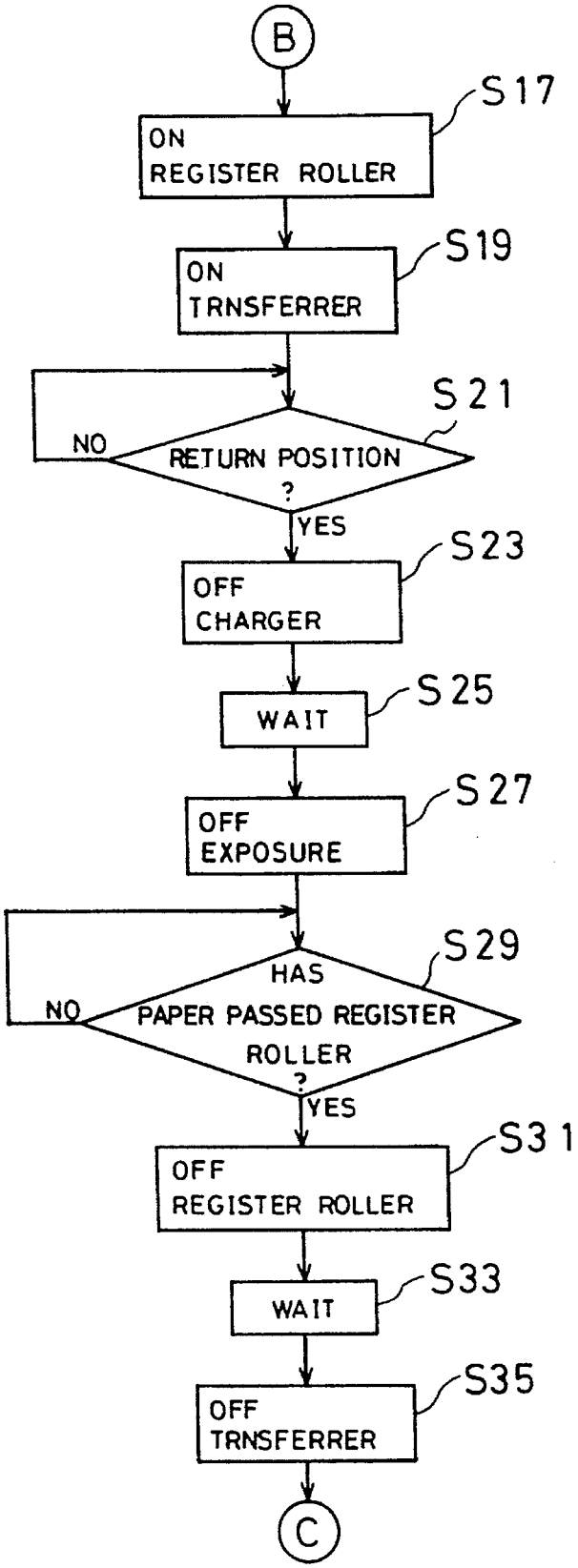
FIG. 3 is a flowchart showing a portion of an operation of the FIG. 1 embodiment.
Figure 4:
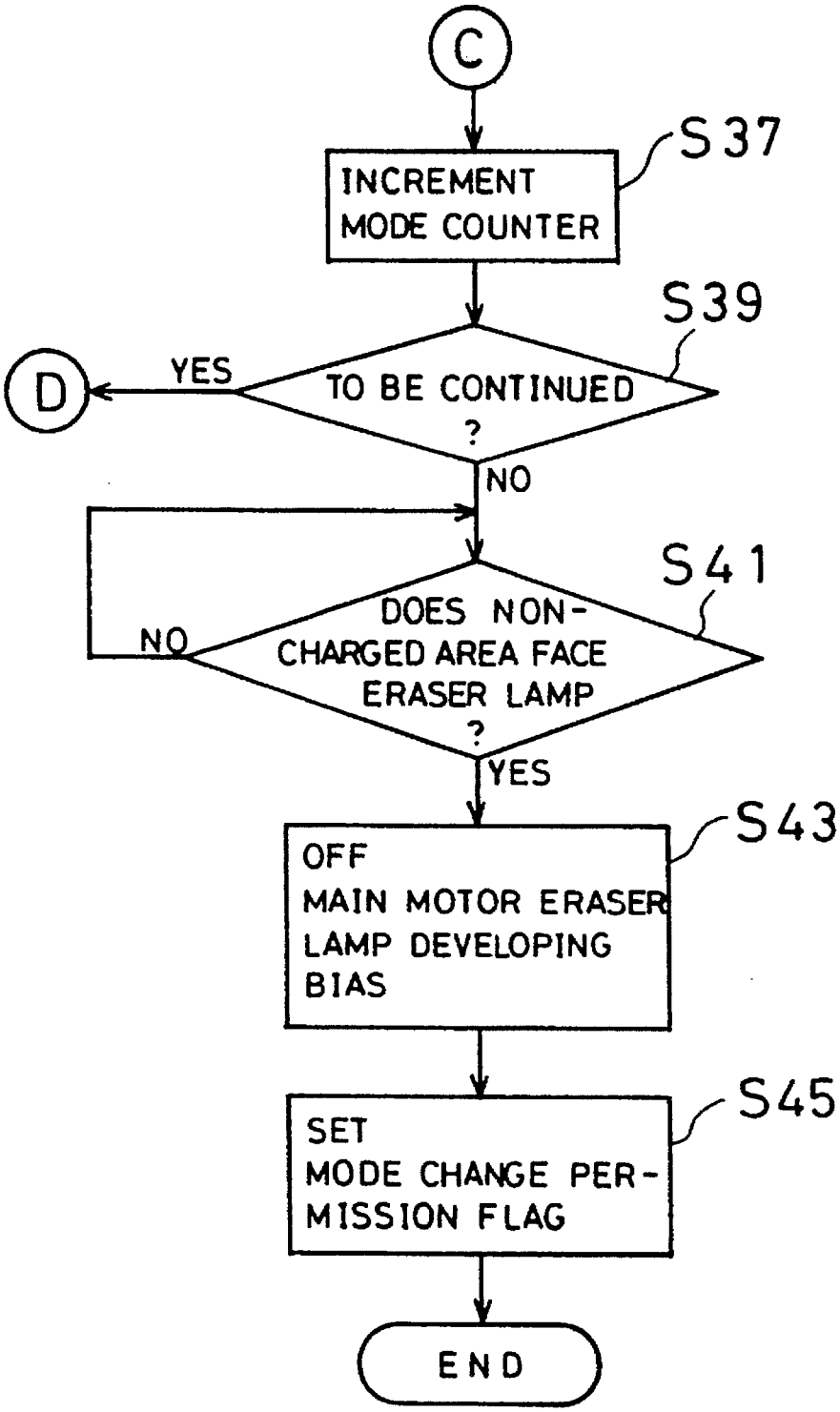
FIG. 4 is a flowchart showing a portion of an operation of the FIG. 1 embodiment.
Figure 5:
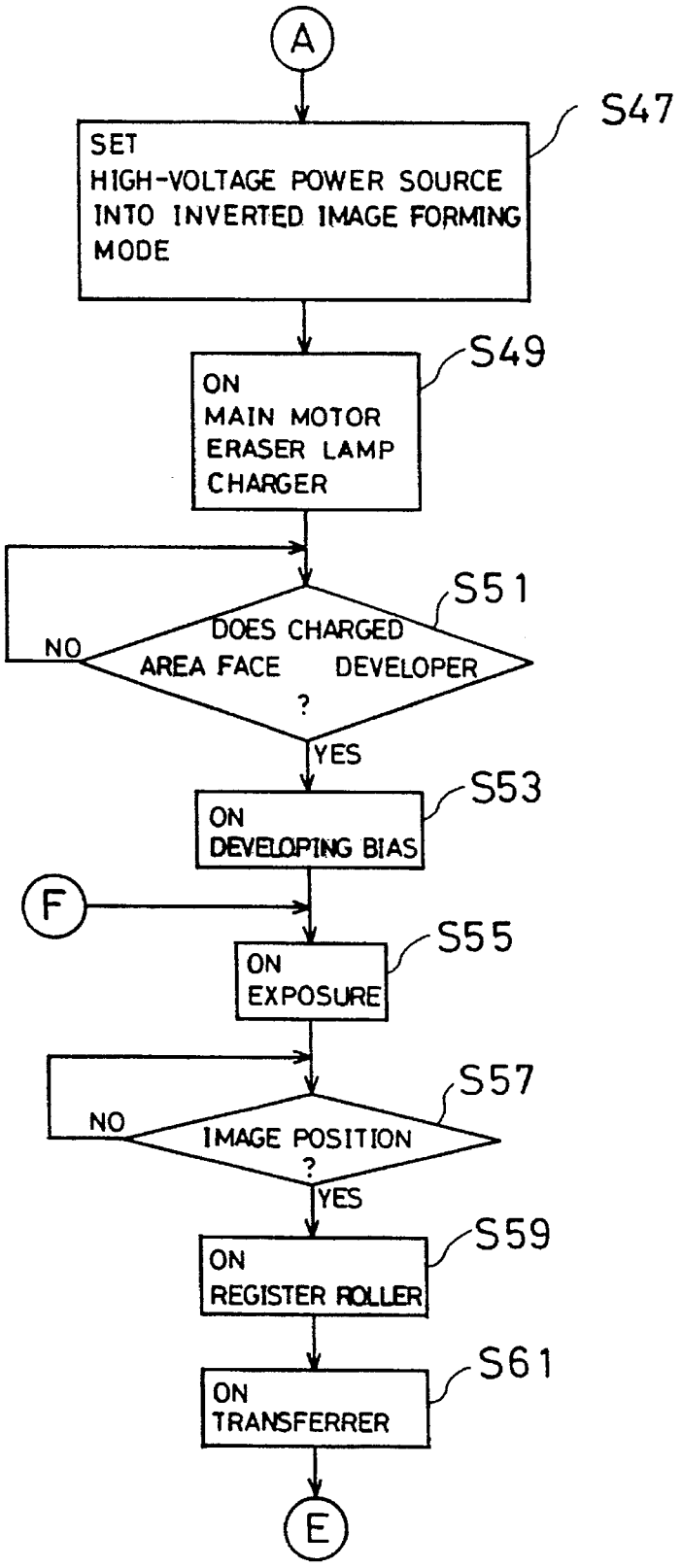
FIG. 5 is a flowchart showing a portion of an operation of the FIG. 1 embodiment.
Figure 6:
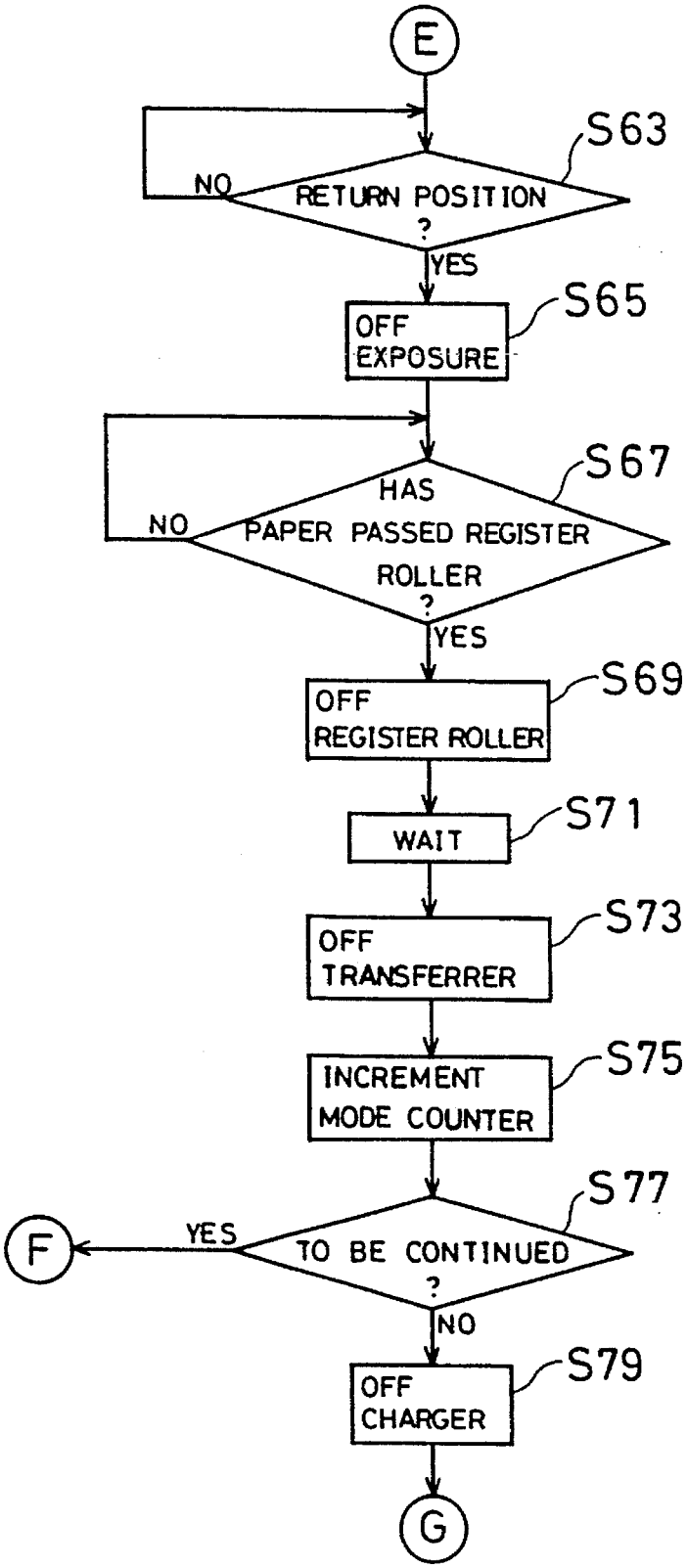
FIG. 6 is a flowchart showing a portion of an operation of the FIG. 1 embodiment.
Figure 7:
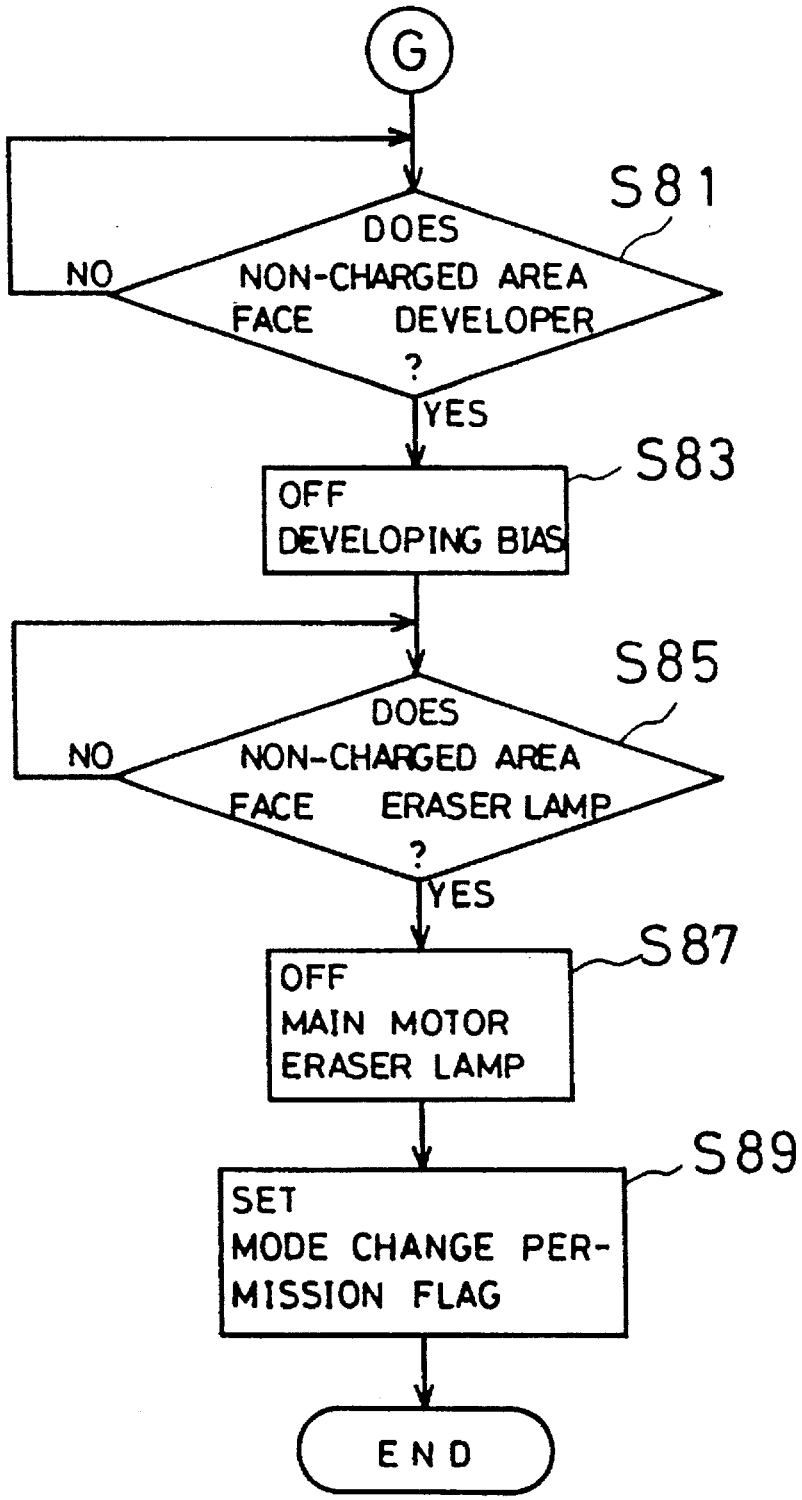
FIG. 7 is a flowchart showing a portion of an operation of the FIG. 1 embodiment.
Figure 8:
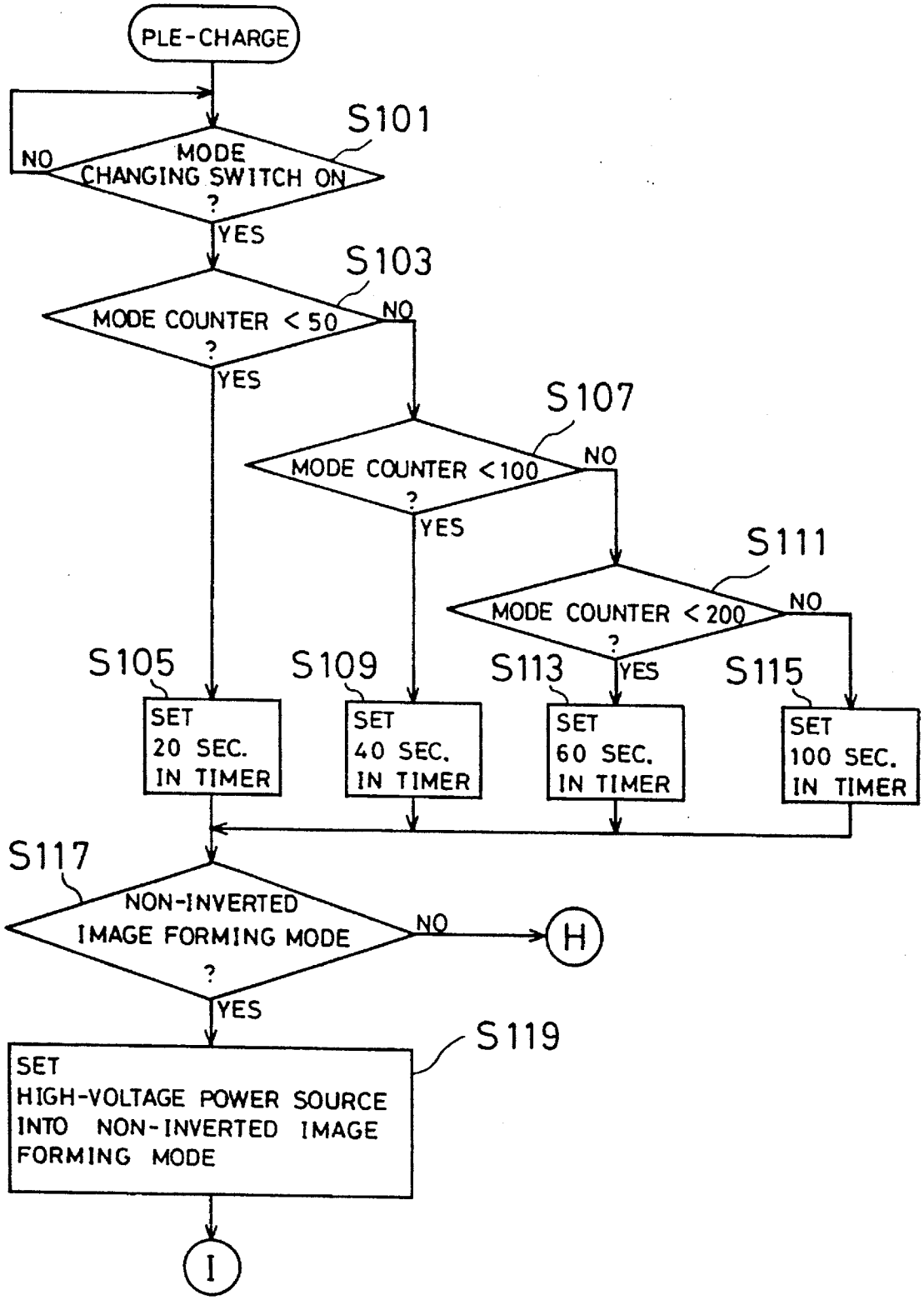
FIG. 8 is a flowchart showing a portion of an operation of the FIG. 1 embodiment.
Figure 9:
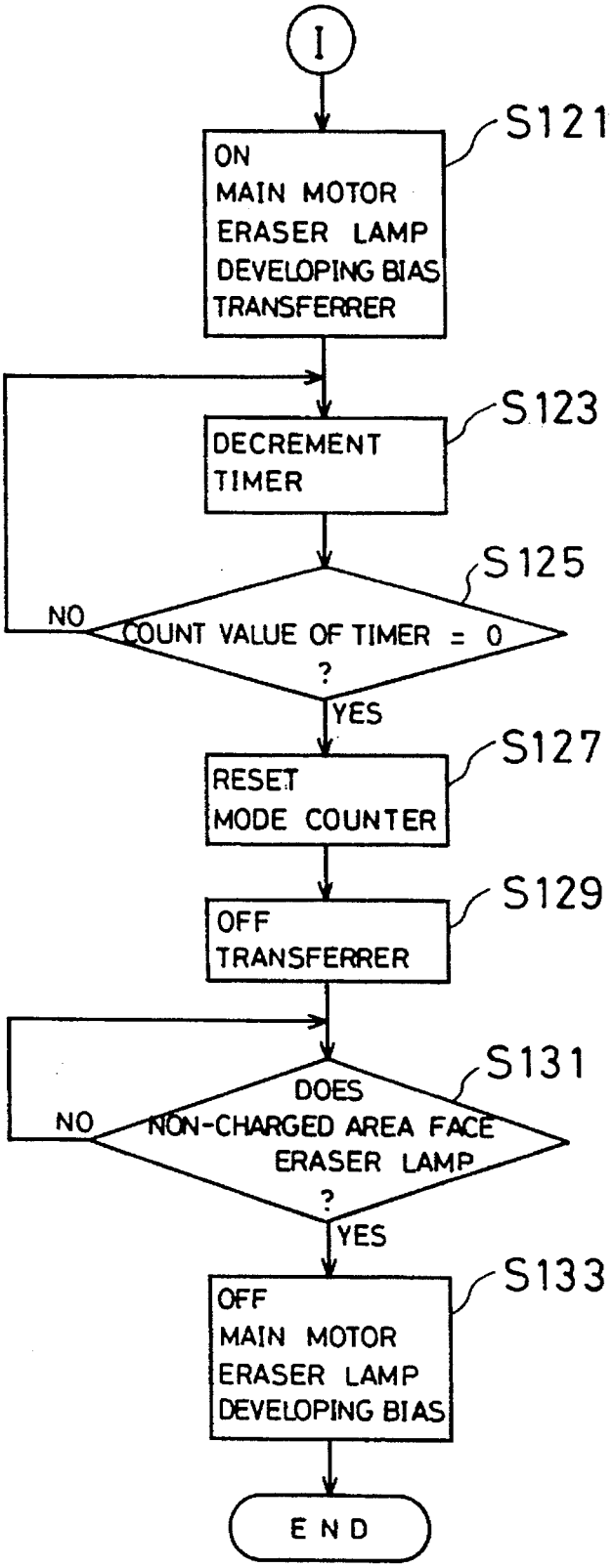
FIG. 9 is a flowchart showing a portion of an operation of the FIG. 1 embodiment.
Figure 10:
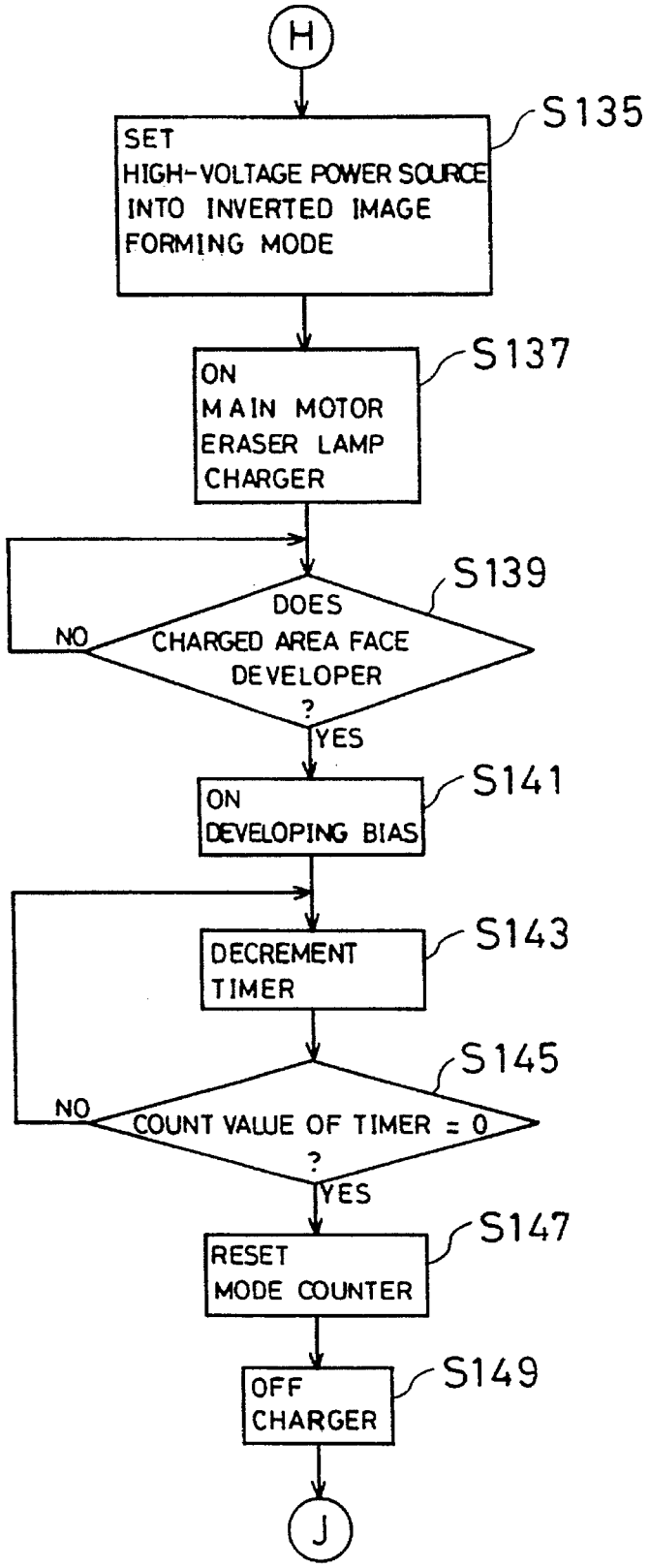
FIG. 10 is a flowchart showing a portion of an operation of the FIG. 1 embodiment.
Figure 11:
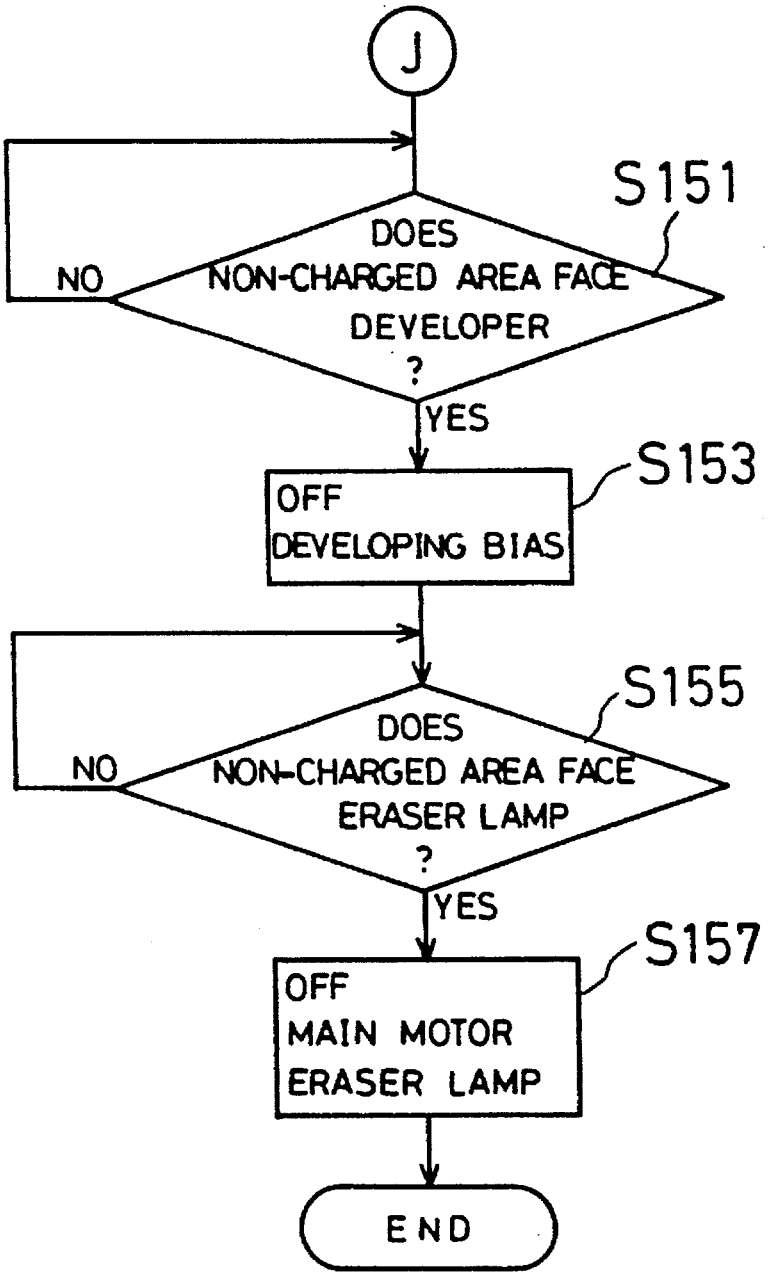
FIG. 11 is a flowchart showing a portion of an operation of the FIG. 1 embodiment.

With referring FIG. 1, an electrophotographying apparatus 10 of this embodiment shown includes a photosensitive drum 12 which is rotated in a direction shown by an arrow mark A. A charger 14 is arranged above the photosensitive drum 12, a developer 16 is arranged at a left side portion of the photosensitive drum 12, a transferrer 18 and a separator 20 are arranged below the photosensitive drum 12. A cleaning blade 22 and an eraser lamp 24 are arranged at right above the photosensitive drum 12. An original table 26 is provided above the charger 14, and an original 28 is put on an upper surface of the original table 26.

The charger 14 is a scorotron charger having a mesh-like grid electrode 30, and the charger 14 is connected to the ground via a varistor 32 which functions as a bi-directional constant voltage diode. Then, a voltage of −6.0 kV, for example, is applied to the charger 14 in a non-inverted image forming mode, and a voltage of +5.5 kV, for example, is applied to the charger 14 in an inverted image forming mode. The photosensitive drum 12 is charged by the charger 14 with a positive polarity or a negative polarity according to respective image forming modes. In this embodiment shown, the photosensitive drum 12 is charged at −630 V, for example, in the non-inverted image forming mode or +600 V, for example, in the inverted image forming mode.

The original 28 is irradiated by an exposure lamp 36 by an amount of light which is controlled by an AVR (Automatic Voltage Regulator) 34, and a light image of the original 28 exposes the photosensitive drum 12 via mirrors 38*a* and 38*b*. A voltage at an exposed portion of the photosensitive drum 12 becomes −100 V, for example, in the non-inverted image forming mode, or +60 V, for example, in the inverted image forming mode, whereby an electrostatic latent image is formed on the photosensitive drum 12 according to the light image of the original 28.

The developer 16 includes a developing agent 40 in which a toner and a carrier are mixed with each other and a developing sleeve 42 by which the developing agent 40 is fed toward the photosensitive drum 12. In addition, the toner is charged with a positive polarity by being agitated with the carrier. Furthermore, a developing bias voltage is applied to the developing sleeve 42 in accordance with the non-inverted image forming mode or the inverted image forming mode. More specifically, a developing bias voltage of −200 V, for example, is applied to the developing sleeve 42 in the non-inverted image forming mode, and a developing bias voltage of +400 V, for example, is applied to the developing sleeve 46 in the inverted image forming mode. Due to an electric field established by the developing bias voltage and a surface voltage of the photosensitive drum 12, the toner is adhered to the non-exposed portions of the photosensitive drum 12 in the non-inverted image forming mode, or the toner is adhered to the exposed portions of the photosensitive drum 12 in the inverted image forming mode. Thus, the electrostatic latent image being formed on the surface of the photosensitive drum 12 is developed by the toner.

The transferrer 18 transfers a toner image formed on the surface of the photosensitive drum 12 onto a paper 46 which is fed by a register roller 44 being arranged at a left side portion of the transferrer 18. More specifically, by applying a voltage or electric field of a negative polarity according to the image forming mode to a rear surface of the paper 46, i.e., to the photosensitive drum 12 by the transferrer 18, the toner on the photosensitive drum 12 is attracted toward the paper by the electric field, and therefore, the toner image is transferred onto the paper 46. The transferring electric field (voltage) in the non-inverted image forming mode is −4.7 kV, for example, and the transferring electric field (voltage) in the inverted image forming mode is −4.3 kV, for example.

In addition, voltages applied to the charger 14, the developer 16 and the transferrer 18, respectively are changed according to the non-inverted image forming mode or the inverted image forming mode. That is, the microcomputer 50 determines the image forming mode of the non-inverted image forming mode or the inverted image forming mode on the basis of a signal from a mode changing switch 48, and controls a high-voltage power source 52 so as to change the voltages to be adapted to the image forming mode as determined. The microcomputer 50 also controls a voltage of the AVR 34. Furthermore, the polarity of the transferring electric field developed by the transferrer 18 is changeable, and therefore, the microcomputer 50 also controls the polarity.

A voltage of a positive polarity is applied to the paper 46 on which the toner image has been transferred by the separator 20, whereby the electric charge of the negative polarity applied by the transferrer 18 is neutralized, and therefore, the paper 46 is separated from the photosensitive drum 12. Thereafter, the paper 46 is fed to a fixer (not shown), and therefore, the toner image transferred onto the paper 46 is fixed to the paper 46.

The cleaning blade 22 recovers the toner remaining on the photosensitive drum 12. Furthermore, the eraser lamp 24 removes the electric charge remaining on the photosensitive drum 12.

In addition, at a time of the pre-charge, the photosensitive drum 12 is not exposed, and if the image forming mode is changed from the non-inverted image forming mode to the inverted image forming mode, the photosensitive drum 12 is pre-charged with the positive polarity by the charger 14, and if the image forming mode is changed from the inverted image forming mode to the non-inverted image forming mode, the photosensitive drum 12 is pre-charged with the negative polarity by the transferrer 18.

Next, with referring FIG. 2 to FIG. 7, a control operation of the microcomputer 50 in the image forming process will be described. At first, if a start key (not shown) is turned-on in a step S1, a mode change permission flag included in the microcomputer 50 is reset in a step S3, and then, in a step S5, the microcomputer 50 determines on the basis of the signal from the mode changing switch 48 whether a desired image forming mode is the non-inverted image forming mode or the inverted image forming mode. If the desired mode is the non-inverted image forming mode, in a step S7, the high-voltage power source 52 is set to be adapted to the non-inverted image forming mode, and then, in a step S9, the microcomputer 50 turns-on a main motor (not shown) for driving the photosensitive drum 12, the eraser lamp 24 and the developing bias applied to the developing sleeve 42. Succeedingly, the charger 14 is turned-on in a step S11, and in a step S13, the light exposure is started, that is, the exposure lamp 36 is turned-on. Next, if it is determined in a step S15 that the exposure lamp 36 reaches an image position for reading the original 28, in a step S17, the register roller 44 is driven such that a leading end of the electrostatic latent image formed on the photosensitive drum 12 and a leading end of the paper 46 become coincident with each other.

Next, in a step S19, the transferrer 18 is turned-on, and thereafter, if it is determined in a step S21 that the exposure lamp 38 reaches a return position, in a step S23, the charger 14 is turned-off. When a charge ended area (non-charged area) of the photosensitive drum 12 faces the exposure lamp 36 in a step S25, in a step S27, the exposure is terminated. Thereafter, if the paper 46 is passed through the register roller 44 in a step S29, in a step S31, the register roller 44 is turned-off, and it is waited in a step S33 that the paper 46 passes the transferrer 18. Then, the transferrer 18 is turned-off in a step S35, and a mode counter **56*a* included in the microcomputer 50 is incremented in a step S37. If it is determined in a step S39 that a condition that a copy is to be continued, the steps after the step S11 are repeated; however, in a case of one sheet copy or a last copy of the continuous copy, after it is detected in a step S41 that the charge ended area faces the eraser lamp 24, the main motor, the eraser lamp 24 and the developing bias are turned-off in a step S43, and in a step S45**, the mode change permission flag is reset, and then, the process is terminated.

If it is detected in the step S5 that the desired image forming mode is the inverted image forming mode, the microcomputer 50 controls the high-voltage power source 52 so as to adapt the high-voltage power source 52 to the inverted image forming mode in a step S47. Thereafter, in a step S49, the microcomputer 50 turns-on the main motor, the eraser lamp 24 and the charger 14. Next, if it is detected in a step S51 a charged area of the photosensitive drum 12 by the charger 14 faces the developer 16, in a step S53, the developing bias is turned-on, and then, in a step S55, the exposure is started. In addition, is the reason why the developing bias is turned-on at a time that the charged area faces the developer 16 is different from the non-inverted image forming mode is that the developing bias voltage in the inverted image forming mode is +400 V, for example, and therefore, if the developing bias is turned-on prior to the charged area faces the developer 16, the toner is adhered to the photosensitive drum 12. If the exposure lamp 36 is moved to the image position of the original 28 in a step S57, in a step S59, the register roller 44 is driven, and the transferrer 18 is turned-on in a step S61. Thereafter, if the exposure lamp 34 reaches the return position in a step S63, in a step S65, the exposure is terminated, and the register roller 44 is turned-off after it is determined in a step S67 that the paper 46 passed the register roller 44.

Thereafter, if it is detected in a step S71 that the paper 46 passed through the transferrer 18, in a step S73, the transferrer 18 is turned-off, and the mode counter 56 is incremented in a step S75. Next, if it is detected in a step S77 that the continuous copy is set, the process returns to the step S55; however, in a case of the one sheet copy or the last copy of the continuous copy, in a step S79, the charger 14 is turned-off. Thereafter, if it is detected in a step S81 that the charge ended area of the photosensitive drum 12 faces the developer 16, in a step S83, the developing bias is turned-off, and if the charge ended area faces the eraser lamp 24 in a step S85, in a step S87, the main motor and the eraser lamp 24 are turned-off. Then, after the mode change permission flag 54 is set in a step S89, the process is terminated.

Next, with referring FIG. 8 to FIG. 11, an operation of the microcomputer 50 for controlling the pre-charge performed prior to the above described image forming process will be described.

At first, if the mode changing switch 48 is turned-on in a step S101, in a step S103, the microcomputer 50 determines whether or not the count value of the mode counter **56*a* is less than "50", for example. If the count value is smaller than "50", in a step S105, the microcomputer 50 sets 20 seconds, for example, in the timer 58*a* included in the microcomputer 50. On the other hand, if the count value is equal to or larger than "50" in the step S103, in step S107, the microcomputer 50 determines whether or not the count value is smaller than "100", for example. If the count value is smaller than "100", in step S109, a timer time of 40 seconds, for example, is set in the timer 58*a*. If the count value is equal to or larger than "100" in the step S107, in a step S111, the microcomputer 50 determines whether or not the count value is smaller than "200", for example. If "YES", in a step S113, the microcomputer 50 sets 60 seconds, for example, in the timer 58*a*. If the count value is equal to or larger than "200", in a step 115, a timer time of 100 seconds, for example, is set in the timer 58*a*. Thus, in this embodiment shown, the count value of the mode counter 56*a*** in the preceding image forming mode is utilized as a time associated parameter which determines the pre-charge time.

After the timer **58*a* is set in the step S105, S109, S113 or S115, it is determined whether or not the image forming mode as changed is the non-inverted image forming mode. If the non-inverted image forming mode, in a step S119, the high-voltage power source 52 is set to be adapted to the non-inverted image forming mode by the microcomputer 50. Thereafter, in a step S121, the main motor, the eraser lamp 24, the developing bias and the transferrer 18 are turned-on. Succeedingly, in a step S123, a decrement of the timer 58*a* is started, and in a step S125, the microcomputer 50 determines whether or not the count value becomes zero. If the count value does not become zero, the steps S123 and S125 are repeated, and if the count value becomes zero, in a step S127, the mode counter 56*a* is reset. Next, in a step S129, the transferrer 18 is turned-off, and if it is determined in a step S131 that the charge ended area of the photosensitive drum 12 faces the eraser lamp 24, in a step S133, the main motor, the eraser lamp 24** and the developing bias are turned-off, and the process is terminated.

On the other hand, if it is determined in the step S117 that the image forming mode as changed is the inverted image forming mode, in a step S135, the microcomputer 50 controls the high-voltage power source 52 to be adapted to the inverted image forming mode. Then, in a step S137, the main motor, the eraser lamp 24 and the charger 14 is turned-on, and in a step S139, it is determined whether or not a charged area of the photosensitive drum 12 reaches the developer 16. If the charged area reaches the developer 16, in a step S141, the developing bias is turned-on, and then, in a step S143, the timer 58*a* is started to be decremented. If it is detected in a step S145 that the count value of the timer 58*a* becomes zero, in a step S147, the mode counter 56*a* is reset in a step S147, and the charger 14 is turned-off in a step S149. Thereafter, if it is detected in a step S151 that the charge ended area of the photosensitive drum 12 faces the developer 16, in a step S153, the developing bias is turned-off. Furthermore, if the charge ended area faces the eraser lamp 24 in a step S155, in a step S157, the main motor and the eraser lamp 24 are turned-off, and the process is terminated.

In an actual operation, when the image forming process of the non-inverted image forming mode or the inverted image forming mode is started, the photosensitive drum 12 is charged by the charger 14, and the photosensitive drum 12 is exposed by scanning the original 28 by the exposure lamp 36, and therefore, the electrostatic latent images formed on the photosensitive drum 12. Thereafter, the electrostatic latent image is developed by the developer 16, and the toner image thus formed on the surface of the photosensitive drum 12 is transferred to the paper 46 which is fed by the register roller 44 by the transferrer 18. At each time that such a copying operation (image forming operation) is completed, the mode counter 56*a* is incremented.

After the completion of the image forming process, if the image forming mode is changed, the pre-charge is started. At that time, the timer 58*a* is set in accordance with the count value of the mode counter 56*a*, and therefore, the photosensitive drum 12 is pre-charged during the timer time that is set in the timer 58*a*. That is, when the image forming mode is changed to the inverted image forming mode, the photosensitive drum 12 is rotated until the count value of the timer 58*a* becomes zero, and during that time, the photosensitive drum 12 is pre-charged by the charger 14. If the image forming mode is changed to the non-inverted image forming mode, the photosensitive drum 12 is rotated until the count value of the timer 58*a* becomes zero, and during that time, the photosensitive drum 12 is pre-charged by the transferrer 18.

In accordance with this embodiment shown, it is possible to set the pre-charge time according to the number of image forming operations in the preceding image forming mode, and therefore, the pre-charge time is made shorter, while a good image quantity is obtainable.

Figure 12:
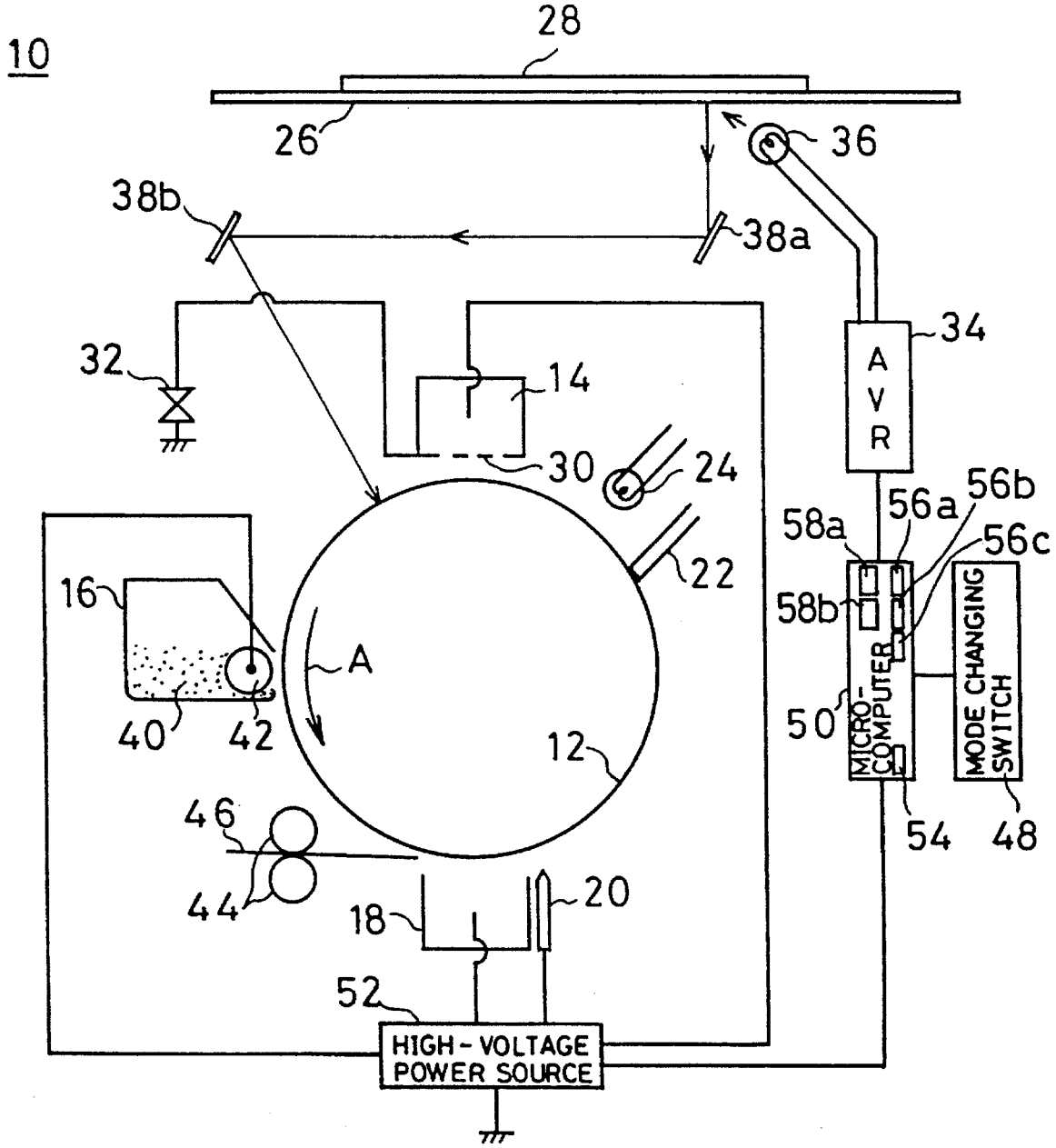
FIG. 12 is an illustrative view Showing another embodiment according to the present invention.

With referring FIG. 12, an electrophotographying apparatus 10 of another embodiment according to the present invention has structure similar to that of the apparatus 10 shown in FIG. 1, and therefore, in the following, only different points will be described. That is, the apparatus 10 shown in FIG. 12 is different from the apparatus 10 shown in FIG. 1 in a point that counters 56*b* and 56*c* and a timer 58*b* are further included in the microcomputer 50 which controls the following operation. In addition, the timer 58*b* is utilized for counting a stop time that the image forming operation (copying operation) is stopped between the termination of the non-inverted image forming mode operation and the start of the inverted image forming mode.

Figure 13:
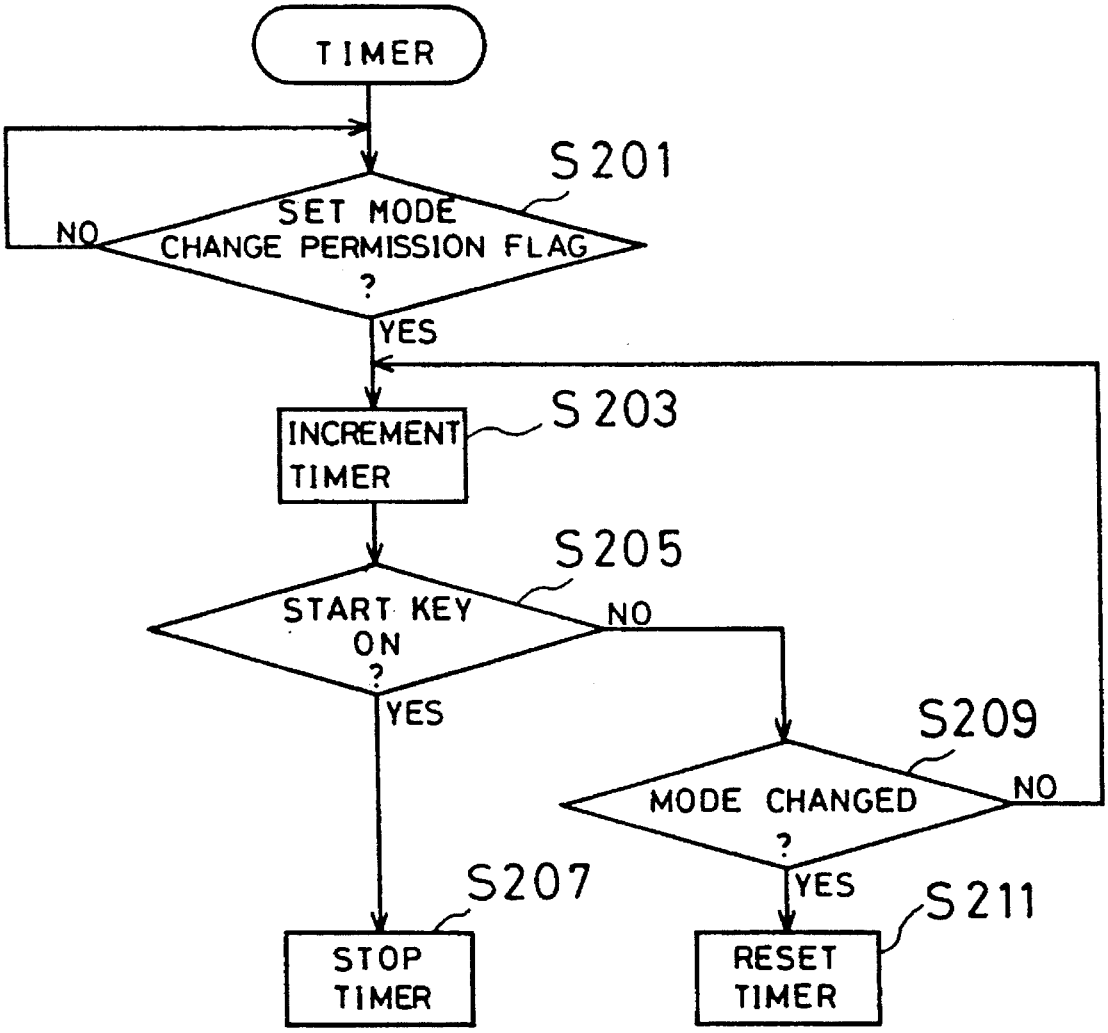
FIG. 13 is a flowchart showing a portion of an operation of FIG. 12 embodiment.

With reference to FIG. 13, an operation of the microcomputer 50 for controlling the timer 58*b* will be described. If the mode change permission flag 54 is set in a step S201, the timer 58*b* is incremented in a step S203. Next, if it is detected in a step S205 that the start key (not shown) is turned-on, in a step S207, the timer 58*b* is stopped, and then, the image forming process for the non-inverted image forming mode or the inverted image forming mode is executed. However, since the image forming process of this embodiment shown is similar to the image forming process shown in FIG. 2 to FIG. 7, and therefore, a duplicate description will be omitted here. On the other hand, if the start key is not operated in the step S205, in a step S209, the microcomputer 50 determines whether or not the image forming mode is changed by the mode changing switch 48. If the image forming mode is changed, in a step S211, the timer 58*b* is reset, and then, a series of operation steps shown in FIG. 14 to FIG. 17 are executed. If the image forming mode is not changed, the process returns to the step S203. Thus, the timer 58*b* counts the stopped time. More specifically, if the start key is turned-on, the image forming operation is started, and therefore, the timer 58*b* is stopped; however, if the start key is not operated and if the image forming mode is not changed, the timer 58*b* is incremented because during that time the image forming operation is stopped. Then, if the image forming mode is changed, the timer 58*b* is reset.

Next, with referring FIG. 14 and FIG. 15, an operation of the microcomputer 50 in the pre-charge operation after the image forming mode is changed from the inverted image forming mode to the non-inverted image forming mode will be described. At first, in a step S301, the mode change permission flag 54 is reset, and in a step S303, a count value N of the counter 56*b* and a count value A of the counter 56*c* are set as N=99 and A=1. Next, in a step S305, the microcomputer 50 determines whether or not the count value X of the mode counter 56*a*, that is, the number of image forming operations X is equal to or less than N ($X \leqq N$). If "NO" is determined in the step S305, in a step S307, the count value N and the count value A are set again as N=N+100 and A=A+1, and then, the process returns to the step S305. In addition, the count value A is a value for representing a rank or division of the pre-charge time, and as seen from the flowing table 1, the rank is incremented by "1" at every time that the number of prints, i.e. the number of image forming operations increased by "100".

TABLE 1

| Number of Prints (X) | Rank (A) |
|---|---|
| 0–99 | 1 |
| 100–199 | 2 |
| 200–299 | 3 |
| 300–399 | 4 |
| . | . |
| . | . |
| . | . |

If "YES" is determined in the step S305, in a step S309, a count value M of the timer 58*b* is set as M=0, and then, in a step S311, the microcomputer 50 determines whether or not the stopped time Y (minutes) counted by the timer 58*b* is smaller than "M+10" (Y<M+10), for example. If "NO" is determined in the step S311, in a step S313, the count value M and the count value A are set again as M=M+10 and A=A−1, and thereafter, the process returns to the step S311. If "YES" is determined in the step S311, the process proceeds to a step S315. By executing the steps S311 and S313, as seen from the following table 2, the rank A is decremented according to the increase of the stop time Y counted by the counter 58*b*. In addition, as described in the above, the count value of the timer 58*b* indicates the stopped time during that the image forming operation is stopped at a time that the image forming mode is changed from the non-inverted image forming mode to the inverted image forming mode, or vice versa. That is, all the stop time between both image forming modes is accumulated by the counter 58*b*.

TABLE 2

| Stop Time (Y) | Rank is lowered by |
|---|---|
| 0–10 | 0 |
| 11–20 | 1 |
| 21–30 | 2 |
| 31–40 | 3 |
| . | . |
| . | . |
| . | . |

If A≧1 in the step S315, the process directly proceeds to a step S319; however, if the count value A is less than 0, the count value A is set as A=1 in a step S317, and thereafter, the process proceeds to the step S319. In the step S319, the main motor, the eraser lamp 24 and the transferrer 18 are turned-on, and the pre-charge is started. Thereafter, if it is detected in a step S321 that the pre-charge time T (=A×20) seconds elapsed, in a step S323, the transferrer 18 is turned-off. If the charge ended area (non-charged area) of the photosensitive drum 12 faces the eraser lamp 24 in a step S325, in a step S327, the main motor and the eraser lamp 24 are turned-off. Then, the mode counter 56*a* is reset in a step S329, and the mode change permission flag 54 is set in a step S331, and then the process is terminated.

Figure 14:
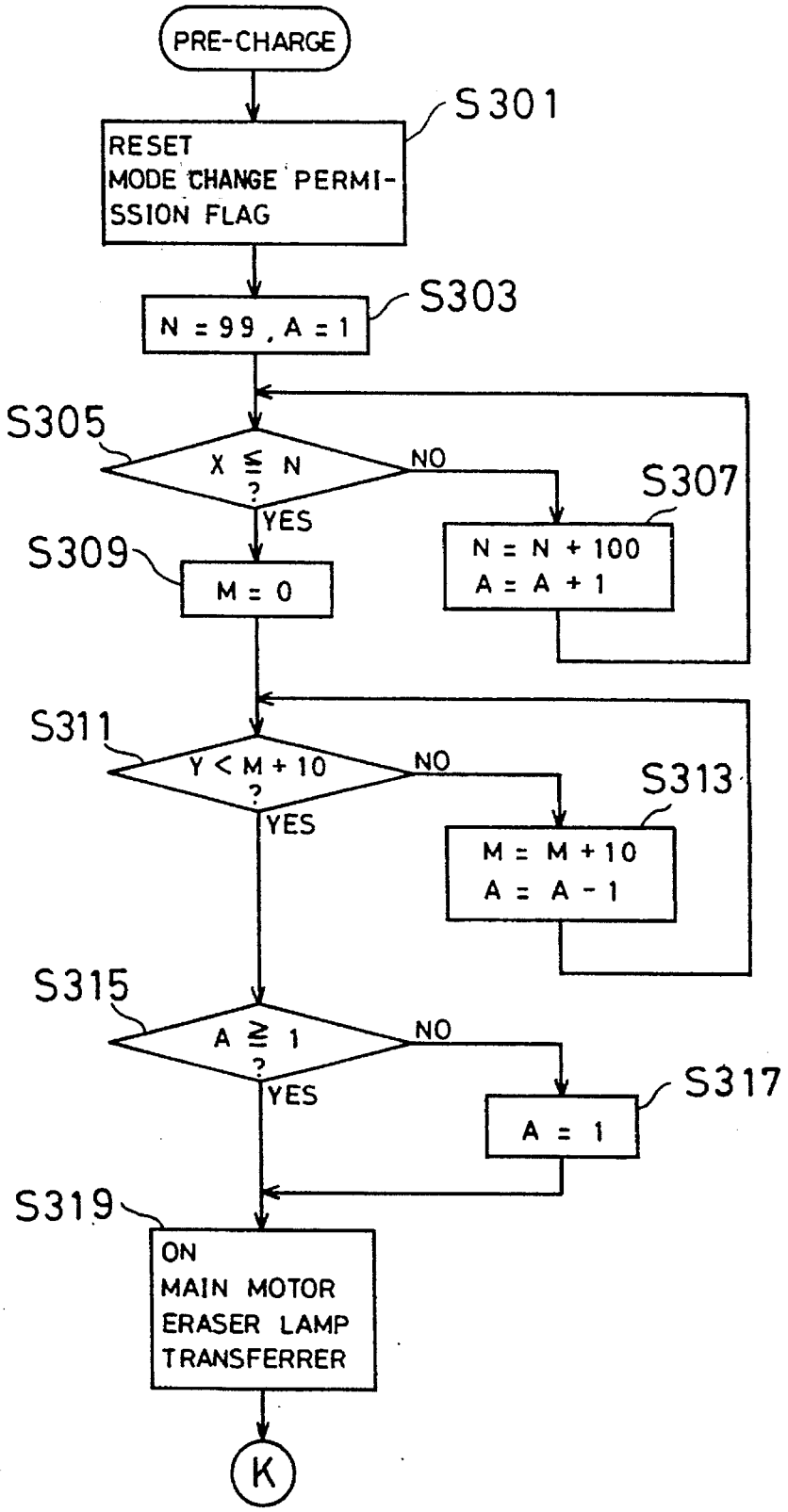
FIG. 14 is a flowchart showing a portion of an operation of the FIG. 12 embodiment.
Figure 15:
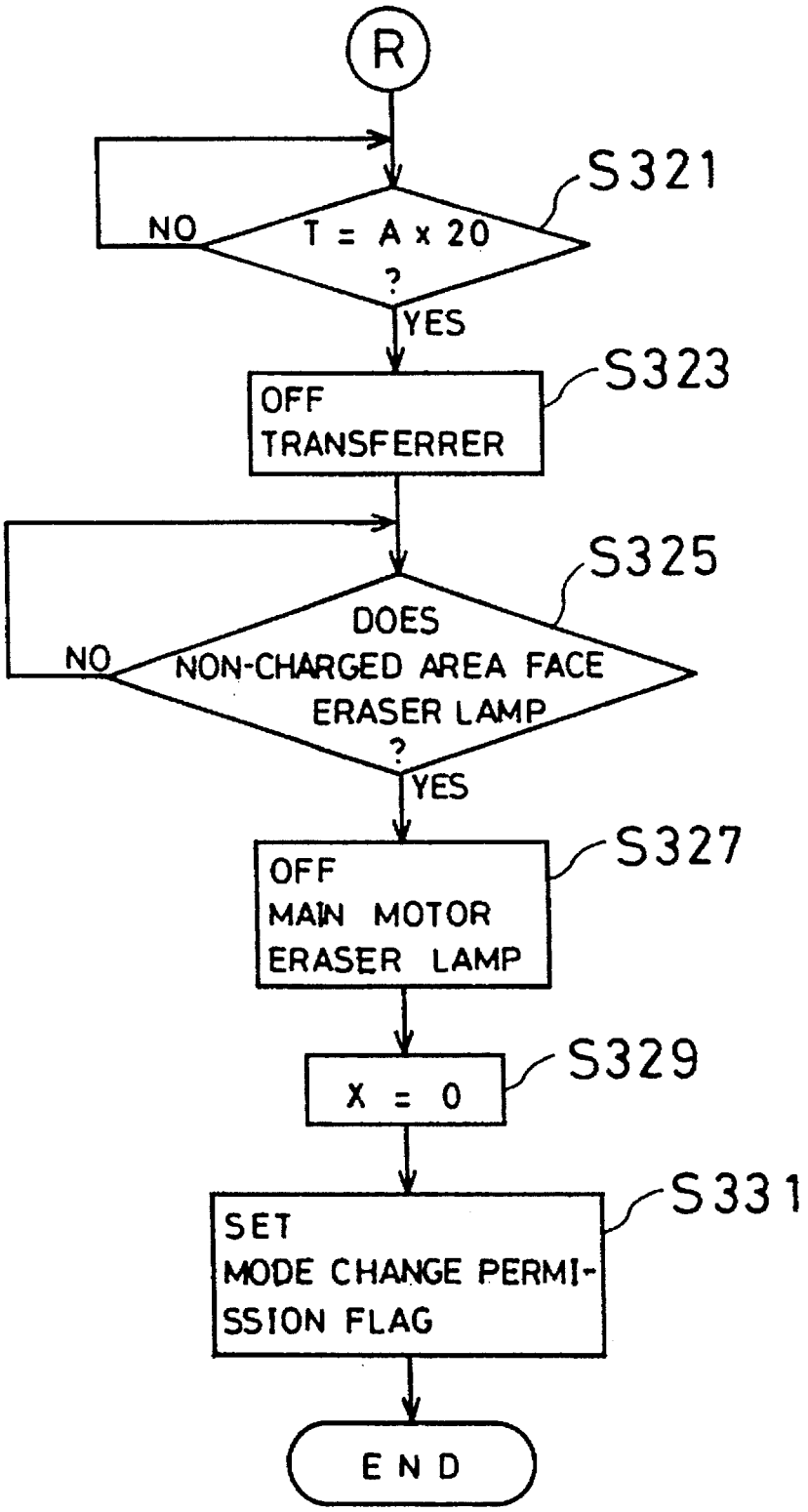
FIG. 15 is a flowchart showing a portion of an operation of the FIG. 12 embodiment.
Figure 16:
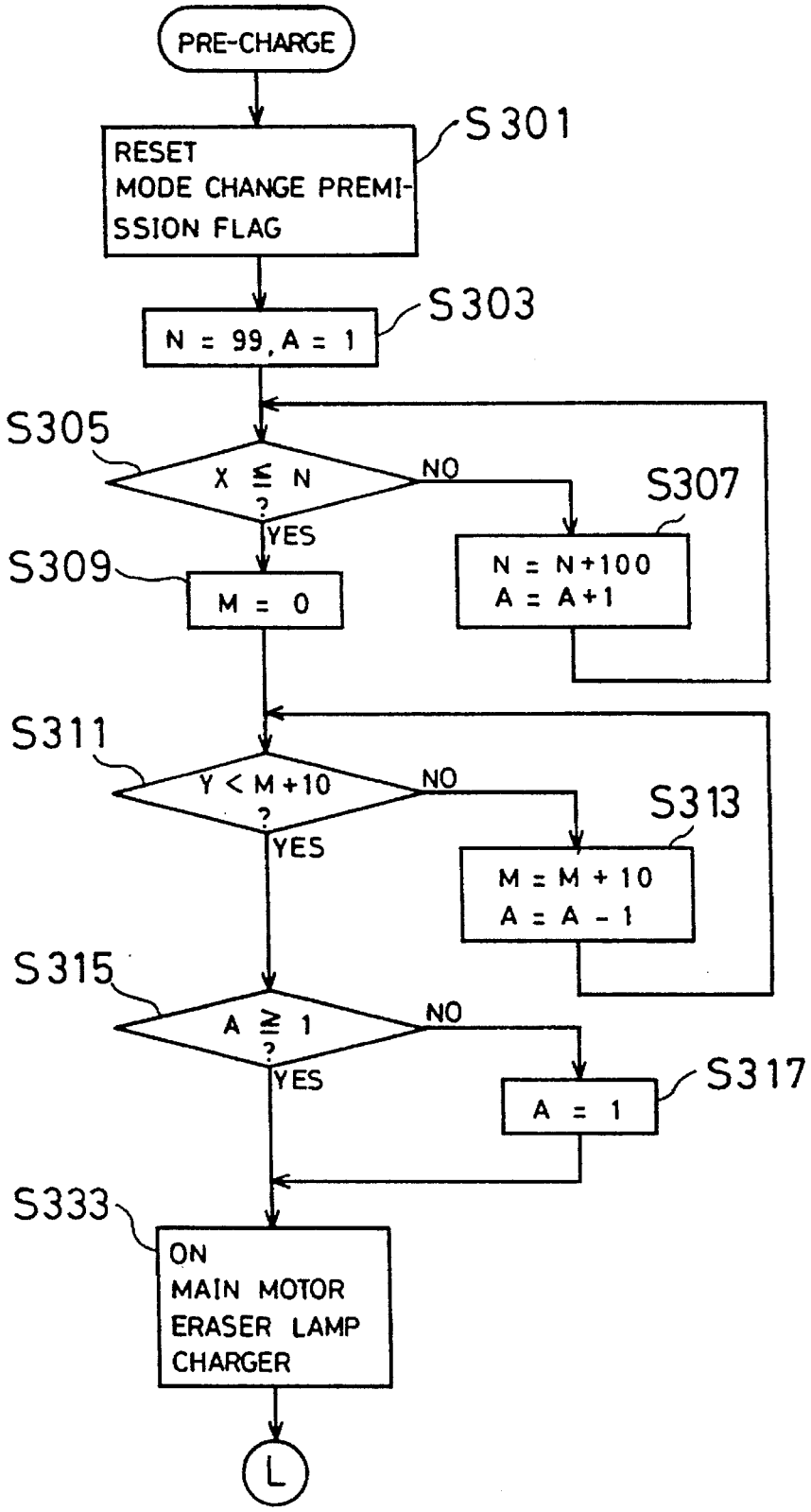
FIG. 16 is a flowchart showing a portion of an operation of the FIG. 12 embodiment.
Figure 17:
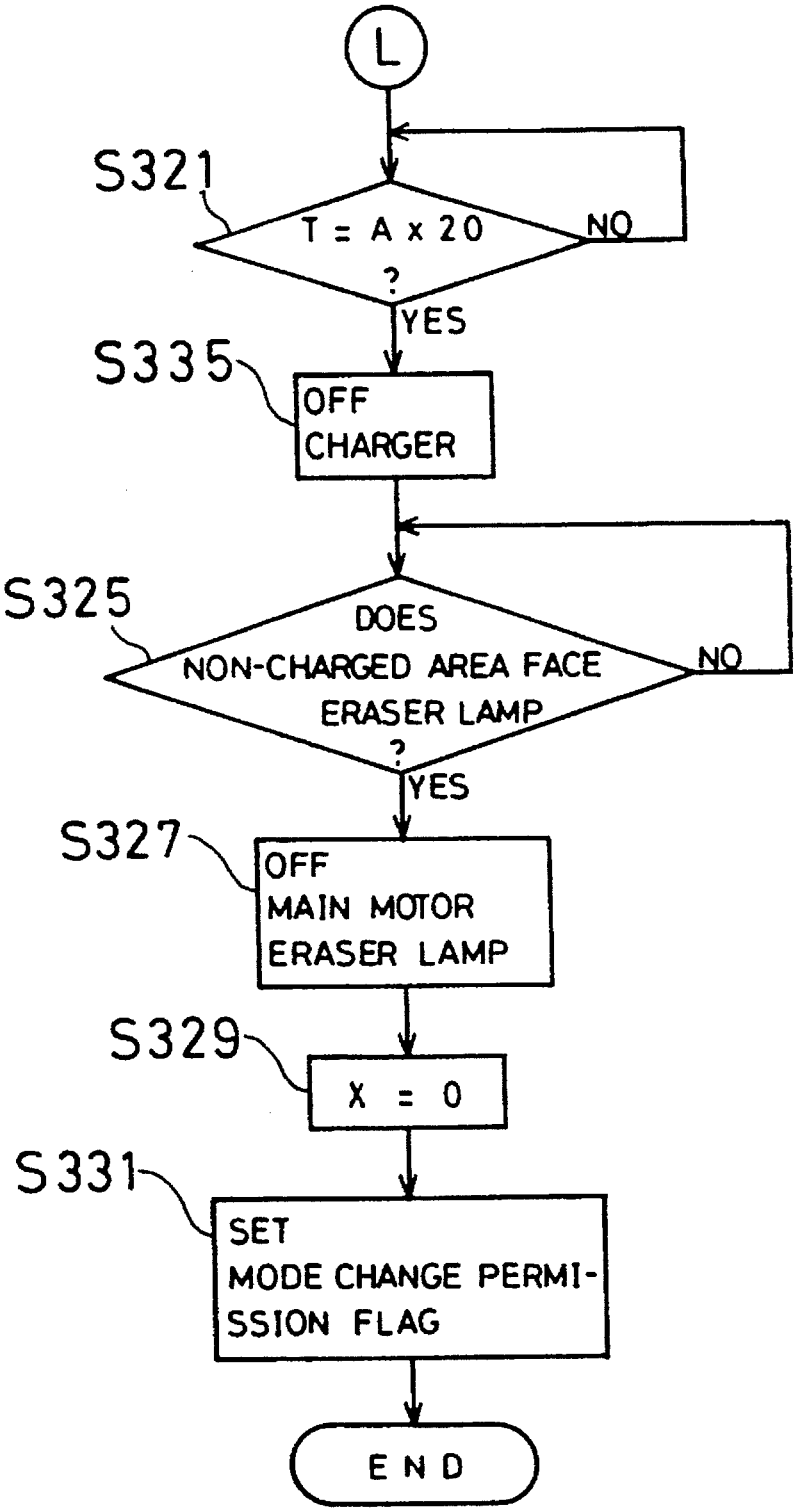
FIG. 17 is a flowchart showing a portion of an operation of the FIG. 12 embodiment.

An operation of the microcomputer 50 at a time of the pre-charge after the image forming mode is changed from the non-inverted image forming mode and the inverted image forming mode is shown in FIG. 16 and FIG. 17; however, a series of operation steps are similar to a series of operation steps shown in FIG. 14 and FIG. 15 except that the charger 14 is turned-on instead of the transferrer 18 in the step S333, and the charger 14 is turned-off instead of the transferrer 18 in the step S335, and therefore, by the same step numbers are applied to the same operation steps, a duplicate description will be omitted.

In the image forming mode, the number of image forming operations is counted by the mode counter 56*a*, and the stop time between the preceding image forming mode and the succeeding image forming mode is counted by the timer 58*b*. Then, if the mode changing switch 54 is turned-on, the pre-charge is started. The pre-charge time is set on the basis of the both of the number of image forming operations (the number of prints) and the stop time. More specifically, if the number of image forming operations is "200", for example, and the stop time is 5 minutes, for example, the pre-charge time is set as 60 seconds, but in a case of the same number of image forming operation, if the stop time is 15 minutes, for example, the pre-charge time becomes 40 seconds because the rank is decremented by "1" as shown in the table 2. Furthermore, in a case of the same number of image forming operations, if the stop time is 25 minutes, for example, the pre-charge time becomes 20 seconds because the rank is decremented by "2" as shown in the table 2. Thus, in this embodiment shown, the count value of the counter 56*a* which counts the number of image forming operations in the preceding image forming mode and the count value of the counter 58*b* which counts the stop time between the preceding image forming mode and the succeeding image forming mode are utilized as parameters associated with the pre-charge time.

Thus, the pre-charge time is set in the timer 58*a* by taking the recovery of the fatigue of the photosensitive drum 12 during the stop time into consideration, and therefore, the pre-charge time can be shortened.

Figure 18:
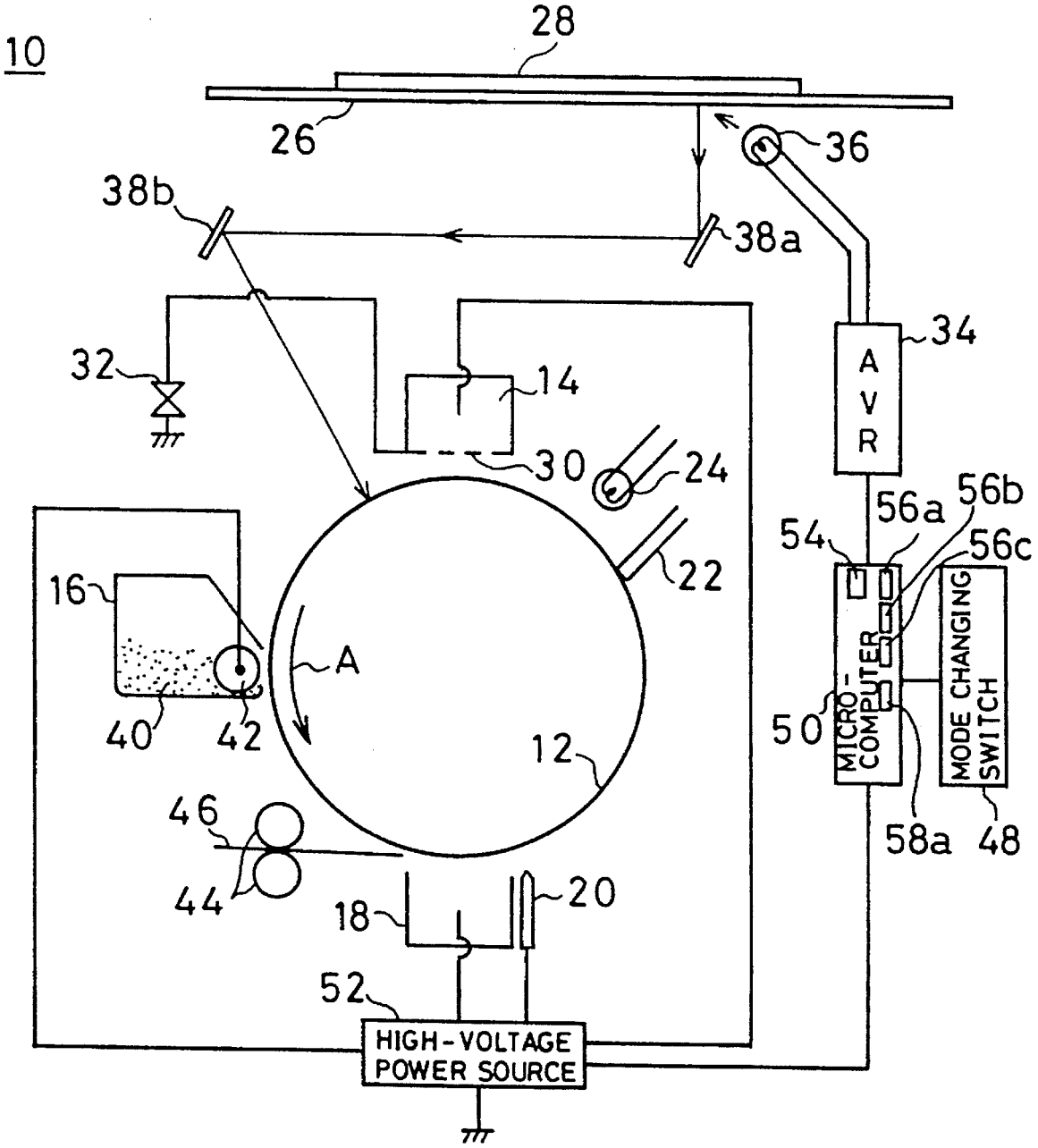
FIG. 18 is an illustrative view showing a further embodiment according to the present invention.
Figure 19:
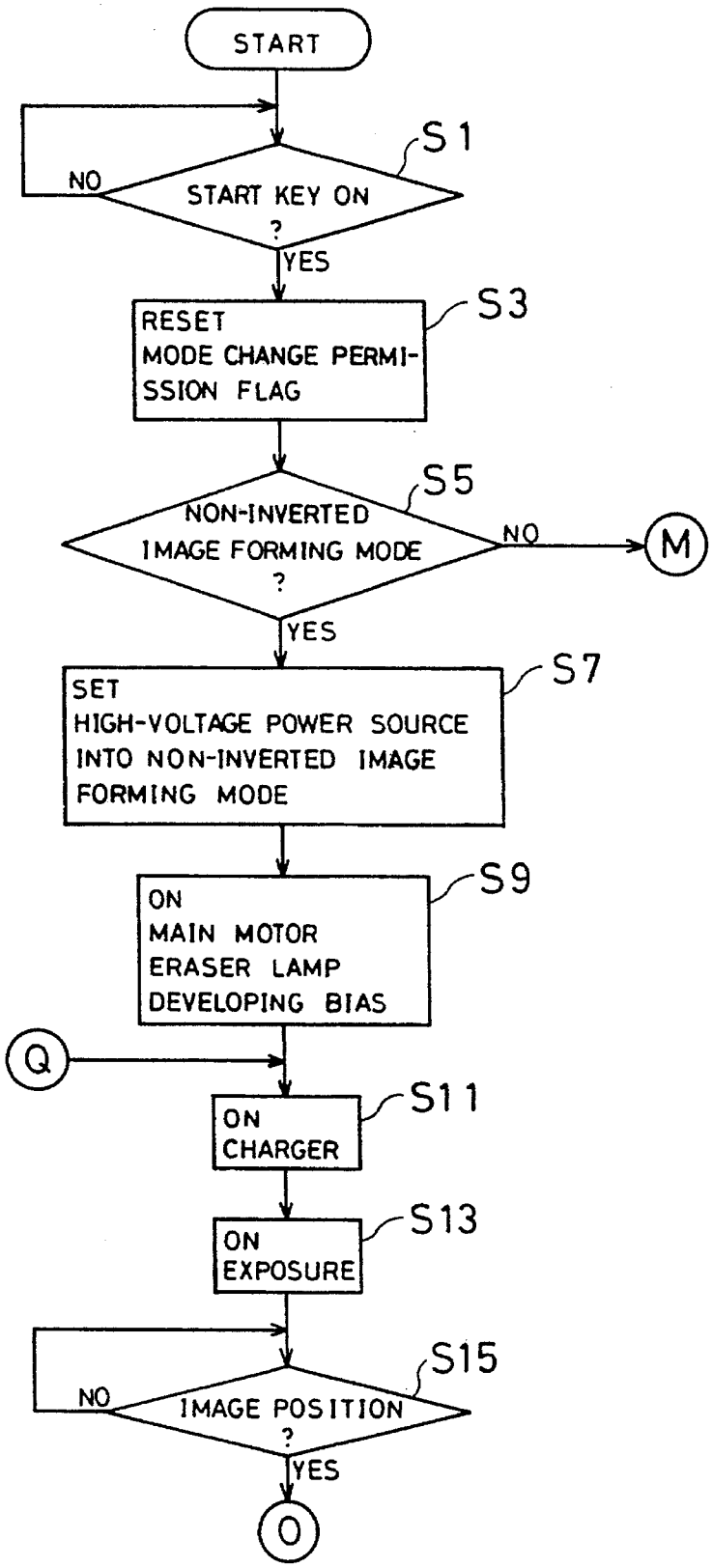
FIG. 19 is a flowchart showing a portion of an operation of the FIG. 18 embodiment.
Figure 20:
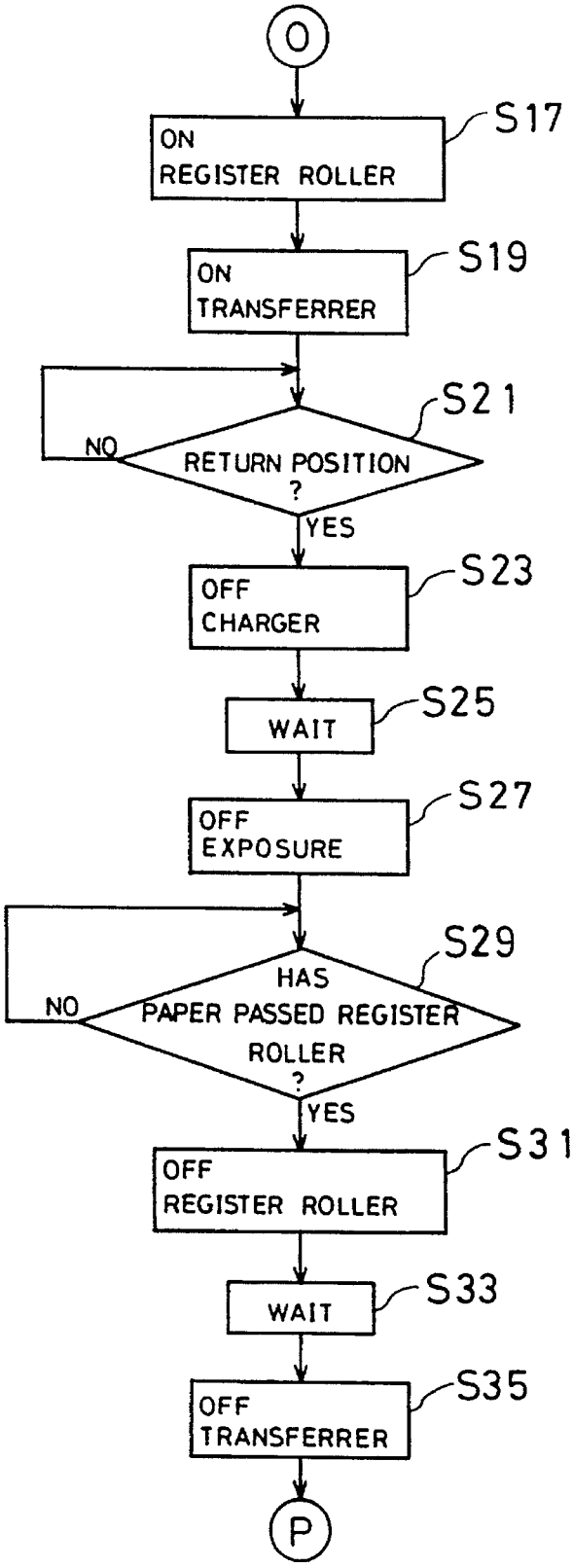
FIG. 20 is a flowchart showing a portion of an operation of the FIG. 18 embodiment.
Figure 21:
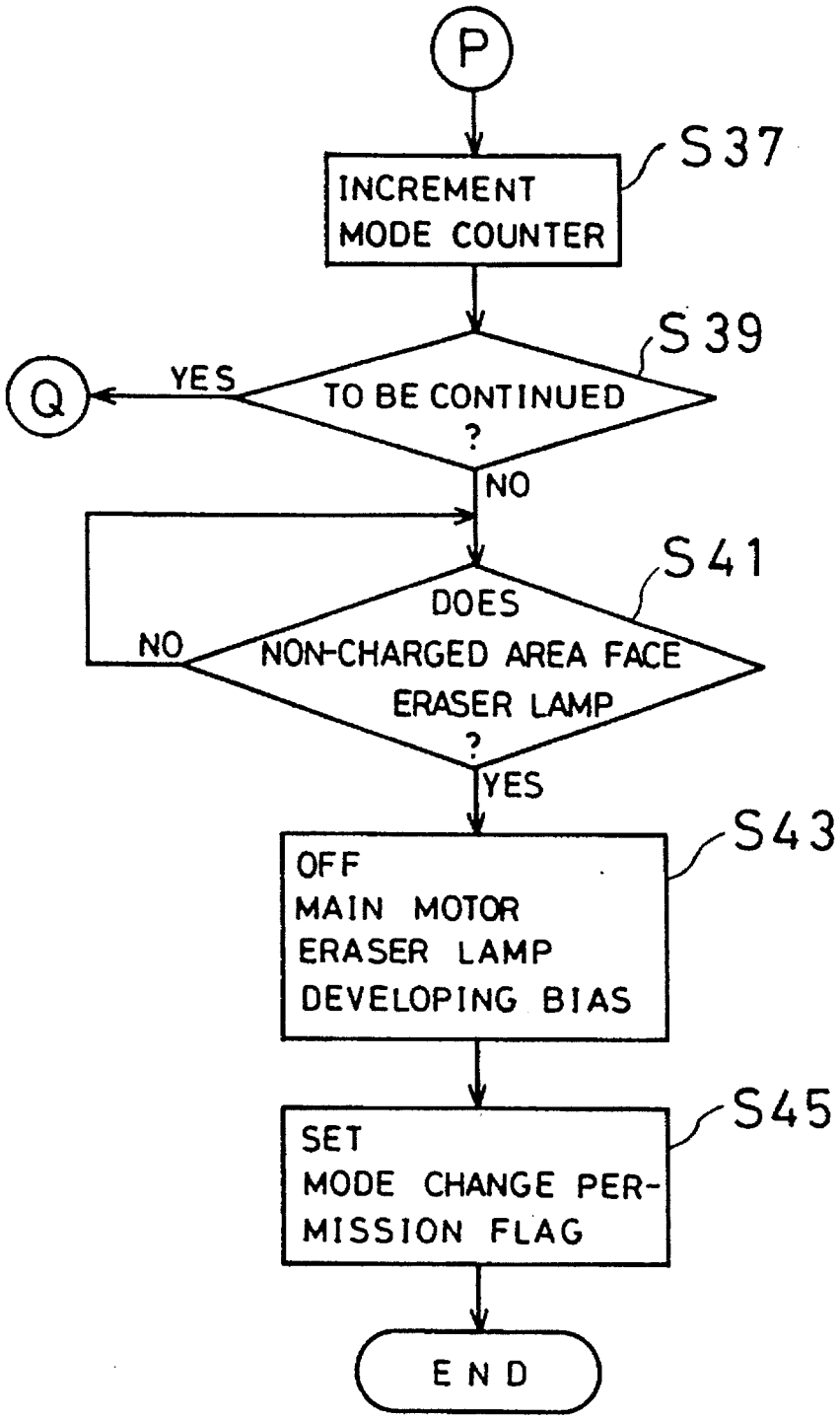
FIG. 21 is a flowchart showing a portion of an operation of the FIG. 18 embodiment.
Figure 22:
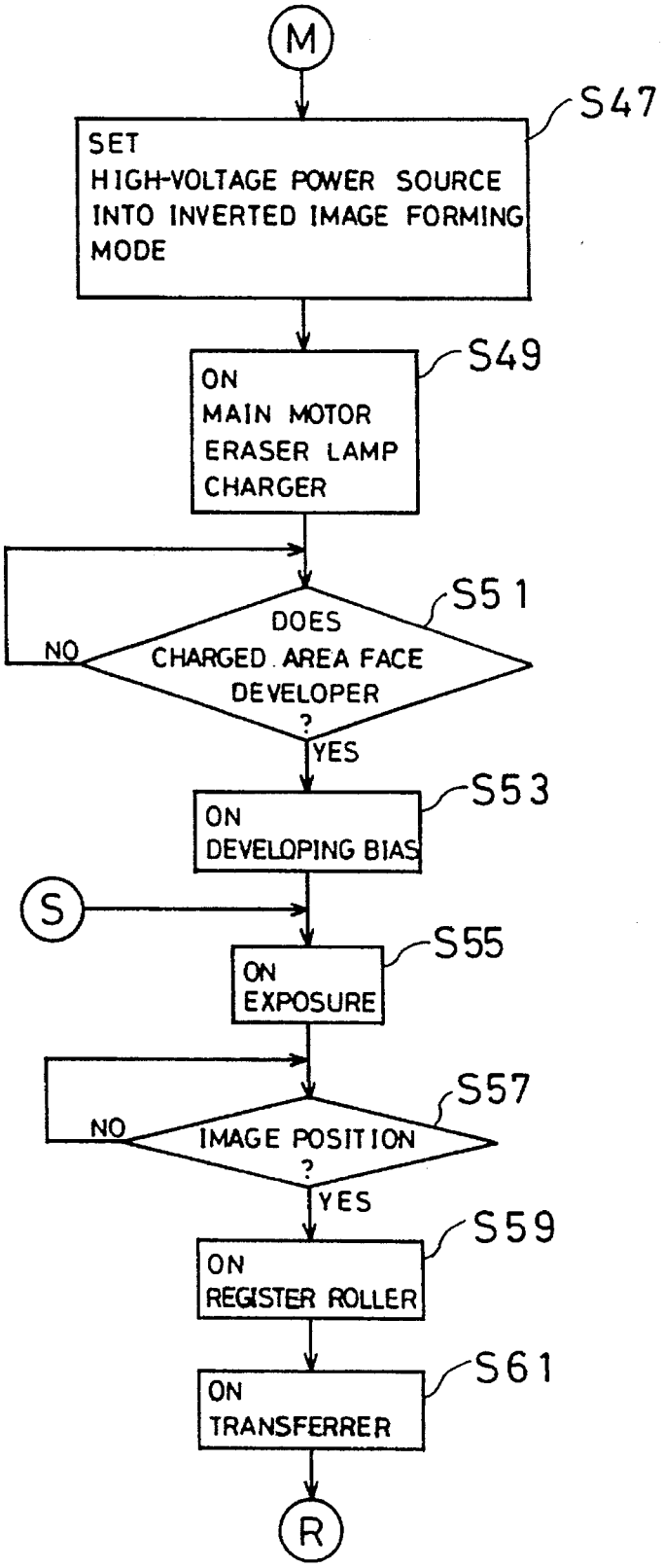
FIG. 22 is a flowchart showing a portion of an operation of the FIG. 18 embodiment.
Figure 23:
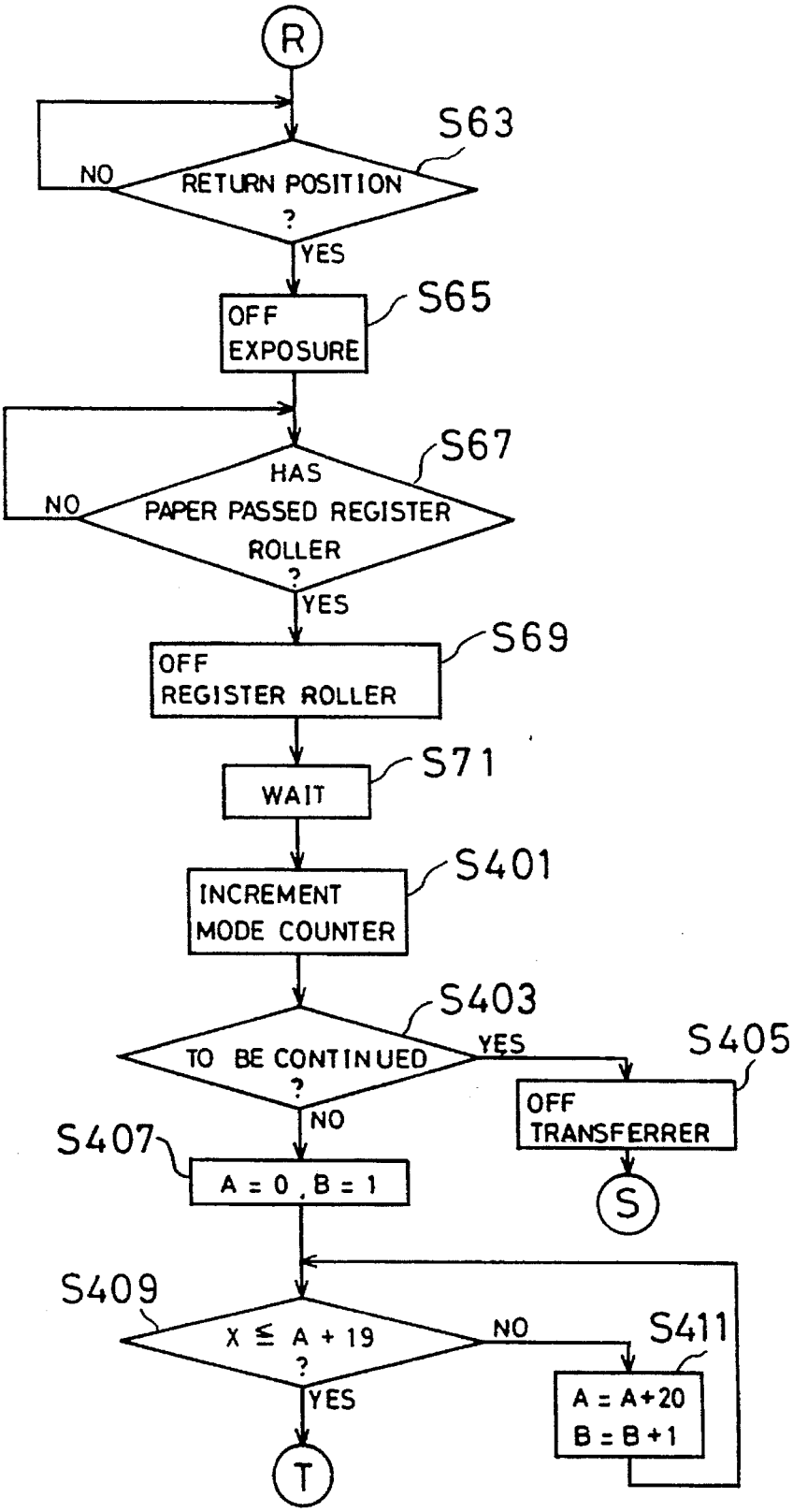
FIG. 23 is a flowchart showing a portion of an operation of the FIG. 18 embodiment.
Figure 24:
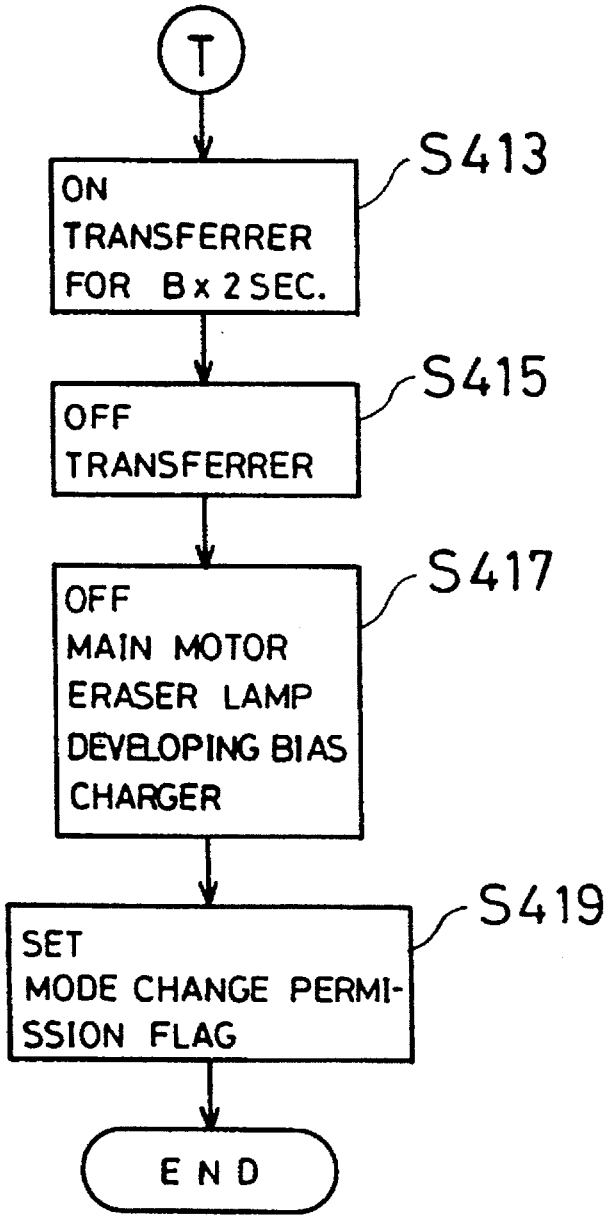
FIG. 24 is a flowchart showing a portion of an operation of the FIG. 18 embodiment.

With referring FIG. 18, an electrophotographying apparatus 10 of another embodiment according to the present invention is constructed in a manner similar to that of the apparatus shown in FIG. 1 except that counters 56*b* and 56*c* are further included in the microcomputer 50. Therefore, in the following, only different points will be described. Furthermore, the microcomputer 50 executes operation steps shown in FIG. 19 to FIG. 24 in the image forming process; however, the operation steps S1 to S71 shown in FIG. 19 to FIG. 23 are the same or similar to the operation steps S1 to S71 shown in FIG. 2 to FIG. 6, and therefore, by applying the same step numbers to the same operation steps, a duplicate description will be omitted here.

If the paper 46 passed through the transferrer 18 in the step S71, in a step S401, the mode counter 56*a* is incremented, and then, in a step S403, it is determined whether or not the continuous copy is set. Then, if the copy is to be continued, in a step S405, the transferrer 18 is turned-off, and then, the process proceeds to the step S55. In a case of the one sheet copy or the last copy of the continuous copy in the step S403, in a step S407, the count value A of the counter 58*b* and the count value B of the counter 56*c* are respectively set as A=0 and B=1, for example. Then, in a step S409, it is determined whether or not the count value X of the mode counter 56*a*, that is, the number of image forming operations X is equal to or less than "A+19" (X≦A+19), for example. Then, if "NO" is determined, in a step S411, the count value A and the count value B are respectively set again as A=A+20 and B=B+1, for example, and then, the process proceeds to the step S409. If "YES" is determined in the step S409, in a step S413, a timer time of B×2 seconds, for example, is set in the timer 58*a* for defining the pre-charge time, and the transferrer 18 is continuously turned-on, and thereafter, in a step S415, the transferrer 18 is turned-off. Then, in a step S417, the main motor, the eraser lamp 24, the developing bias and the charger 14 are turned-off, and in a step S419, the mode change permission flag 54 is set, and thereafter, the process is terminated.

Figure 25:
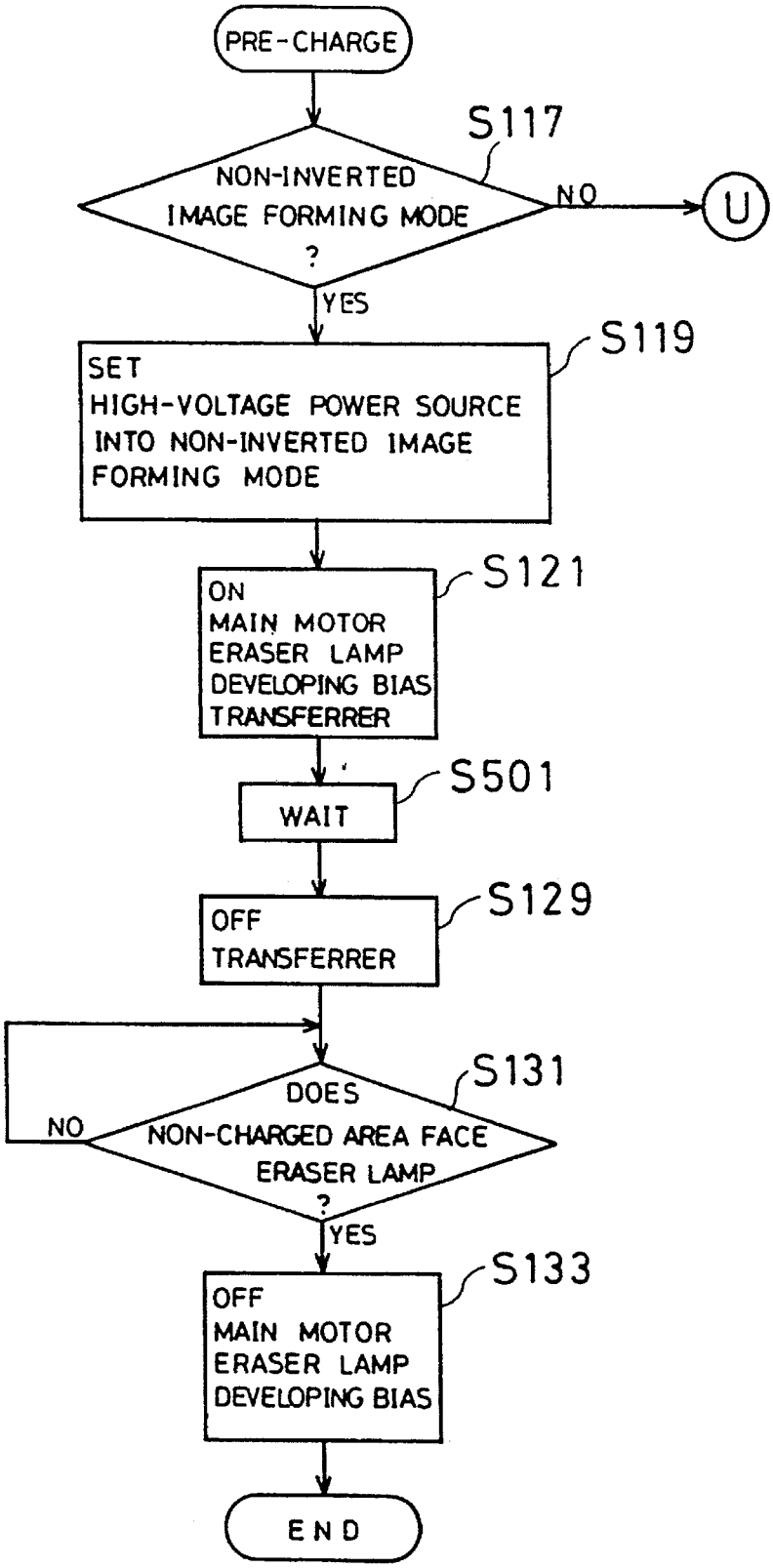
FIG. 25 is a flowchart showing a portion of an operation of the FIG. 18 embodiment.
Figure 26:
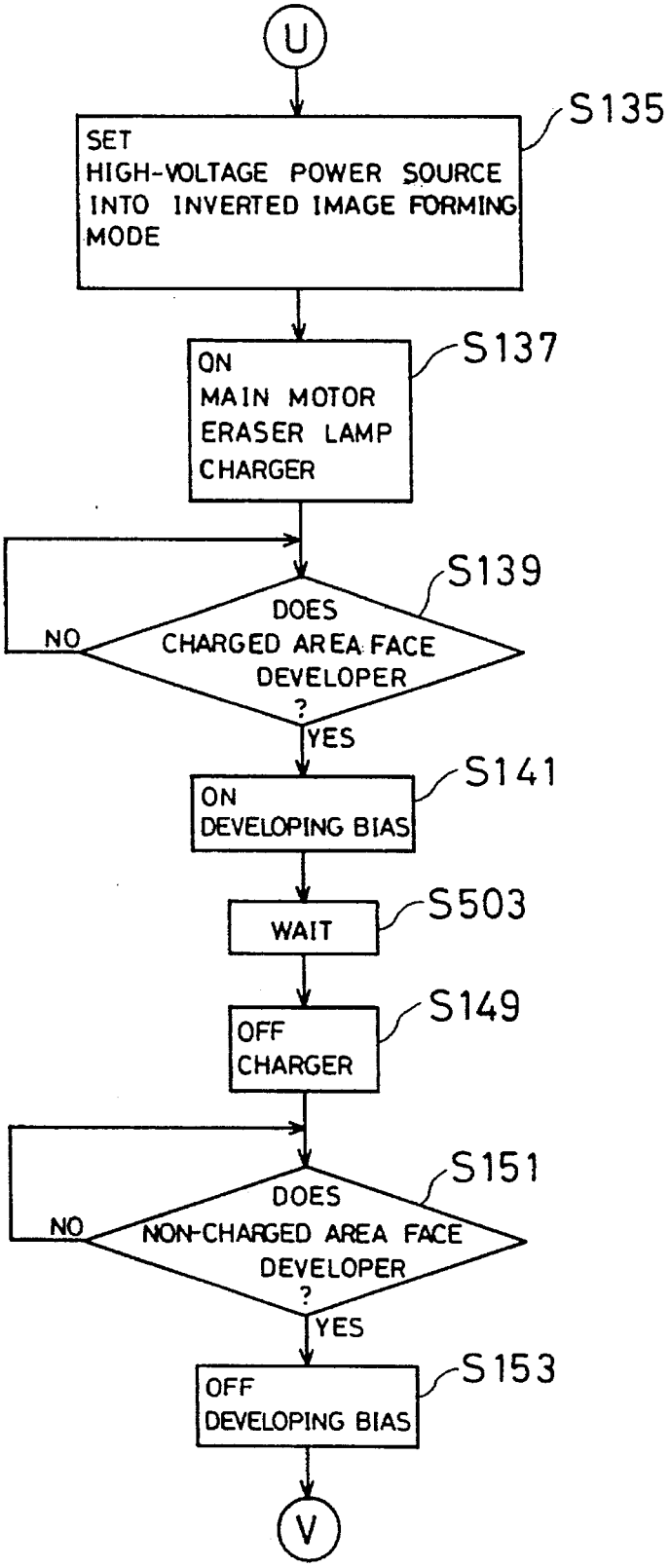
FIG. 26 is a flowchart showing a portion of an operation of the FIG. 18 embodiment.

The microcomputer 50 further executes operation steps shown in FIG. 25 to FIG. 27 at a time of the pre-charge; however, such operation steps are approximately similar to operation steps S117 to S157 shown in FIG. 8 to FIG. 11, and therefore, only different steps will be described, and a duplicate description will be omitted by applying the same steps numbers to the same operation steps. More specifically, in this embodiment shown, instead of the steps S123 to S127 shown in FIG. 9, a step S501 shown in FIG. 25 is executed, in which the photosensitive drum 12 is pre-charged by the transferrer 18 during a predetermined time. Furthermore, instead of the steps S141 to S147 shown in FIG. 10, in the embodiment shown, a step S503 shown in FIG. 26 is executed, in which the photosensitive drum 12 is pre-charged by the charger 14 for a predetermined time. In addition, since the transferrer 18 is turned-on after the image forming process of the inverted image forming mode is completed, the pre-charge time in the step S501 may be 20 seconds shorter than 60 seconds in the prior art.

Furthermore, in this embodiment shown, in a case where the photosensitive drum 12 is hardly affected by the influence of the preceding image forming mode when the image forming mode is changed from the non-inverted image forming mode to the inverted image forming mode, the operation steps S135 to S157 may be omitted.

In performing the image forming process in the inverted image forming mode, the photosensitive drum 12 is exposed such that the electrostatic latent image is formed on the surface of the photosensitive drum 12. Thereafter, the electrostatic latent image is developed by the developer 16, and the toner image formed on the photosensitive drum 12 is transferred onto the paper 46 by the transferrer 18. Then, the toner image is fixed to the paper 46 by the fixer (not shown). When such the image forming process is completed, the transferrer 18 is continuously turned-on during the time in corresponding to the number of image forming operations (the number of prints), that is, B×2 seconds, for example. Next, when the image forming mode is changed from the inverted image forming mode to the non-inverted image forming mode, the photosensitive drum 12 is pre-charged by the transferrer 18 for the predetermined time.

According to this embodiment shown, since the transferrer 18 is turned-on during the predetermined time after the completion of the image forming process in the inverted image forming mode, the pre-charge time in changing the image forming mode from the inverted image forming mode into the non-inverted image forming mode can be shortened in comparison with the prior art. Furthermore, in this embodiment shown, the time that the transferrer 18 is continuously turned-on after the completion of the image forming process is changed in accordance with the number of image forming operations, i.e., B; however, the time may be a constant time.

Figure 27:
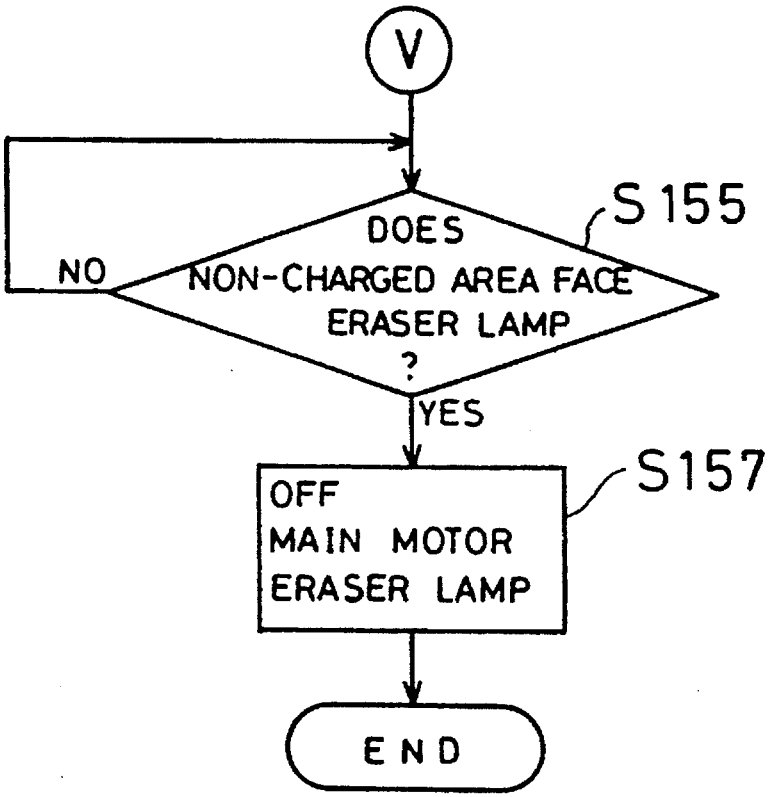
FIG. 27 is a flowchart showing a portion of an operation of the FIG. 18 embodiment.
Figure 28:
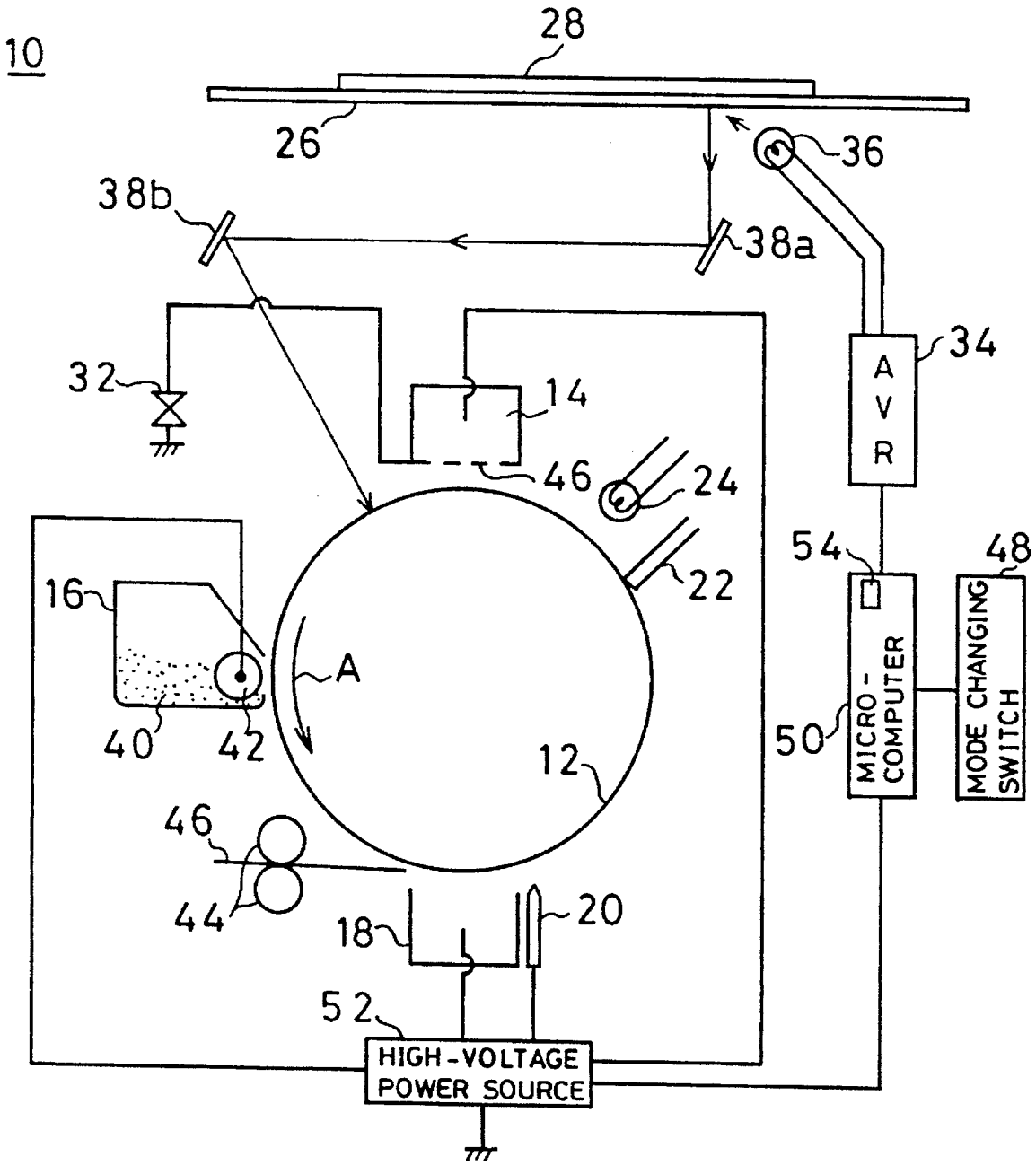
FIG. 28 is an illustrative view showing a still further embodiment according to the present invention.
Figure 29:
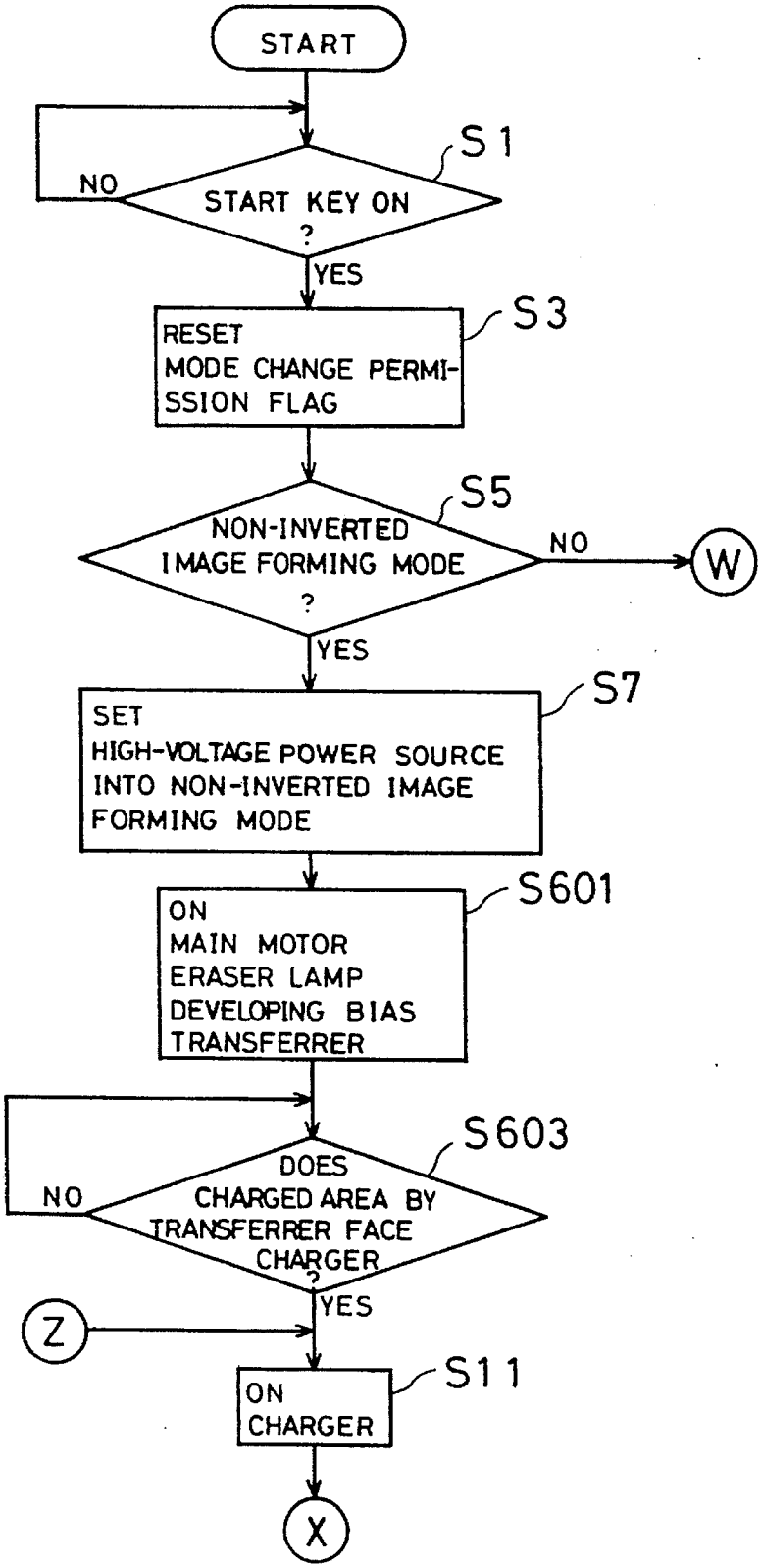
FIG. 29 is a flowchart showing a portion of an operation of the FIG. 28 embodiment.
Figure 30:
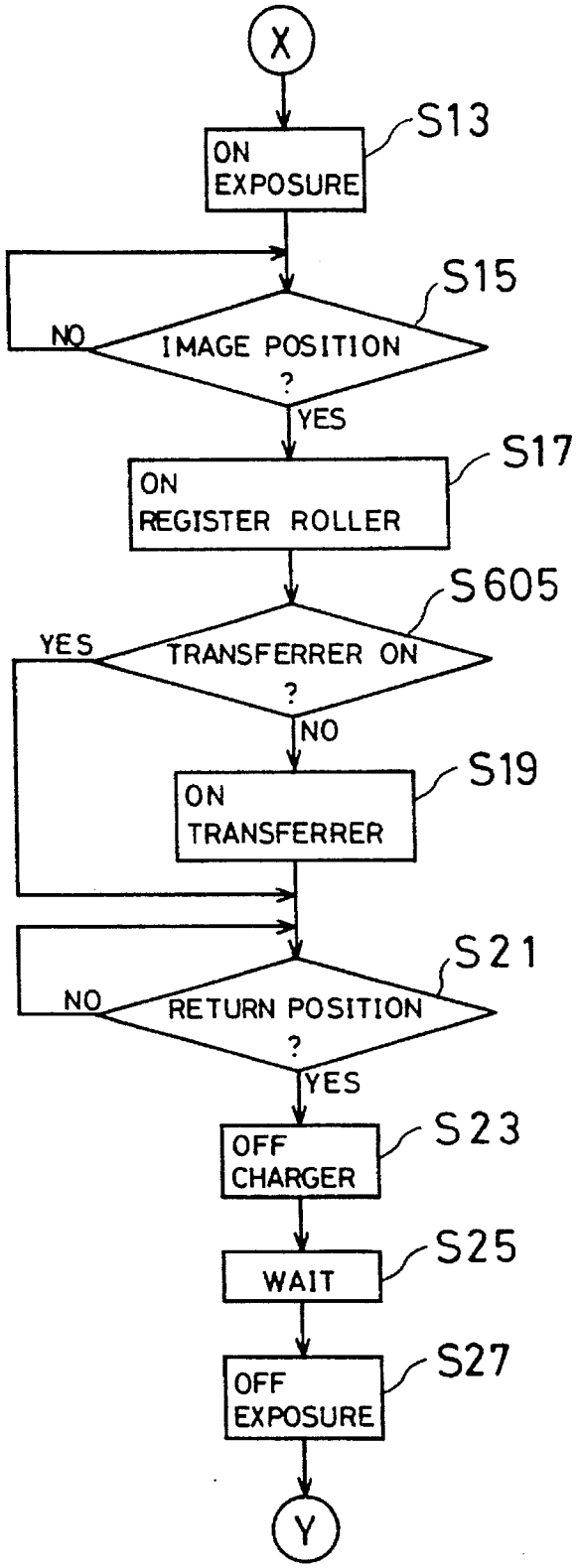
FIG. 30 is a flowchart showing a portion of an operation of the FIG. 28 embodiment.
Figure 31:
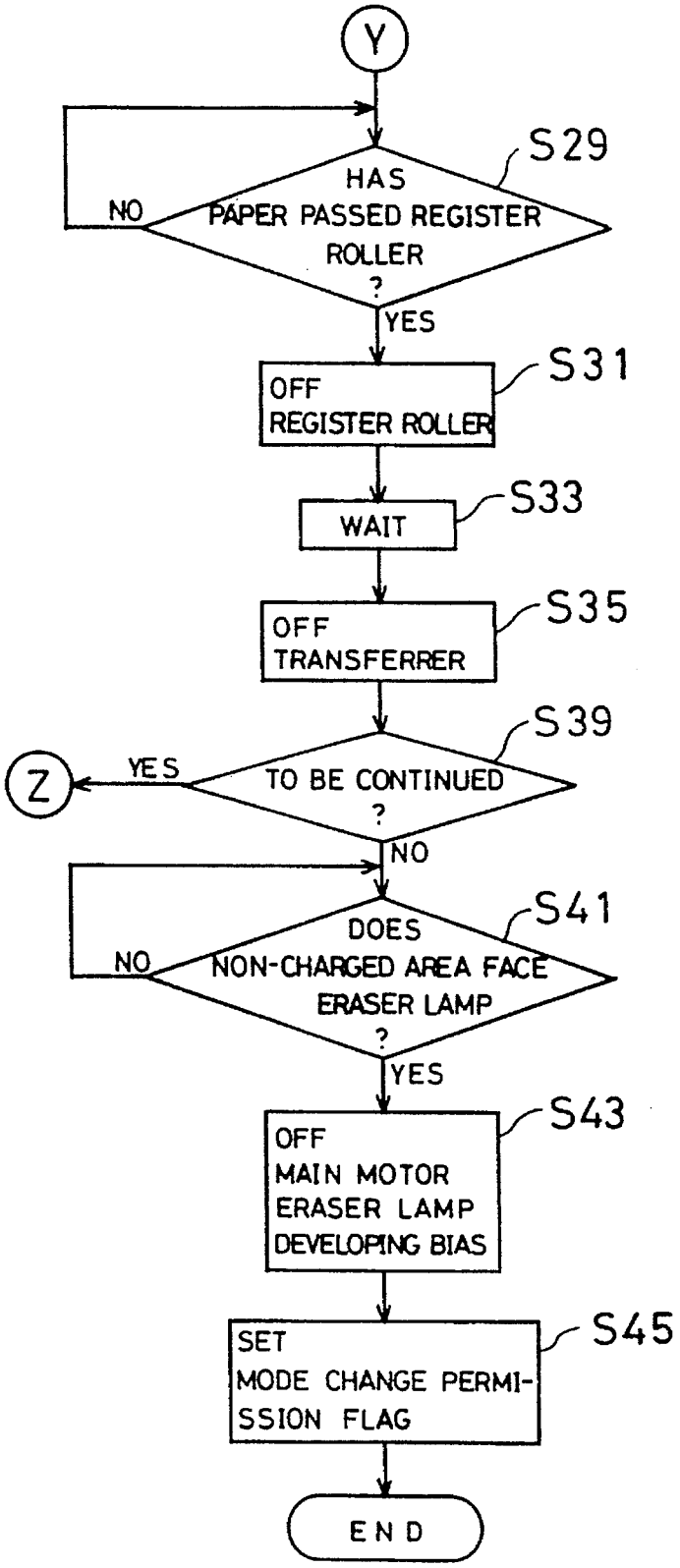
FIG. 31 is a flowchart showing a portion of an operation of the FIG. 28 embodiment.
Figure 32:
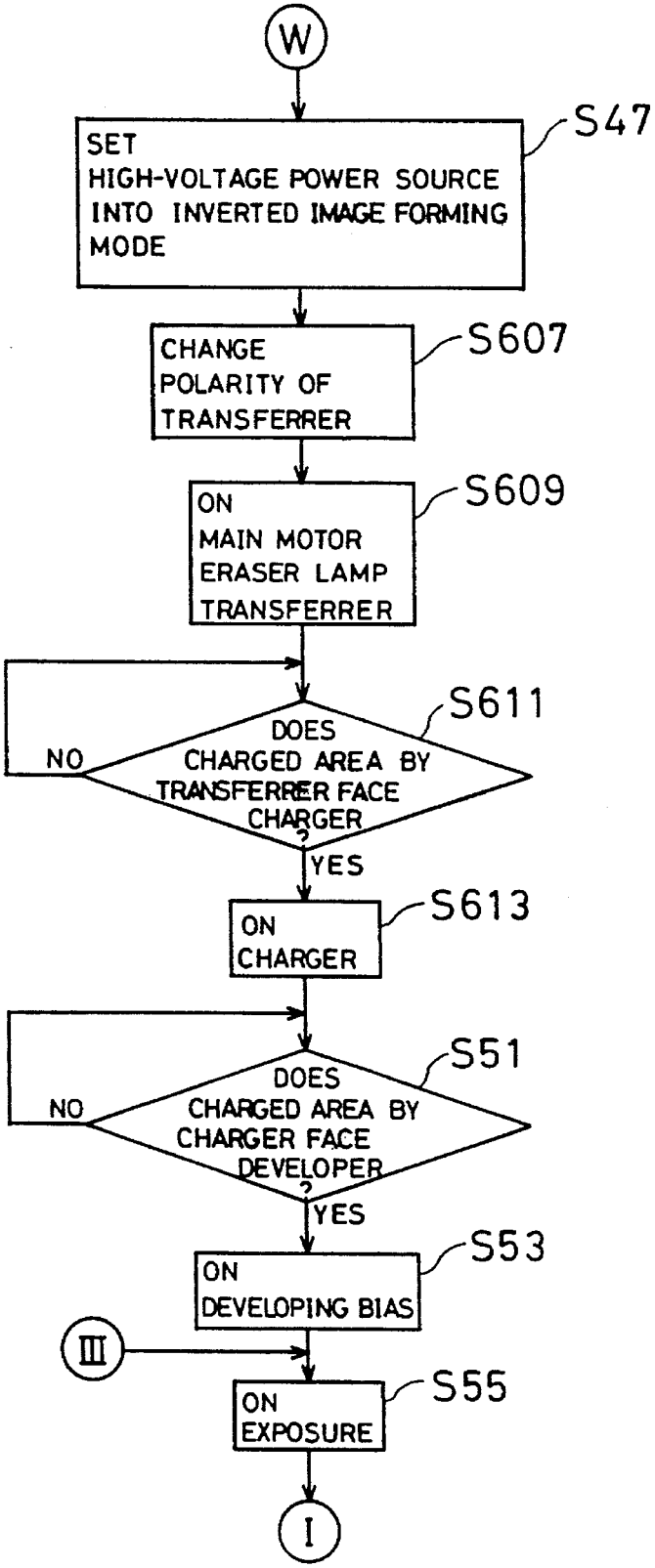
FIG. 32 is a flowchart showing a portion of an operation of the FIG. 28 embodiment.
Figure 33:
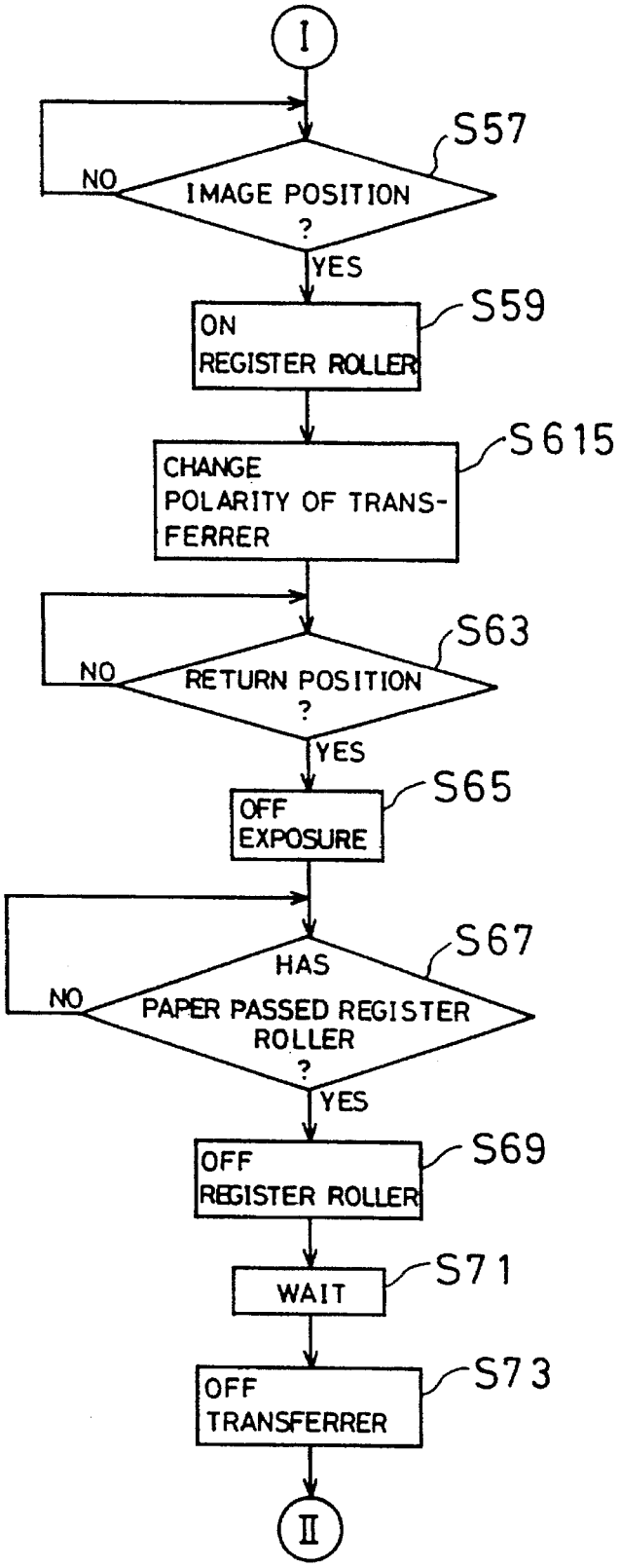
FIG. 33 is a flowchart showing a portion of an operation of the FIG. 28 embodiment.
Figure 34:
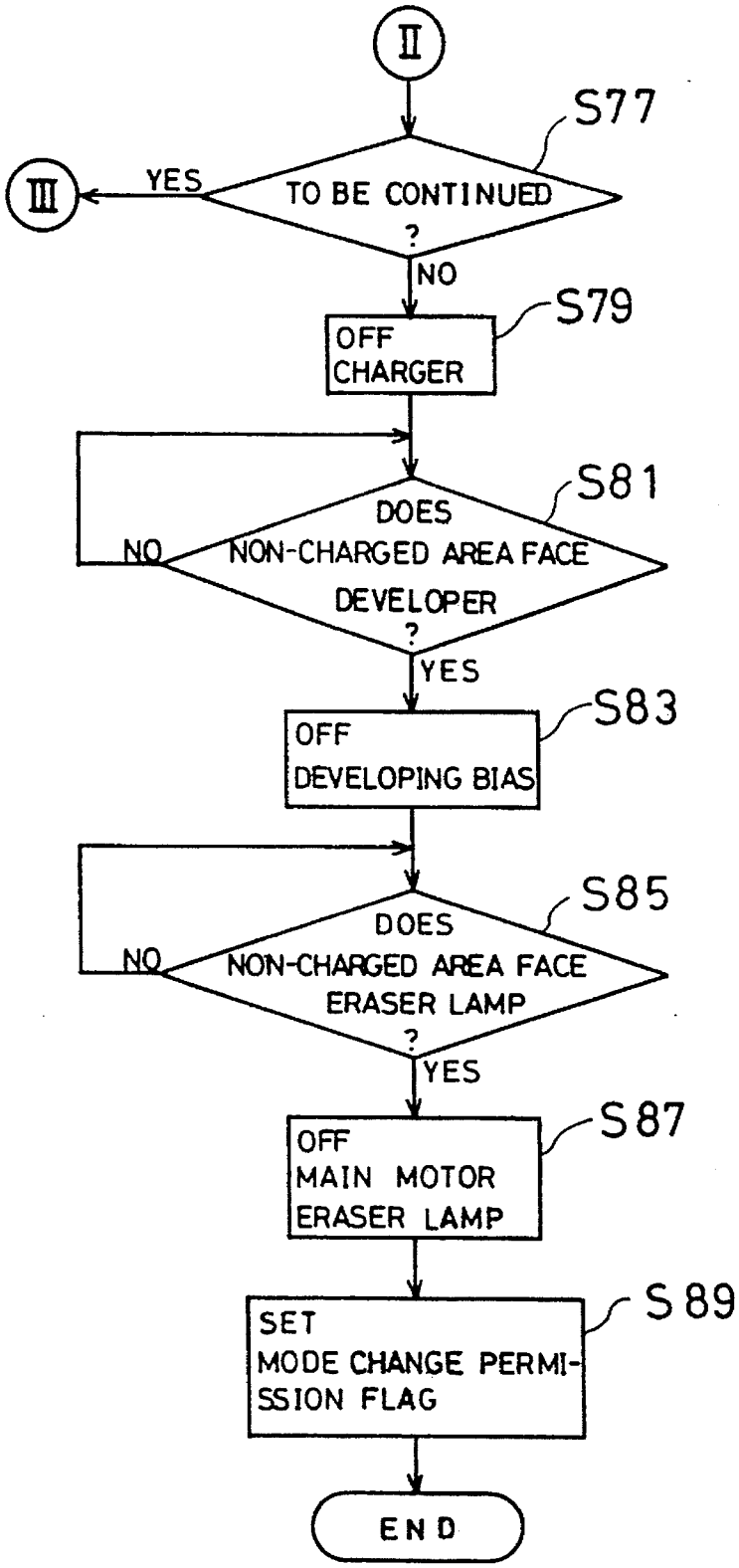
FIG. 34 is a flowchart showing a portion of an operation of the FIG. 28 embodiment.

With referring FIG. 27, an apparatus 10 of a still another embodiment according to the present invention is similar to the apparatus 10 shown in FIG. 1 except that the mode counter **56*a* and the timer 58*a* are omitted from the microcomputer 50. The microcomputer 50 executes operation steps shown in FIG. 29 to FIG. 34 in the image forming process; however, such operation steps are similar to the operation steps shown in FIG. 2 to FIG. 7, and therefore, a duplicate description will be omitted here by applying the same step numbers to the same steps. In addition, in this embodiment shown, steps S601 to S605 are executed in FIG. 29 and FIG. 30, and steps S607 to S615 are executed in FIG. 32 and FIG. 33**.

After the execution of the step S7, in a step S601, the main motor, the eraser lamp 24, the developing bias and the transferrer 18 are turned-on. Thereafter, if it is detected in a step S603 that the charged area of the photosensitive drum 12 faces the charger 14, in the step S11, the charger 14 is turned-on. Furthermore, if the register roller 44 is turned-on in the step S17, in a step S605, the microcomputer 50 determines whether or not the transferrer 18 is turned-on. If the transferrer 18 is turned-on in the step S605, the process proceeds to the step S21; however, if the transferrer 18 is not turned-on, in the step S19, the transferrer 18 is turned-on, and then the process proceeds to the step S21. In addition, a reason why the step S605 is executed is as follows: it is unnecessary to turn-on the transferrer 18 in the step S19 because the transferrer 18 is turned-on in the step S601 in a first image forming process; however, if the first image forming process is completed, the transferrer 18 is turned-off in the step S35, and therefore, it is necessary to turn-on the transferrer 18 in the step S19 for a second or succeeding image forming process.

Furthermore, after the execution of the step S47, in a step S607, a polarity of the electric field developed by the transferrer 18 is inverted by the microcomputer 50, and then, in a step S609, the main motor, the eraser lamp 24 and the transferrer 18 are turned-on. Thereafter, if it is detected in a step S611 that the charged area of the photosensitive drum 12 by the transferrer 18 faces the charger 14, in a step S613, the charger 14 is turned-on, and the process proceeds to the step S51. Furthermore, when the register roller 44 is turned-on in the step S59, the polarity of the electric field developed by the transferrer 18 is inverted again, that is, the polarity of the electric field is put back, and then, the process proceeds to the step S63.

When the image forming process is performed in the non-inverted image forming mode, at a time that the main motor is started to be rotated, the transferrer 18 is turned-on with the negative polarity, and therefore, a high-voltage of −4.7 kV, for example, is applied to the transferrer 18 from the high-voltage power source 52, whereby the photosensitive drum 12 is pre-charged with the negative polarity. Due to the pre-charge, the influence of the electric charge on the photosensitive drum 12 in the preceding image forming mode becomes small, and therefore, the charging voltage at a first rotation of the photosensitive drum 12 does not have to be made smaller than that of a second rotation of the photosensitive drum 12.

When the image forming process is to be performed in the inverted image forming mode, at a time that the main motor is started to be rotated, the transferrer 18 is turned-on with a reversed polarity, and therefore, a high-voltage of +4.3 kV, for example, is applied from the high-voltage power source 52 to the transferrer 18, whereby the photosensitive drum 12 is pre-charged with the positive polarity. Due to the pre-charge, the influence of the charge on the photosensitive drum 12 in the preceding image forming mode becomes small. Thereafter, the transferrer 18 must be operated as a transferrer rather than a pre-charger, that is, the toner image formed on the photosensitive drum 12 is to be transferred onto the paper 46 by the transferrer 18, at the same time that the register roller 44 is turned-on, the polarity of the transferrer 18 is put back, that is, inverted again. Therefore, the high-voltage −4.3 kV, for example, is applied to the transferrer 18.

In accordance with this embodiment shown, the photosensitive drum 12 is pre-charged by the transferrer 18 at a time of the start of the image forming process after the image forming mode is changed, whereby the influence of the electric charge on the photosensitive drum 12 in the preceding image forming mode can be made small, and therefore, it is not necessary to perform the pre-charge separately from the image forming process.

Figure 35:
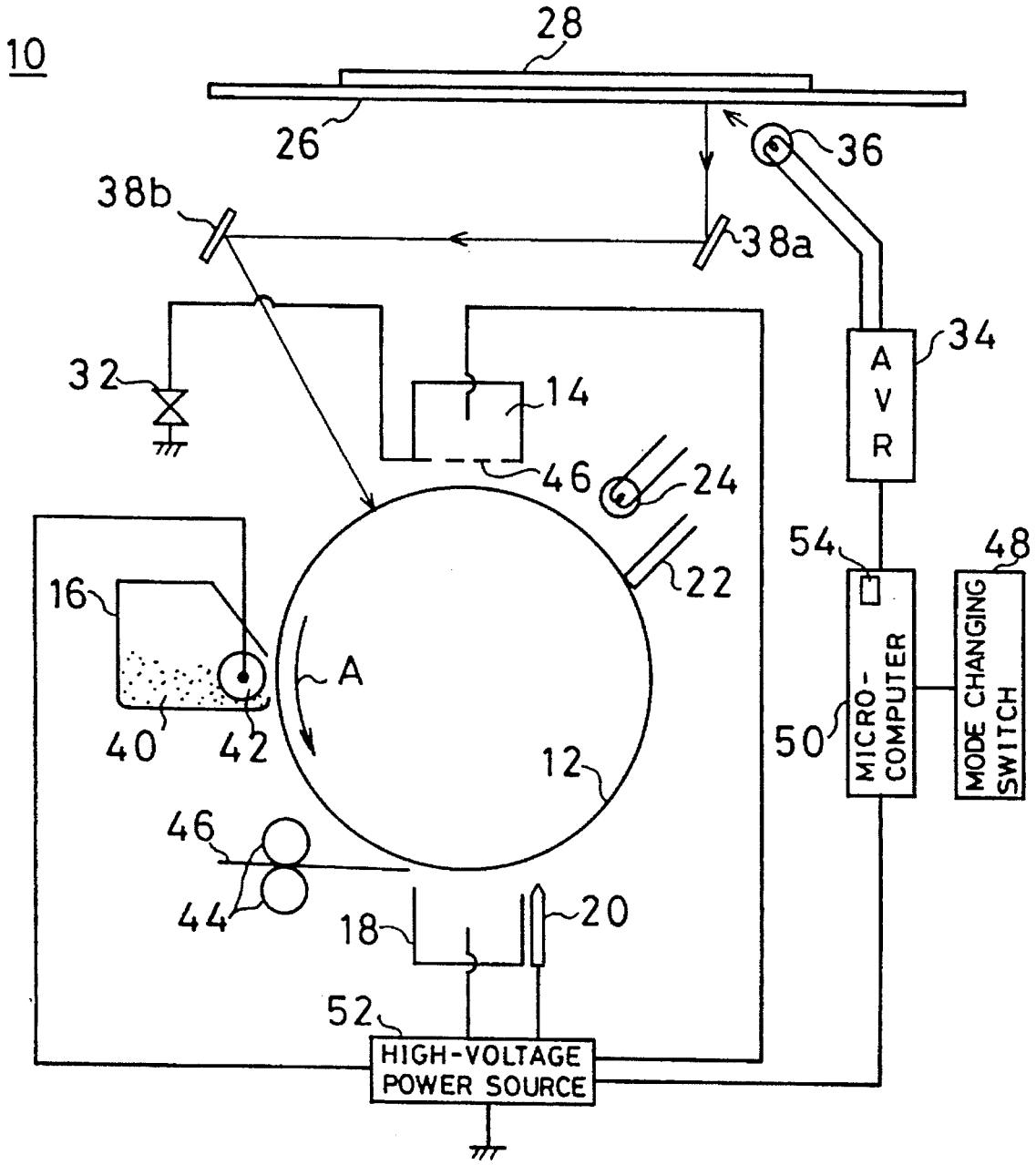
FIG. 35 is an illustrative view showing another embodiment according to the present invention.
Figure 36:
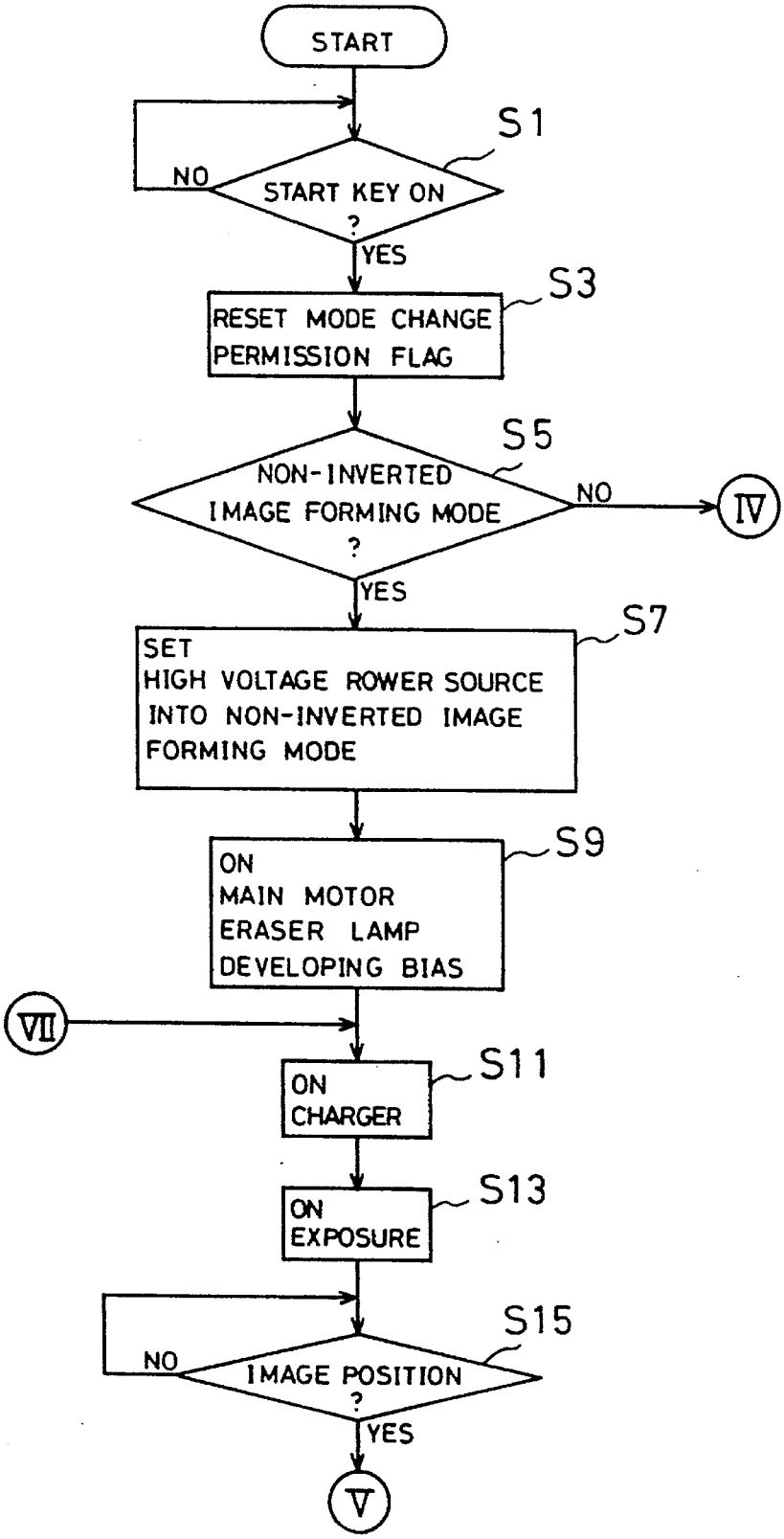
FIG. 36 is a flowchart showing a portion of an operation of the FIG. 35 embodiment.
Figure 37:
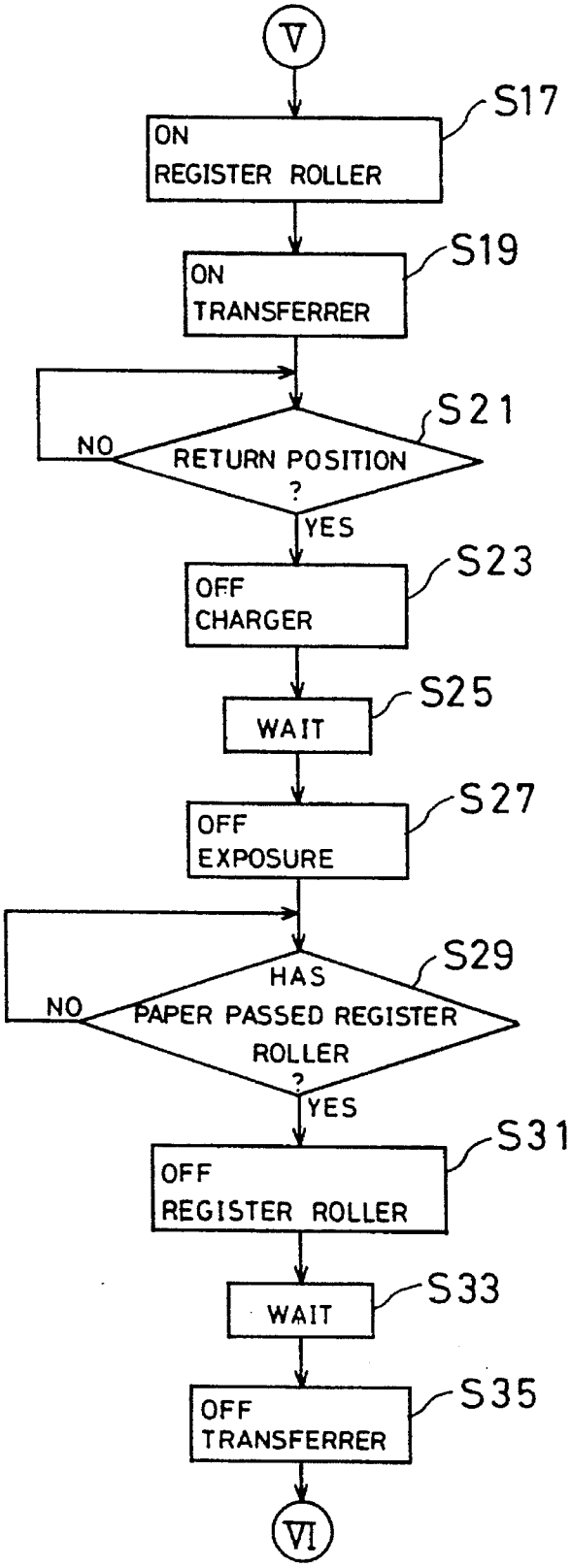
FIG. 37 is a flowchart showing a portion of an operation of the FIG. 35 embodiment.
Figure 38:
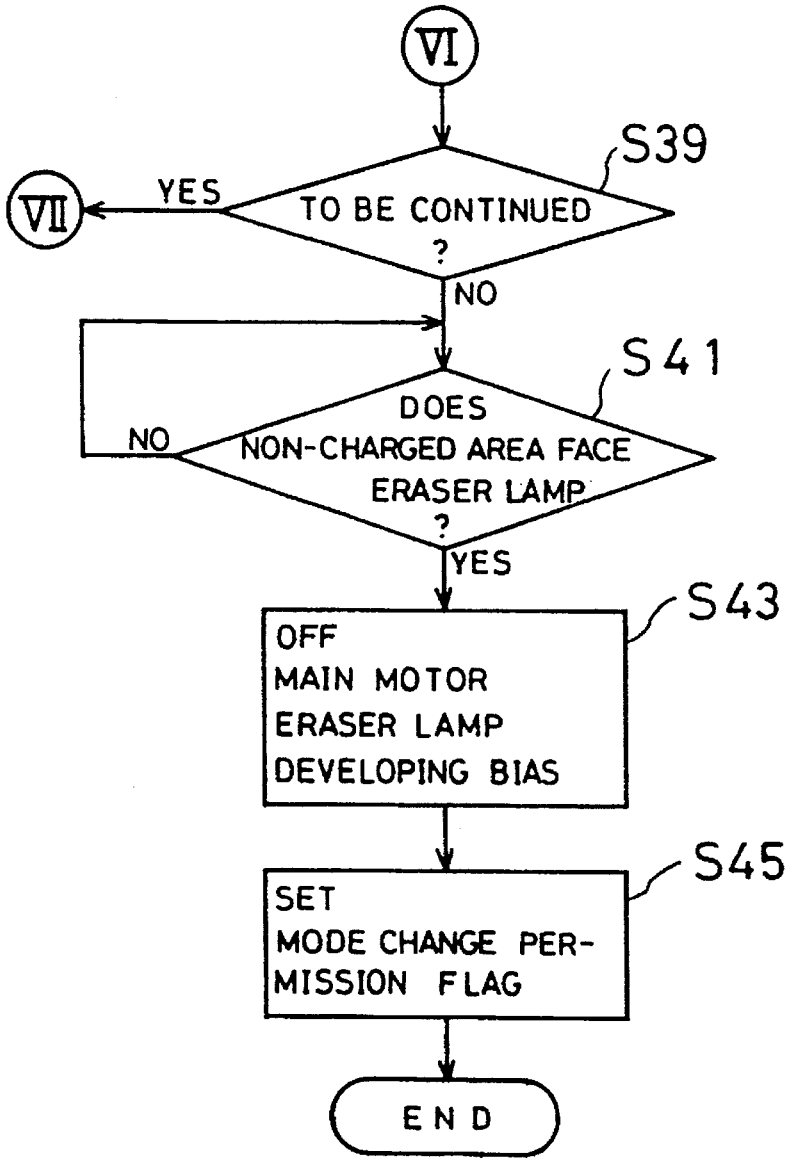
FIG. 38 is a flowchart showing a portion of an operation of the FIG. 35 embodiment.
Figure 39:
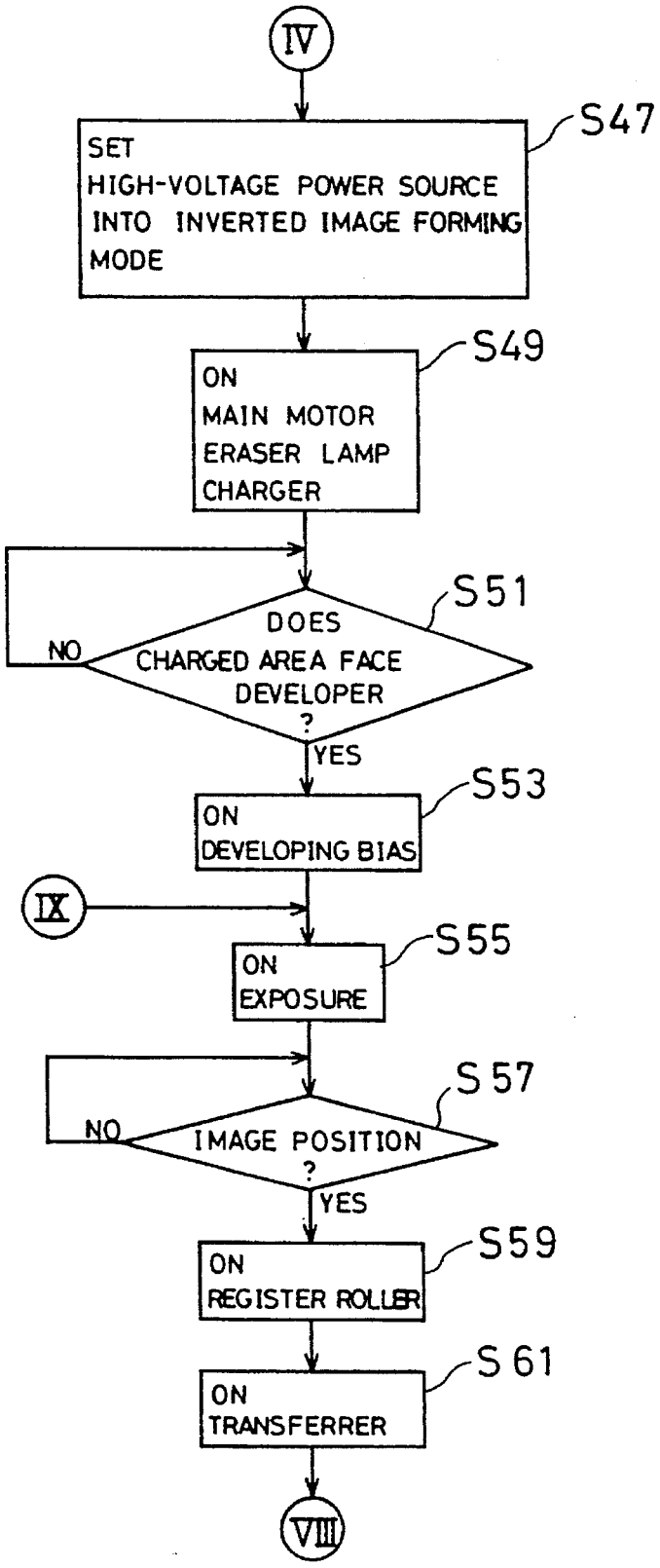
FIG. 39 is a flowchart showing a portion of an operation of the FIG. 35 embodiment.
Figure 40:
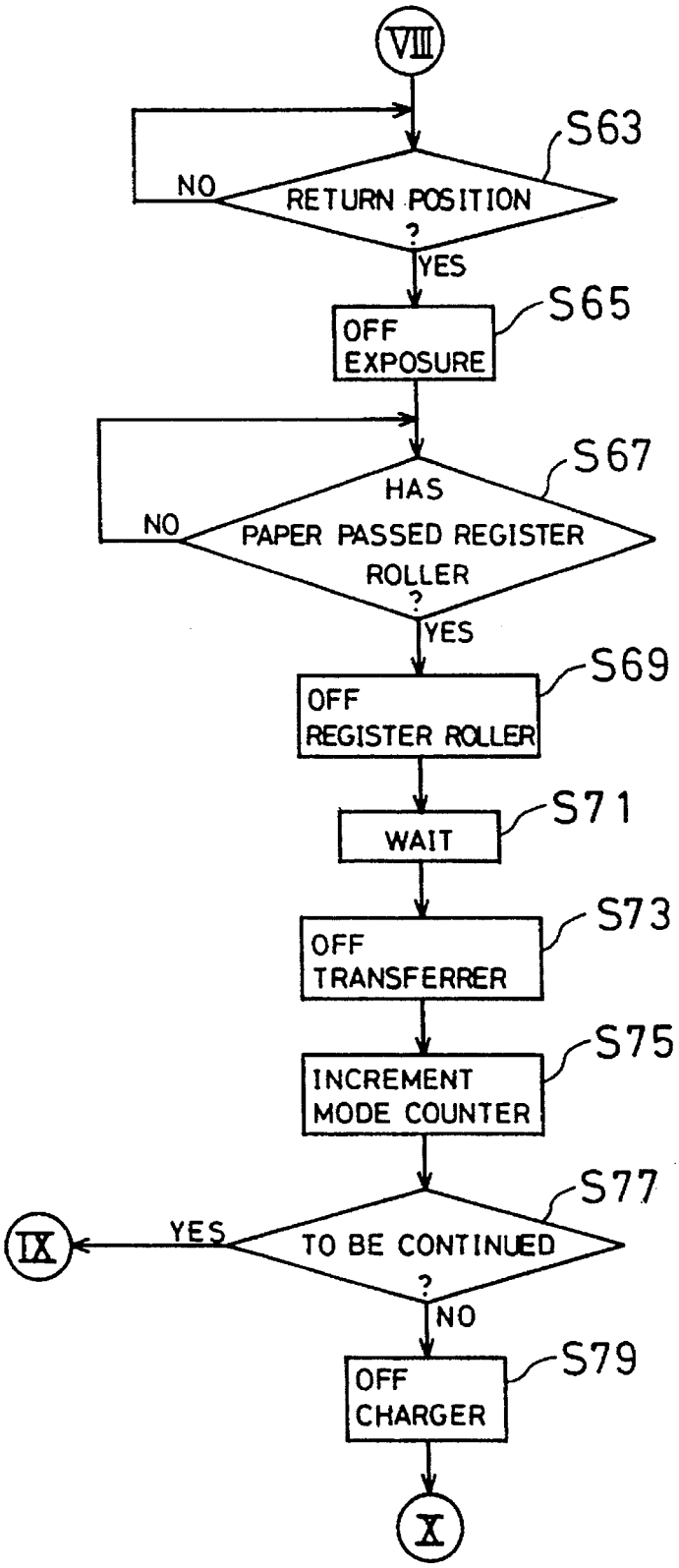
FIG. 40 is a flowchart showing a portion of an operation of the FIG. 35 embodiment.
Figure 41:
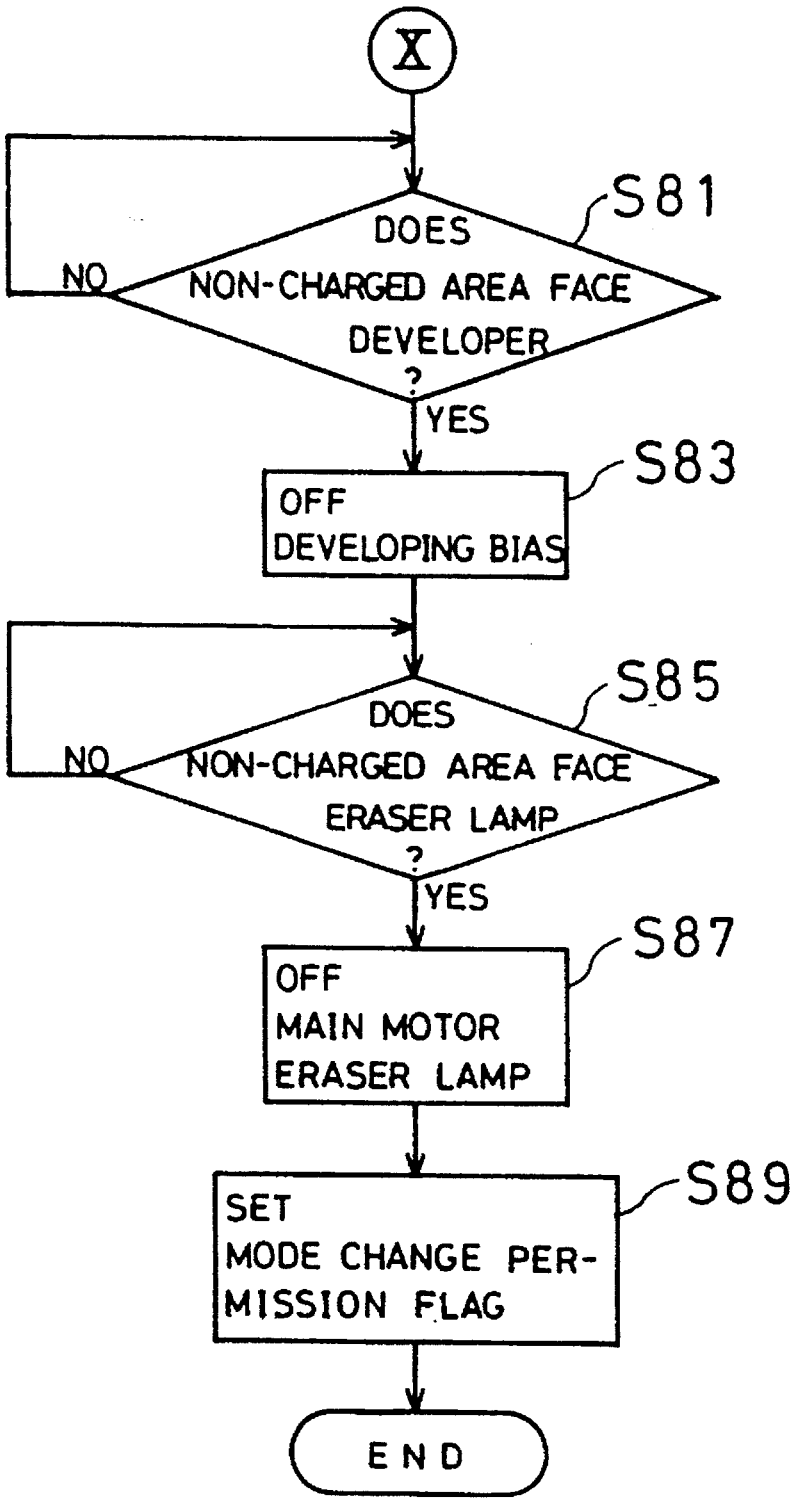
FIG. 41 is a flowchart showing a portion of an operation of the FIG. 35 embodiment.

With referring FIG. 35, an electrophotographying apparatus 10 of another embodiment according to the present invention has structure similar to that of the apparatus 10 shown in FIG. 1 except that the counter **56*a* and the timer 58*a* are omitted from the microcomputer 50. Furthermore, the microcomputer 50 executes operation steps shown in FIG. 36 to FIG. 41 in performing the image forming process; however, such operation steps are similar to the operation steps shown in FIG. 2 to FIG. 7, and therefore, by applying the same step numbers to the same steps, a duplicate description will be omitted here. In addition, the steps S37 and S73** are not required in this embodiment shown.

Figure 42:
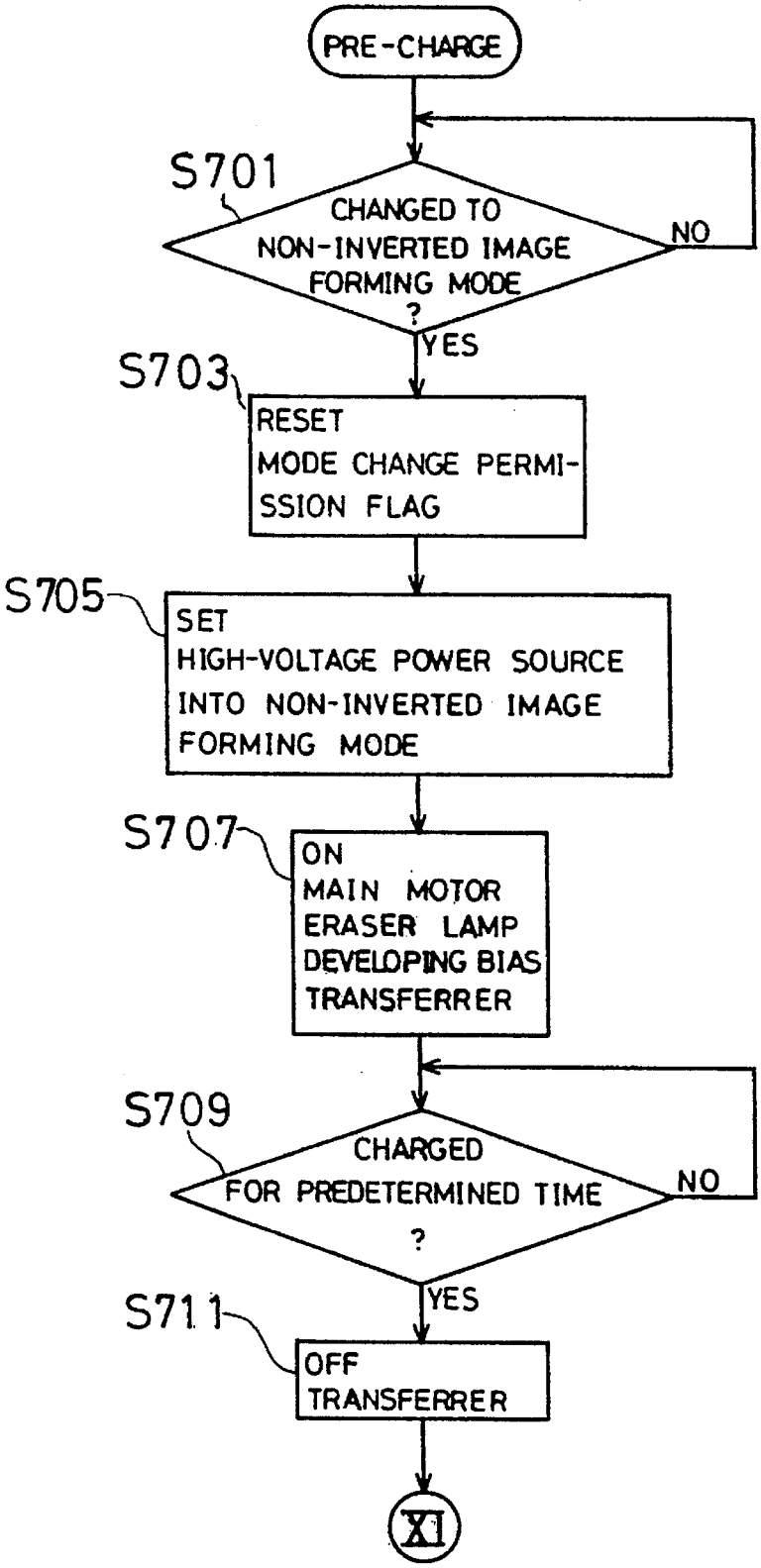
FIG. 42 is a flowchart showing a portion of an operation of the FIG. 35 embodiment.
Figure 43:
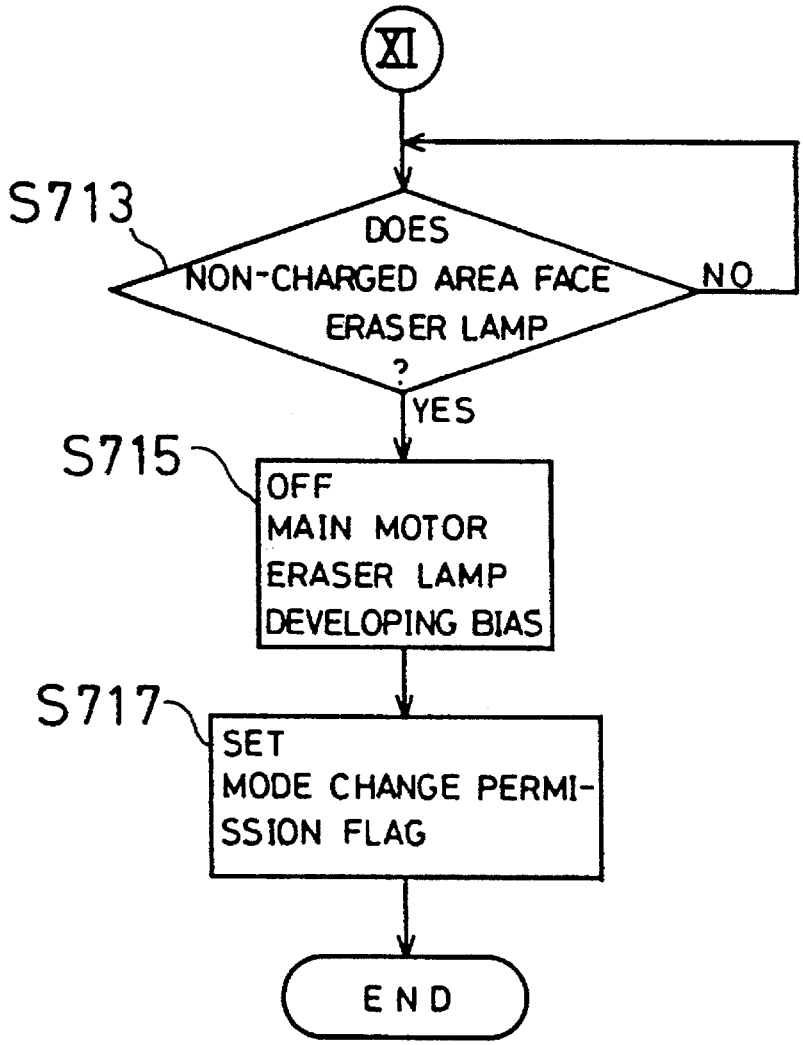
FIG. 43 is a flowchart showing a portion of an operation of the FIG. 35 embodiment.
Figure 44:
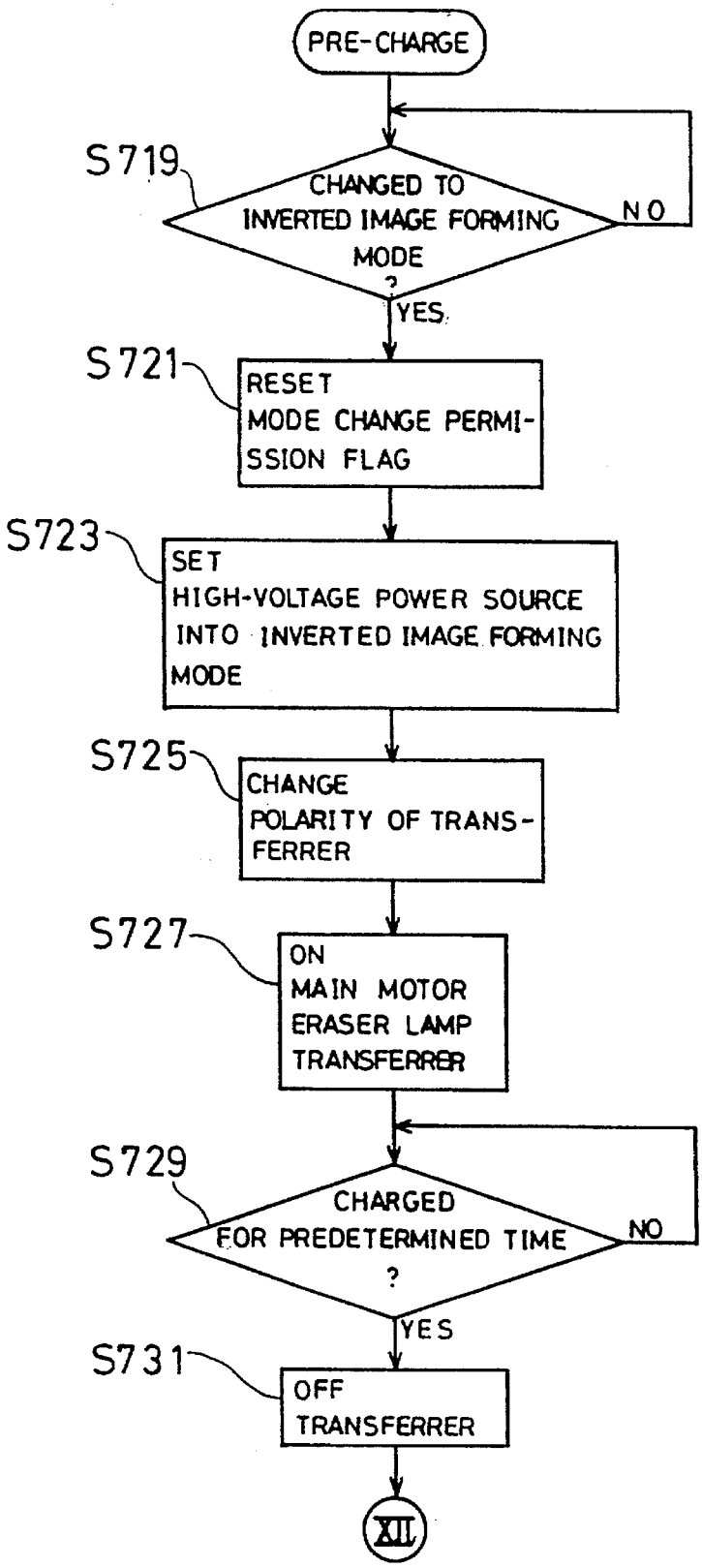
FIG. 44 is a flowchart showing a portion of an operation of the FIG. 35 embodiment.
Figure 45:
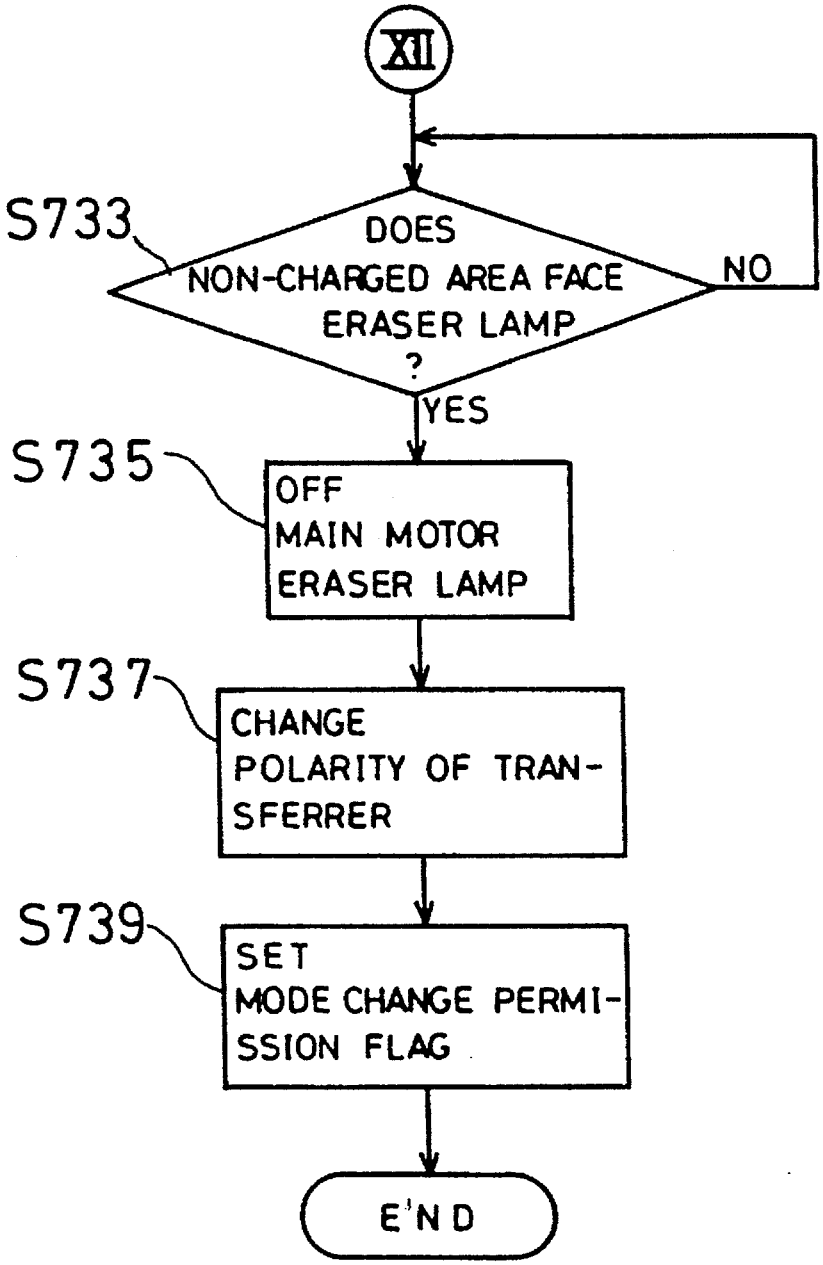
FIG. 45 is a flowchart showing a portion of an operation of the FIG. 35 embodiment.

The microcomputer 50 controls the pre-charge at a time when the image forming mode is changed from the inverted image forming mode to the non-inverted image forming mode according to the operation steps shown in FIG. 42 and FIG. 43, and the microcomputer 50 controls the pre-charge at a time that the image forming mode is changed from the non-inverted image forming mode to the inverted image forming mode according to the operation steps shown in FIG. 44 and FIG. 45.

First, with referring FIG. 42 and FIG. 43, the pre-charge at a time when the image forming mode is changed into the non-inverted image forming mode will be described. If it is detected in a step S701 that the image forming mode is changed into the non-inverted image forming mode, in a step S703, the mode change permission flag 54 is reset, and then, the high-voltage power source 52 is set to be adapted to the non-inverted image forming mode in a step S705. Thereafter, in a step S707, the main motor, the eraser lamp 24, developing bias and the transferrer 18 are turned-on, and then, in a step S709, in order to sufficiently remove the influence of the preceding image forming mode, that is, the inverted image forming mode, the photosensitive drum 12 is pre-charged by the transferrer 18 with −4.7 kV, for example, for a predetermined time, and then, in a step S711, the transferrer 18 is turned-off. Succeedingly, if it is determined in a step S713 that the charge ended area (non-charged area) of the photosensitive drum 12 faces the eraser lamp 24, in a step S715, the main motor, the eraser lamp 24 and the developing bias are turned-off, and in a step S717, the mode change permission flag 54 is set, and thereafter, the process is terminated.

Next, with referring FIG. 44 and FIG. 45, the pre-charge occurring at a time that the image forming mode is changed from the non-inverted image forming mode to the inverted image forming mode will be described. If it is determined in a step S719 that the image forming mode is changed into the inverted image forming mode, in a step S721, the mode change permission flag 54 is reset, and in a next step S723, the high-voltage power source 52 is set to be adapted to the inverted image forming mode. Next, in a step S725, the polarity of the transferrer 18 is inverted, and then, in a step S727, the main motor, the eraser lamp 24 and the transferrer 18 are turned-on. Therefore, the voltage of +4.3 kV, for example, is applied to the transferrer 18. Thereafter, in a step S729, in order to sufficiently eliminate the charge of the photosensitive drum 12 in the preceding image forming mode, that is, the inverted image forming mode, the transferrer 18 is turned-on for a predetermined time, and thereafter, in a step S731, the transferrer 18 is turned-off. Next, in a step S733, the charge ended area (non-charged area) of the photosensitive drum 12 by the charger 18 faces the eraser lamp 24, the main motor and the eraser lamp 24 are turned-off in a step S735, and the polarity of the transferrer 18 is inverted again in a step S737, and then, the mode change permission flag 54 is set in a step S739. Then, the process is terminated.

In accordance with this embodiment shown, the photosensitive drum 12 is pre-charged by the transferrer 18 to which the voltage of −4.7 kV or +4.3 kV is applied, it is possible to make the pre-charge time short, and an eraser lamp provided between the charger 14 and the developer 16 as used in the prior art may be omitted.

Figure 46:
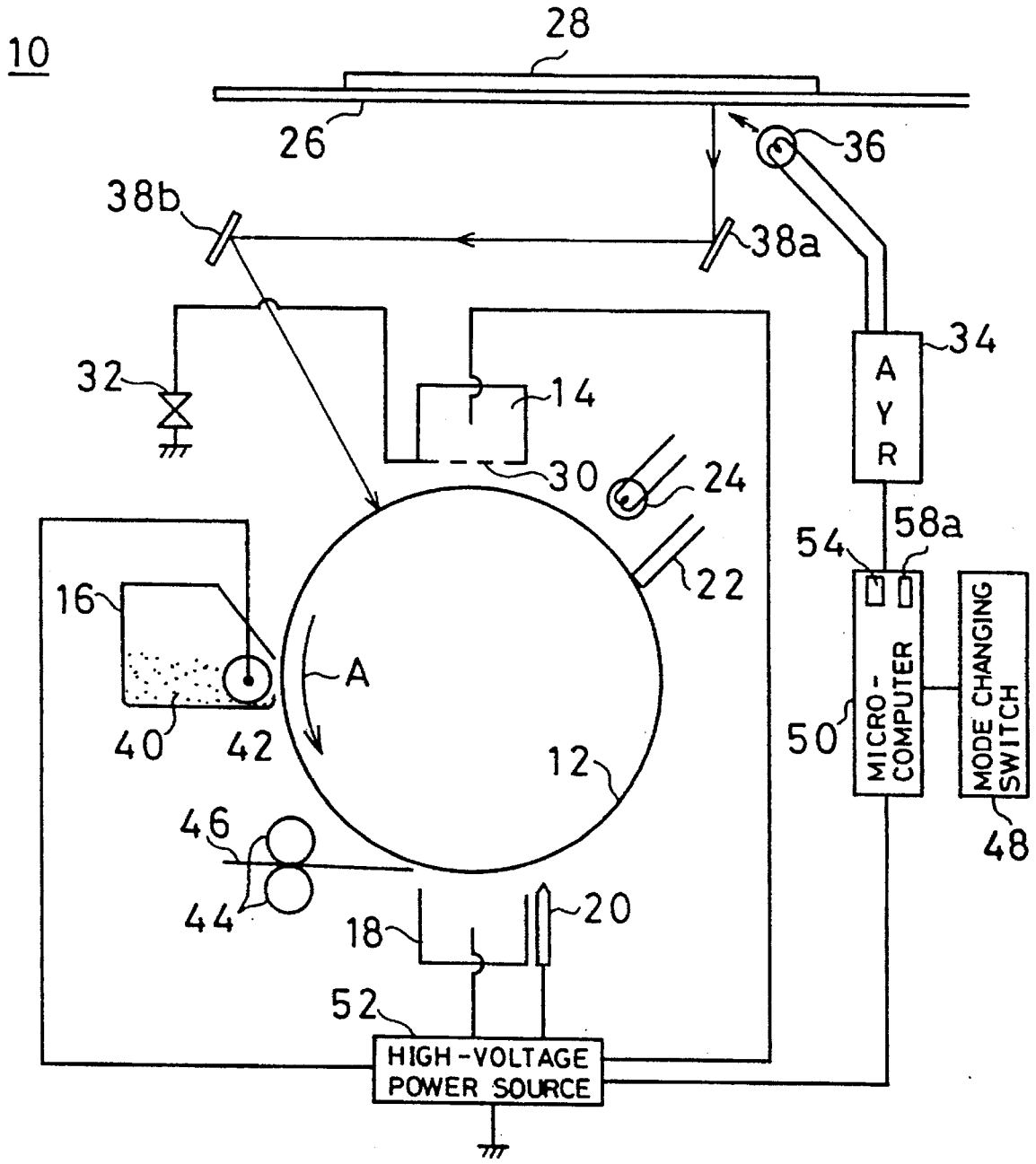
FIG. 46 is an illustrative view showing the other embodiment according to the present invention.

With referring FIG. 46, an apparatus 10 of the other embodiment according to the present invention has structure similar that of the apparatus 10 shown in FIG. 1 except that the counter **56*a* is omitted from the microcomputer 50. Furthermore, the microcomputer 50 executes operation steps shown in FIG. 36 to FIG. 41** in the image forming process, and therefore, in the following, a duplicate description will be omitted here.

Figure 47:
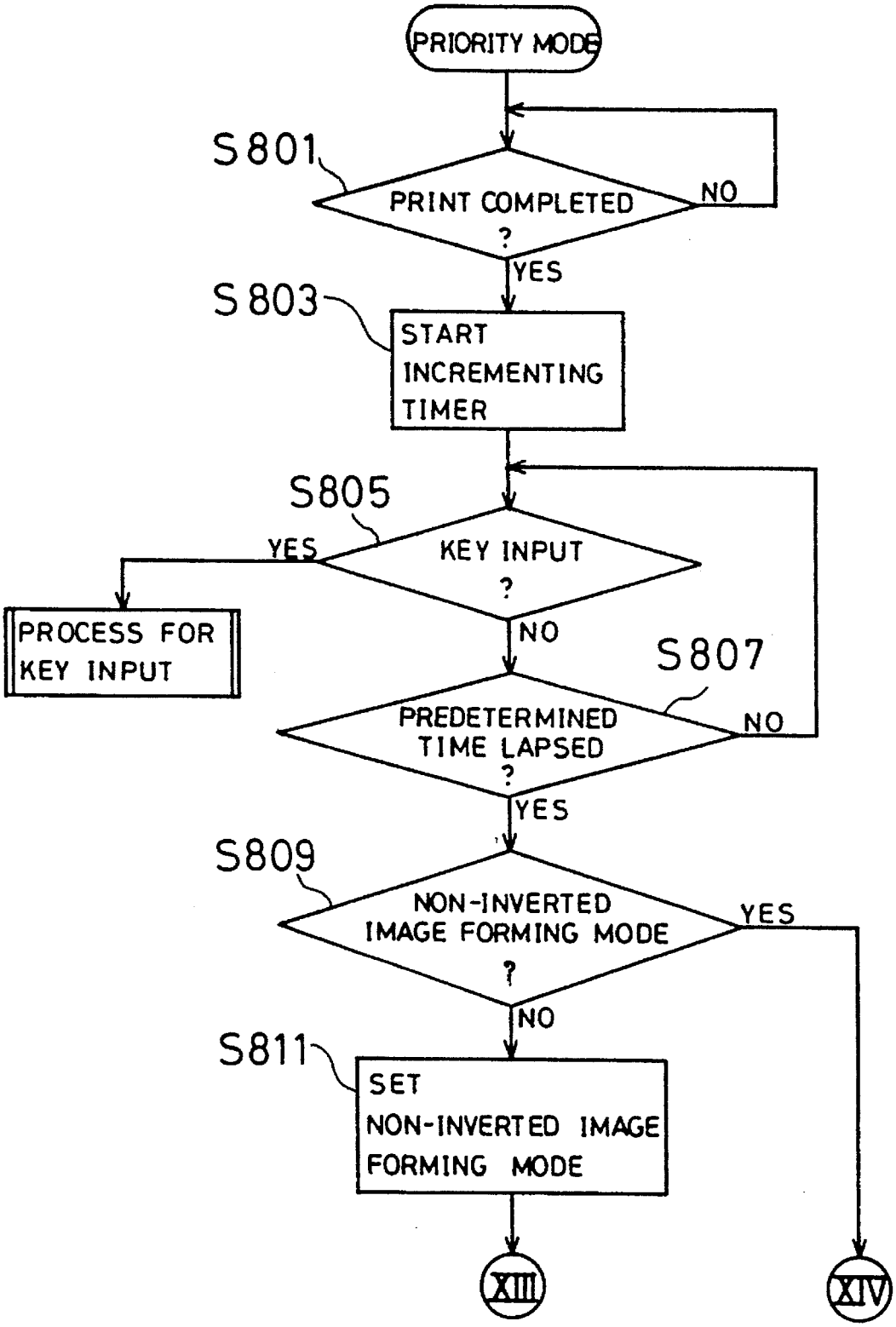
FIG. 47 is a flowchart showing a portion of an operation of the FIG. 46 embodiment.
Figure 48:
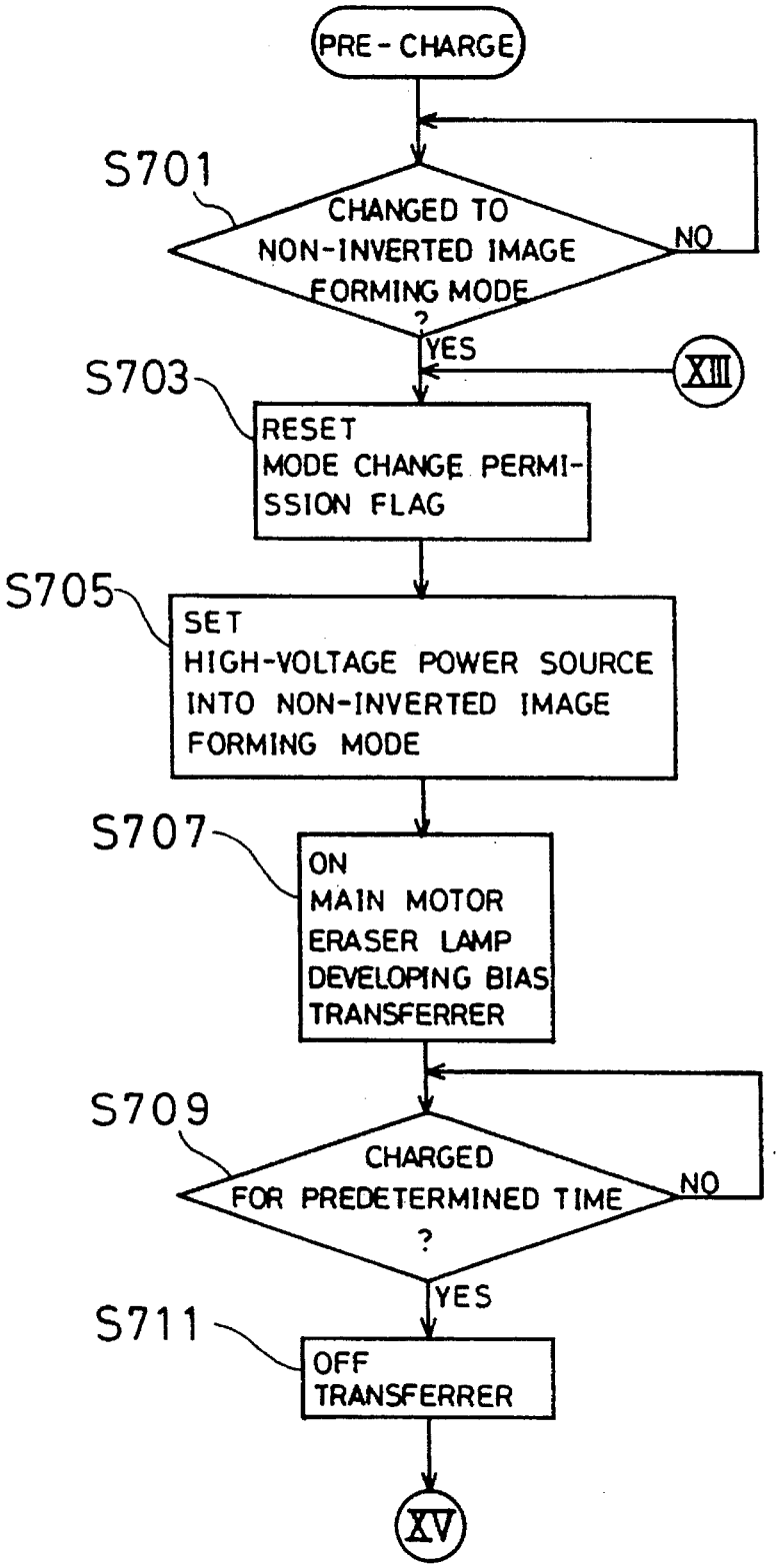
FIG. 48 is a flowchart showing a portion of an operation of the FIG. 46 embodiment.
Figure 49:
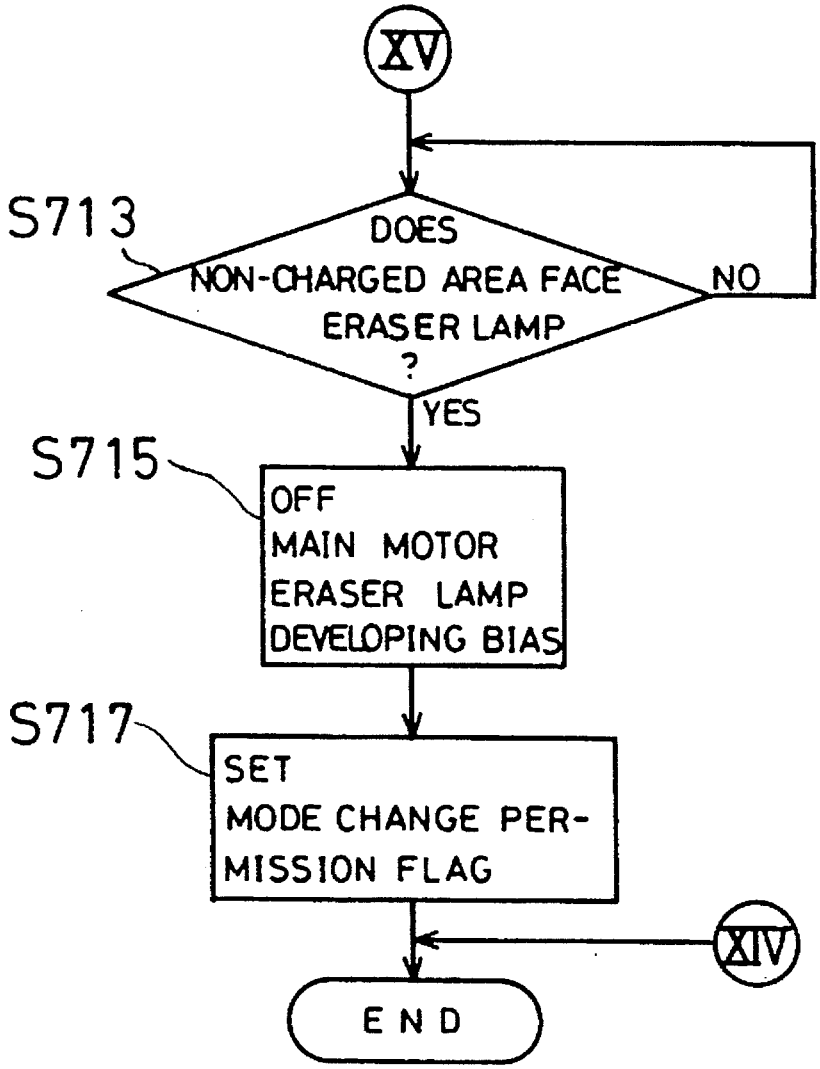
FIG. 49 is a flowchart showing a portion of an operation of the FIG. 46 embodiment.
Figure 50:
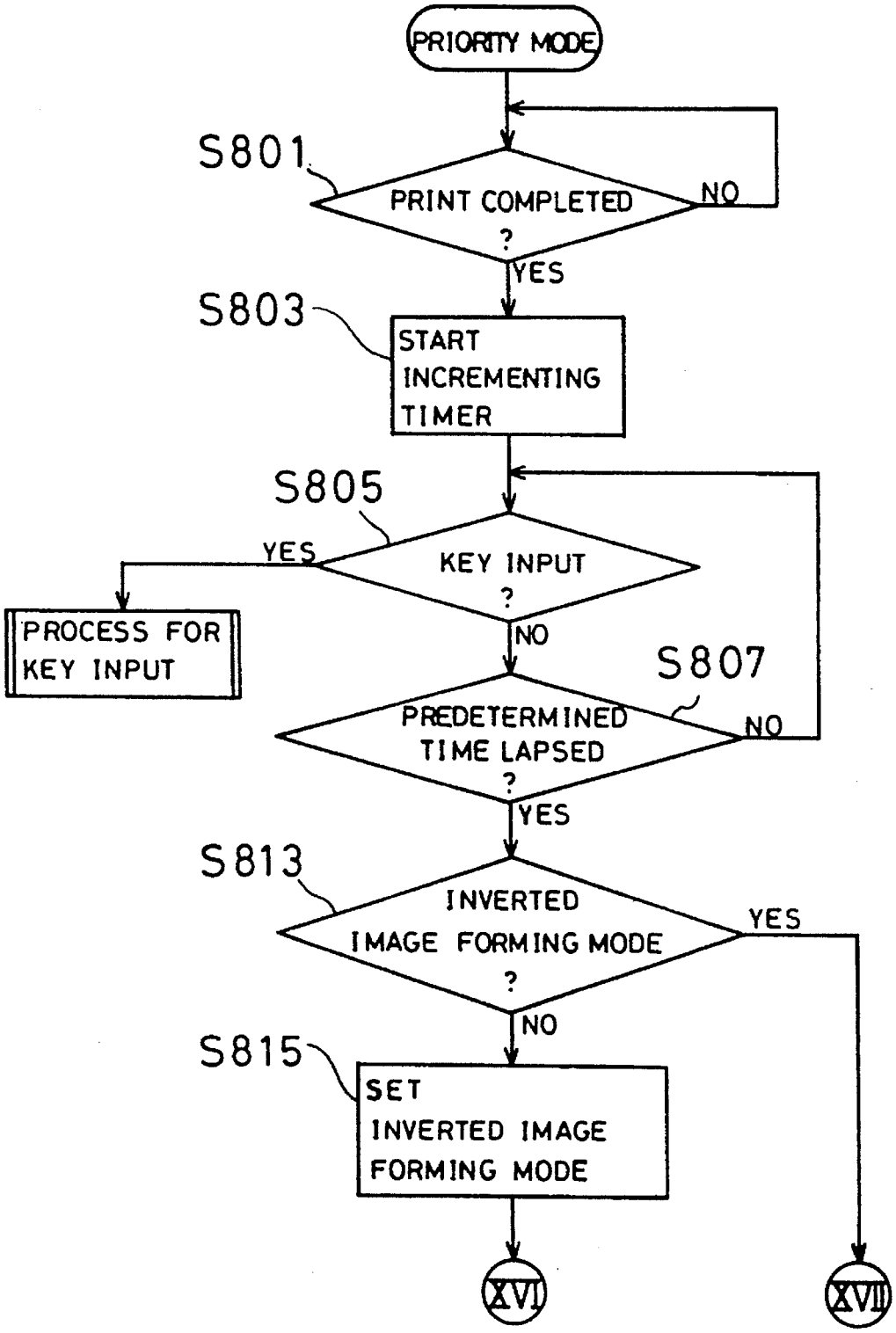
FIG. 50 is a flowchart showing a portion of an operation of the FIG. 46 embodiment.

With referring FIG. 47 to FIG. 52, an operation of the microcomputer 50 in a case where one of the non-inverted image forming mode and the inverted image forming mode is set as a priority mode. An operation of the microcomputer 50 in a case where the non-inverted image forming mode is the priority mode is shown in FIG. 47 to FIG. 49. If the image forming process is completed in the step S801, in a step S803, a counting operation of the timer **58*a* is started. Thereafter, if any key is operated in a step S805, the microcomputer 50 executes operation steps on the basis of the key entry; however, if no key is operated, it is determined in a step S807 whether or not a predetermined time has elapsed. Then, if the predetermined time has elapsed, in a step S809, it is determined whether or not a present image forming mode is the non-inverted image forming mode. Then, "YES" is obtained in the step S809, the process is completed; however, if "NO" is determined in the step S809, in a step S811, the image forming mode is set into the non-inverted image forming mode, and then, the process proceeds to the step S703 shown in FIG. 48. In addition, operation steps shown in FIG. 48 and FIG. 49 are similar to operation steps shown in FIGS. 42 and 43**, and therefore, by applying the same step numbers to the same steps, a duplicate description will be omitted here.

Figure 51:
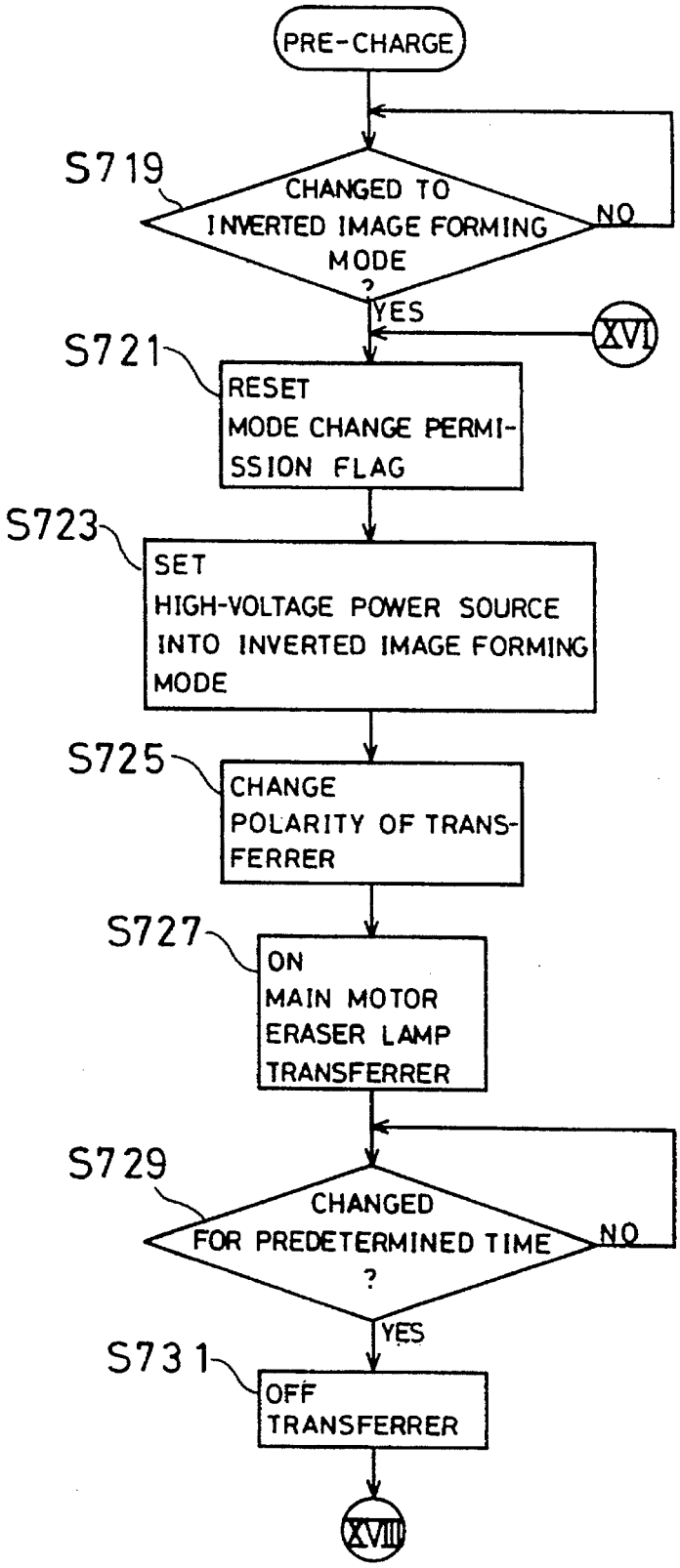
FIG. 51 is a flowchart showing a portion of an operation of the FIG. 46 embodiment.
Figure 52:
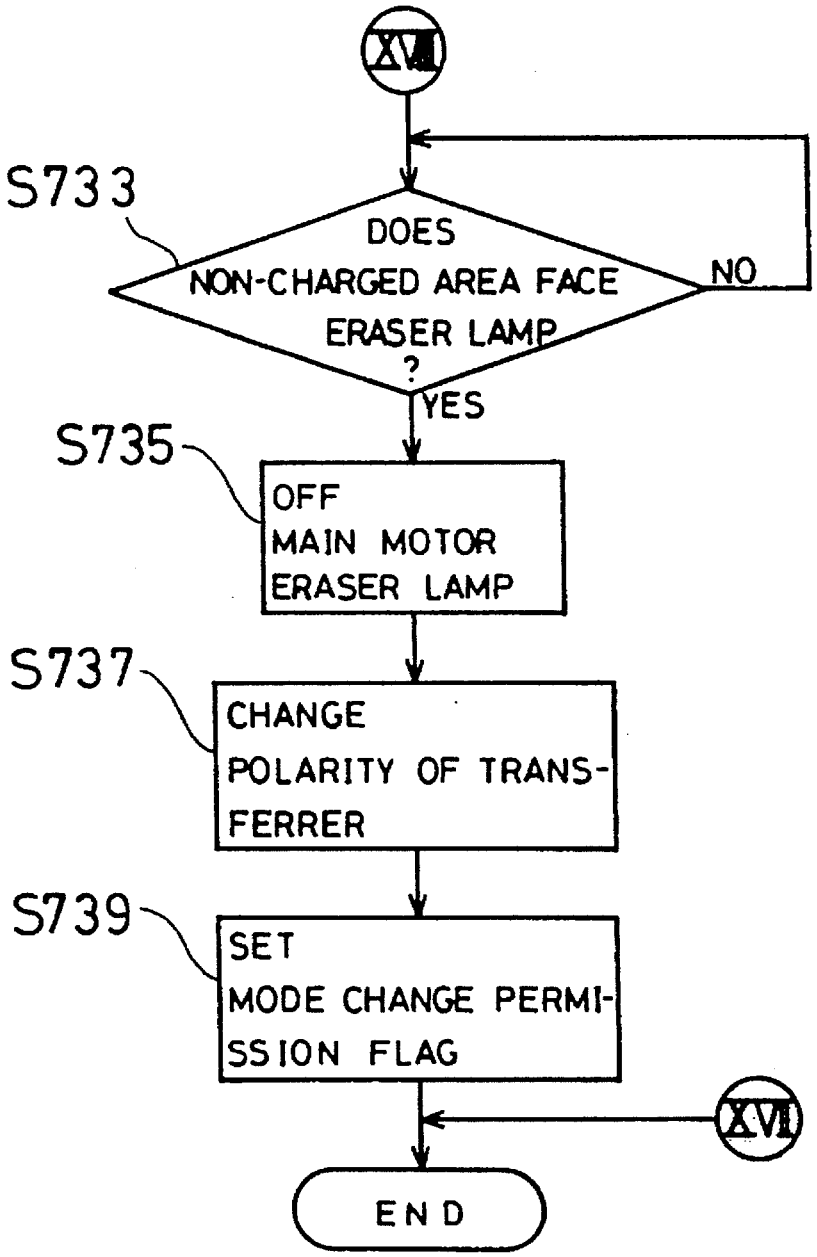
FIG. 52 is a flowchart showing a portion of an operation of the FIG. 46 embodiment.

Next, an operation of the microcomputer 50 in a case where the inverted image forming mode is the priority mode. Such an operation is similar to an operation shown in FIG. 47 except that it is determined in a step S813 whether or not the present image forming mode is the inverted image forming mode, and the image forming mode is set into the inverted image forming mode in a step S815. Furthermore, operation steps shown in FIG. 51 and FIG. 52 are similar to the operation steps shown in FIG. 44 and FIG. 45. Therefore, by applying the same step numbers to the same steps, a duplicate description will be omitted here.

In a case where the non-inverted image forming mode is set as the priority mode, if the present mode is the inverted image forming mode and no image forming operation is performed for a predetermined time, the image forming mode is changed into the non-inverted image forming mode, and then, the photosensitive drum 12 is pre-charged for a predetermined time. Furthermore, in a case where the inverted image forming mode is set as the priority mode, if the present image forming mode is the non-inverted image forming mode and no image forming operation is performed for a predetermined time, the image forming mode is changed into the inverted image forming mode, and then, the photosensitive drum 12 is pre-charged.

In accordance with this embodiment shown, even when the image forming mode is automatically returned to the priority mode, it is possible to eliminate the electric charge on the photosensitive drum 12 with the charging polarity of the preceding image forming mode by the pre-charge, and therefore, the user can rapidly perform the image forming operation in the priority mode.

In addition, in the above described embodiments, a electrophotogrpahic coping apparatus is described; however, the present invention can be applied to a facsimile, printer, and etc.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus in which a photosensitive member is pre-charged prior to starting an image forming process, comprising:

charging means for charging said photosensitive member with a predetermined polarity;

forming means for forming an electrostatic latent image on said photosensitive member charged by said charging means;

developing means for developing said electrostatic latent image to obtain a toner image;

transfer means for applying a transferring electric field to transfer said toner image onto a paper;

selecting means for selecting one of an inverted image forming mode and a non-inverted image forming mode;

parameter setting means for evaluating a time associated parameter of a selected one of said image forming modes prior to a different other image forming mode being selected by said selecting means;

timer means in which a pre-charge of said photosensitive member is set for a time based on the said time associated parameter; and turning-on means for turning-on one of said charging means and said transfer means during said pre-charge time set in said timer means prior to starting the image forming process of the selected different other image forming mode.

2. An image forming apparatus according to claim 1, wherein said turning-on means turns-on said charging means prior to starting an image forming process with said inverted image forming mode being selected as said different other image forming mode, and said transfer means prior to starting of an image forming process with said non-inverted image forming mode being selected as said different other image forming mode.

3. An image forming apparatus according to claim 2, wherein said parameter setting means evaluates said time associated parameter on the basis of at least one of the number of image forming operations in said selected one image forming mode and a stop time between said selected one image forming mode and a succeeding selected different other image forming mode.

4. An image forming apparatus according to claim 3, wherein said number of image forming operations is divided into a plurality of ranges, and said parameter setting means includes counter means for obtaining a count value according to a range of the number of image forming operations of said selected one image forming mode.

5. An image forming apparatus according to claim 4, wherein said stop time is divided into a plurality of ranges, and the count value of said counter means is determined according to a range of the stop time.

6. An image forming apparatus according to claim 5, wherein said counter means is incremented according to said range of the number of image forming operations of said selected one image forming mode, and decremented according to said range of the stop time.

7. An image forming apparatus in which a photosensitive member is pre-charged prior to starting an image forming process, comprising:

charging means for charging said photosensitive member with a predetermined polarity;

forming means for forming an electrostatic latent image on said photosensitive member being charged by said charging means;

developing means for developing said electrostatic latent image to obtain a toner image;

transfer means for applying a transferring electric field to transfer said toner image onto a paper;

selecting means for selecting one of an inverted image forming mode and a non-inverted image forming mode; and turning-on means for continuously turning on said transfer means for a predetermined time after completion of the image forming process in said inverted image forming mode.

8. An image forming apparatus according to claim 7, further comprises time determining means for determining said predetermined time.

9. An image forming apparatus according to claim 8, wherein said time determining means includes counter means for counting the number of image forming operations in said inverted image forming mode, and said predetermined time is determined as a function of said number of image forming operations.

10. An image forming apparatus comprising:

a photosensitive member;

charging means for charging said photosensitive member with a predetermined polarity;

forming means for forming an electrostatic latent image on said photosensitive member being charged by said charging means;

developing means for developing said electrostatic latent image to obtain a toner image;

transfer means for applying a transferring electric field to transfer said toner image onto a paper;

selecting means for selecting one of an inverted image forming mode and a non-inverted image forming mode;

start key means for designating a start of an image forming process; and turning-on means for turning on said transfer means for a predetermined time in response to an operation of said start key means wherein a polarity of said transferring electric field applied to said photosensitive member by said transfer means is changeable, and said turning-on means includes changing means for changing the polarity of said transfer means when an image forming mode is changed into said inverted image forming mode.

11. An image forming apparatus comprising:

a photosensitive member;

charging means for charging said photosensitive member with a predetermined polarity;

forming means for forming an electrostatic latent image on said photosensitive member being charged by said charging means;

developing means for developing said electrostatic latent image to obtain a toner image;

transfer means for applying a transferring electric field to transfer said toner image onto a paper;

selecting means for selecting one of an inverted image forming mode and a non-inverted image forming mode;

start key means for designating a start of an image forming process;

turning-on means for turning on said transfer means for a predetermined time in response to an operation of said start key means, and setting means for setting a selected one of said inverted image forming mode and said non-inverted image forming mode as a priority mode, wherein said priority mode is selected by said selecting means when a time during which no image forming operation is performed exceeds a predetermined time.

12. An image forming apparatus according to claim 11, further comprising:

measuring means for measuring a time during which no image forming operation is performed;

comparing means for comparing a time measured by said measuring means and said predetermined time;

determining means for determining whether or not a present image forming mode is said priority mode; and designating means for designating a change of image forming mode to said selecting means at a time when said measured time exceeds said predetermined time and said image forming mode is not said priority mode.

* * * * *